US012104805B2

(12) United States Patent
Lin et al.

(10) Patent No.: US 12,104,805 B2
(45) Date of Patent: Oct. 1, 2024

(54) HEAT EXCHANGE DEVICE AND REFRIGERANT CIRCULATION SYSTEM

(71) Applicants: Guangdong Midea White Home Appliance Technology Innovation Center Co., Inc., Foshan (CN); Midea Group Co., Ltd., Foshan (CN)

(72) Inventors: Chen Lin, Foshan (CN); Chenzhong Jiang, Foshan (CN); Jiaji He, Foshan (CN); Hiroshi Omori, Foshan (CN); Bao Yue, Foshan (CN)

(73) Assignees: GUANGDONG MIDEA WHITE HOME APPLIANCE TECHNOLOGY INNOVATION CENTER CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 211 days.

(21) Appl. No.: 17/718,179

(22) Filed: Apr. 11, 2022

(65) Prior Publication Data

US 2022/0268453 A1 Aug. 25, 2022

Related U.S. Application Data

(63) Continuation of application No. PCT/CN2020/133950, filed on Dec. 4, 2020.

(30) Foreign Application Priority Data

Dec. 6, 2019 (CN) ..... 201911244360.5
Dec. 6, 2019 (CN) ..... 201911244517.4
(Continued)

(51) Int. Cl.
*F24F 1/0033* (2019.01)
*F24F 1/0284* (2019.01)
*F24F 1/0325* (2019.01)

(52) U.S. Cl.
CPC ..... *F24F 1/0033* (2013.01); *F24F 1/0284* (2019.02); *F24F 1/0325* (2019.02)

(58) Field of Classification Search
CPC ..... F28F 1/24; F28F 1/14; F28F 1/38; F24F 13/222; F24F 1/0325; F24F 1/0323;
(Continued)

(56) References Cited

U.S. PATENT DOCUMENTS 4,544,023 A 10/1985 Marciniak
4,958,500 A 9/1990 Kuroda et al.
(Continued)

FOREIGN PATENT DOCUMENTS

CN 1707169 A 12/2005
CN 2751251 Y 1/2006
(Continued)

OTHER PUBLICATIONS

JPH05172362A Translation (Year: 1993).*
(Continued)

*Primary Examiner* — Schyler S Sanks
(74) *Attorney, Agent, or Firm* — Morgan, Lewis & Bockius LLP

(57) ABSTRACT

A heat exchange device and a refrigerant circulation system are disclosed. The heat exchange device includes a housing, defining a first air inlet and a first air outlet; wherein the first air inlet and the first air outlet are spaced apart along a first direction; and a first heat exchange component, arranged in the housing and comprising a plurality of heat exchange fins spaced apart along a second direction; wherein the first heat exchange component is arranged opposite to the first air inlet along a third direction; the second direction is perpendicular to the first direction, and the third direction is perpendicular to the first direction and the second direction.

12 Claims, 27 Drawing Sheets

(30) Foreign Application Priority Data

Dec. 6, 2019 (CN) ..... 201911245238.X
Dec. 6, 2019 (CN) ..... 201922181634.2
Dec. 6, 2019 (CN) ..... 201922181652.0
Dec. 6, 2019 (CN) ..... 201922182809.1
Dec. 6, 2019 (CN) ..... 201922190855.6
Dec. 6, 2019 (CN) ..... 201922191032.5

(58) Field of Classification Search
CPC ..... F24F 1/0314; F24F 1/0067; F24F 1/0063; F24F 1/0057
See application file for complete search history.

(56) References Cited

U.S. PATENT DOCUMENTS

| | | | | |
|---|---|---|---|---|
| 2005/0284168 | A1 | 12/2005 | Lee et al. | |
| 2005/0284170 | A1* | 12/2005 | Lee | F24F 1/0014 62/428 |
| 2015/0075213 | A1 | 3/2015 | Ishibashi et al. | |
| 2018/0156491 | A1* | 6/2018 | Ikeda | F24F 13/085 |

FOREIGN PATENT DOCUMENTS

| | | | | |
|---|---|---|---|---|
| CN | 1880895 | A | 12/2006 | |
| CN | 101592392 | A | 12/2009 | |
| CN | 101907374 | A | 12/2010 | |
| CN | 102235717 | A | 11/2011 | |
| CN | 102292600 | A | 12/2011 | |
| CN | 102589053 | A | 7/2012 | |
| CN | 202561903 | U | 11/2012 | |
| CN | 103807916 | A | 5/2014 | |
| CN | 104374004 | A | 2/2015 | |
| CN | 104949201 | A | 9/2015 | |
| CN | 205048572 | U | 2/2016 | |
| CN | 105588187 | A | 5/2016 | |
| CN | 105841243 | A | 8/2016 | |
| CN | 105928060 | A | 9/2016 | |
| CN | 106225087 | A | 12/2016 | |
| CN | 106482193 | A | 3/2017 | |
| CN | 206073351 | U | 4/2017 | |
| CN | 107192028 | A | 9/2017 | |
| CN | 107388874 | A | 11/2017 | |
| CN | 107477675 | A | 12/2017 | |
| CN | 206771639 | U | 12/2017 | |
| CN | 107990758 | A | 5/2018 | |
| CN | 108278683 | A | 7/2018 | |
| CN | 207688320 | U | 8/2018 | |
| CN | 208011889 | U | 10/2018 | |
| CN | 108895582 | A | 11/2018 | |
| CN | 208108301 | U | 11/2018 | |
| CN | 208238598 | U | 12/2018 | |
| CN | 109780631 | A | 5/2019 | |
| CN | 208901508 | U | 5/2019 | |
| CN | 209558557 | U | 10/2019 | |
| CN | 111076306 | A | 4/2020 | |
| CN | 211400027 | U | 9/2020 | |
| CN | 211695347 | U | 10/2020 | |
| CN | 211695348 | U | 10/2020 | |
| CN | 211695349 | U | 10/2020 | |
| CN | 211781451 | U | 10/2020 | |
| CN | 211781452 | U | 10/2020 | |
| CN | 211925909 | U | 11/2020 | |
| DE | 2327614 | A1 | 12/1974 | |
| EP | 1617151 | A1 | 1/2006 | |
| EP | 3076117 | A1 * | 10/2016 | F22B 37/101 |
| GB | 1474432 | A | 5/1977 | |
| JP | S599435 | A | 1/1984 | |
| JP | H05172362 | A * | 7/1993 | |
| JP | H07205644 | A | 8/1995 | |
| JP | 08086464 | A * | 4/1996 | F24F 1/0057 |
| JP | 2000009325 | A | 1/2000 | |
| JP | 2001263703 | A | 9/2001 | |
| JP | 2006234184 | A * | 9/2006 | F24F 1/0059 |
| KR | 20090116522 | A | 11/2009 | |
| KR | 20190078003 | A | 7/2019 | |
| WO | WO 02/103251 | A2 | 12/2002 | |

OTHER PUBLICATIONS

JP-2006234184-A Translation (Year: 2006).*
JPH0886464A Translation (Year: 1996).*
International search report and Written Opinion of the International Search Authority, International Application No. PCT/CN2020/133951, mailed Feb. 25, 2021 (18 pages).
International search report and Written Opinion of the International Search Authority, International Application No. PCT/ CN2020/133950, mailed Feb. 25, 2021 (18 pages).
Chinese First Office Action, Chinese Application No. 201911244360.5, mailed Oct. 26, 2021 (15 pages).
Chinese Second Office Action, Chinese Application No. 201911244360.5, mailed Mar. 14, 2022 (12 pages).
Chinese First Office Action, Chinese Application No. 201911244517.4, mailed Mar. 29, 2022 (18 pages).
Midea Group Co., Ltd., Australian Office Action, AU Patent Application No. 2020394759, Jul. 12, 2023, 4 pgs.
Midea Group Co., Ltd., CN Office Action, Chinese Patent Application No. 201911245237.5, Jun. 6, 2022, 25 pgs.
Midea Group Co., Ltd., Australian Office Action, AU Patent Application No. 2020394759, Apr. 11, 2023, 4 pgs.
Midea Group Co., Ltd., Extended European Search Report, EP20895797.7, Jan. 26, 2023, 12 pgs.

* cited by examiner

HEAT EXCHANGE DEVICE AND REFRIGERANT CIRCULATION SYSTEM

CROSS REFERENCE TO RELATED APPLICATIONS

This application is a continuation of International (PCT) Patent Application No. PCT/CN2020/133950, filed Dec. 4, 2020, which claims the benefit of the Chinese Patent Applications No. 201911244360.5, 201911244517.4, 201911245238.X, 201922181634.2, 201922181652.0, 201922182809.1, 201922190855.6, and 201922191032.5, all filed on Dec. 6, 2019, with the China National Intellectual Property Administration, the entire contents of which are hereby incorporated by reference in its entirety.

TECHNICAL FIELD

The present disclosure relates to the field of heat exchange device technologies, and in particular to a heat exchange device and a refrigerant circulation system.

BACKGROUND

In the related art, a heat exchange device is arranged with a fan to drive an air flow to exchange heat by forced convection, thereby adjusting the indoor temperature. However, when the indoor temperature decreases, the heat exchange device has a large air volume and a strong blowing sensation, which is easy to cause discomfort to users, and the fan of the heat exchange device operates noisily.

SUMMARY OF THE DISCLOSURE

The present disclosure proposes a heat exchange device, which can achieve soft wind, low operating noise, and good use comfort.

The present disclosure provides a heat exchange device, comprising: a housing, defining a first air inlet and a first air outlet; wherein the first air inlet and the first air outlet are spaced apart along a first direction; and a first heat exchange component, arranged in the housing and comprising a plurality of heat exchange fins spaced apart along a second direction; wherein the first heat exchange component is arranged opposite to the first air inlet along a third direction; the second direction is perpendicular to the first direction, and the third direction is perpendicular to the first direction and the second direction.

According to the heat exchange device of the present disclosure, by rationally arranging the first air inlet and the first air outlet, and correspondingly arranging the first heat exchange component, the air output of the heat exchange device is soft, and the operating noise of the heat exchange device is effectively reduced.

The present disclosure further provides a refrigerant circulation system, comprising a compressor and the above-mentioned heat exchange device; wherein the compressor is disposed outside the housing, and the compressor is in communication with the first heat exchange component.

According to the refrigerant circulation system of the present disclosure, by adopting the above-mentioned heat exchange device, the air outlet is soft, the operation noise is low, and it has good practicability.

The present disclosure further provides an air-conditioning indoor unit, comprising: a housing, comprising a front panel and a rear panel oppositely arranged along a first direction, and comprising an upper side panel and a lower side panel oppositely arranged along a second direction; wherein the first direction is perpendicular to the second direction; the housing defines an accommodating cavity; the front panel is arranged with a first air inlet region, the upper side panel is arranged with a second air inlet region, and the lower side panel is arranged with a first air outlet region; a first heat exchanger, arranged in the accommodating cavity; wherein a projection of the first air inlet region along the first direction at least partly falls on the first heat exchanger; the first heat exchanger and the rear panel are spaced apart along the first direction, and a space between the first heat exchanger and the rear panel defines a settlement enhancement region; and a second heat exchanger, arranged in the accommodating cavity; wherein a projection of the second air inlet region along the second direction at least partly falls on the second heat exchanger 12; the projection of the second heat exchanger along the second direction at least partially falls into the settlement enhancement region.

According to the air-conditioning indoor unit of the present disclosure, the first heat exchanger and the second heat exchanger cool the air in the accommodating cavity to form a cooling airflow, and at least part of the cooling airflow sinks along the settlement enhancement region and is output through the first air outlet region, such that the accommodating cavity is in a negative pressure state. The air outside the housing is input into the accommodating cavity from the first air inlet region and the second air inlet region under the action of the negative pressure in the accommodating cavity, and is cooled by the first heat exchanger and the second heat exchanger to continuously generate cooling airflow. In the air-conditioning indoor unit of the present disclosure, continuous and natural cooling air convection is performed, and low-noise and low-wind feeling cooling and air supply are realized.

The present disclosure further provides an air-conditioning indoor unit, comprising: a housing, comprising a front panel and a rear panel oppositely arranged along a first direction, and comprising an upper side panel and a lower side panel oppositely arranged along a second direction; wherein the first direction is perpendicular to the second direction; the housing defines an accommodating cavity; the front panel is arranged with a first air inlet region, and the lower side panel is arranged with a first air outlet region; and a first heat exchanger, arranged in the accommodating cavity; wherein a projection of the first air inlet region along the first direction at least partly falls on the first heat exchanger; the first heat exchanger and the rear panel are spaced apart along the first direction, and a space between the first heat exchanger and the rear panel defines a settlement enhancement region; wherein a ratio between a thickness of the first heat exchanger along the first direction and a distance between the front panel and the rear panel in the first direction is 0.06-0.5; a ratio between the thickness of the first heat exchanger along the first direction and a distance between the first heat exchanger and the rear panel in the first direction is 0.068-1.

According to the air-conditioning indoor unit of the present disclosure, the ratio between the thickness of the first heat exchanger in the first direction and the distance between the front panel and the rear panel in the first direction is 0.06 to 0.5, and the ratio between the thickness of the first heat exchanger along the first direction and the distance between the first heat exchanger and the rear panel in the first direction is 0.068-1. This proportional design realizes a certain spatial settlement enhancement region and increases the refrigeration efficiency.

The present disclosure further provides a fresh air system, comprising: an air inlet tube assembly, comprising an air inlet tube, a switching device, a fan, and a nozzle; wherein the air inlet tube comprises a first air entering port and a second air entering port; the first air entering port is suitable for connection to outdoors, and the second air entering port is suitable for connection to indoors; the switching device is configured to switch at least one of the first air entering port and the second air entering port to communicate with an inlet of the nozzle; the fan is configured to induce air from at least one of the first air entering port and the second air entering port to enter the air inlet tube and flow toward the nozzle; and a heat exchanger, comprising a housing and a heat exchange component; wherein a first air inlet is defined on a side surface of the housing in a thickness direction, and a second air inlet is defined at an end of the housing in a first direction perpendicular to the thickness direction; the housing further defines an air outlet on a side of the first air inlet away from the second air inlet; the heat exchange component is arranged in the housing and is opposite to the first air inlet in the thickness direction; the outlet of the nozzle is connected to the second air inlet and is configured to spray an airflow toward the air outlet.

According to the fresh air system of the present disclosure, the state of fresh air circulation or indoor circulation can be flexibly switched according to the actual use needs of users, so as to be suitable for different application environments, and the indoor air quality can be improved during the fresh air circulation process. Heat exchange and increase the cooling/heating capacity may also be strengthened. In the indoor circulation process, the indoor fan is used to circulate to increase the cooling and heating speed.

In some embodiments, the fresh air system further comprises: an exhaust tube, wherein an inlet end of the exhaust tube is in communication with the indoors, and an outlet end of the exhaust tube is suitable in communication with the outdoors; and a total heat exchanger, comprising a housing and a heat exchange core arranged in the housing; wherein the housing has a first tuyere, a second tuyere, a third tuyere, and a fourth tuyere; the heat exchange core defines a first air channel connecting the first tuyere and the second tuyere, and a second air channel connecting the third tuyere and the fourth tuyere; the first air channel and the second air channel exchange heat through the heat exchange core; the first tuyere is communicated with the inlet end of the air inlet tube, the third tuyere is communicated with the outlet end of the exhaust tube, and the second air outlet and the fourth air outlet are both communicated with the outdoors.

In some embodiments, the switching device comprises a switching valve disposed upstream of the fan and disposed downstream of the first air entering port and the second air entering port.

In some embodiments, the switching device comprises a first on-off valve and a second on-off valve; the first on-off valve is arranged at the first air entering port and is configured to control opening and closing of the first air entering port; the second on-off valve is arranged at the second air entering port and is configured to control opening and closing of the second air entering port.

In some embodiments, the fresh air system further comprises: at least one of a first filter device and a second filter device; the first filter device is arranged at the first air entering port, and the second filter device is arranged at the second air entering port.

In some embodiments, the air inlet tube comprises a first tube section, a second tube section, and a third tube section; an inlet end of the first tube section is formed as the first air entering port, an inlet end of the second tube section is formed as the second air entering port, and an inlet end of the third tube section communicates with an outlet end of the first tube section and an outlet end of the second tube section respectively; the inlet of the nozzle communicates with the third tube section.

In some embodiments, the air inlet tube comprises a third tube section; the inlet of the nozzle communicates with the third tube section; the number of the nozzles are plural, and the plurality of nozzles are spaced apart along an axial direction of the third tube section.

In some embodiments, a cross-sectional area of an inner cavity of the nozzle gradually decreases along a direction from the inlet of the nozzle to the outlet of the nozzle.

In some embodiments, the housing comprises a first wall surface and a second wall surface that are opposed to each other in the thickness direction; the first air inlet is defined on the first wall surface, and a distance L1 between the heat exchange component and the first wall surface is less than a distance L2 between the heat exchange component and the second wall surface; a ventilation channel is defined between the heat exchange component and the second wall surface; the outlet of the nozzle is arranged opposite to the ventilation channel.

The present disclosure further provides an air-conditioning indoor unit, comprising: a housing, comprising a front panel and a rear panel oppositely arranged along a first direction, and comprising an upper side panel and a lower side panel oppositely arranged along a second direction; wherein the first direction is perpendicular to the second direction; the housing defines an accommodating cavity; the front panel is arranged with a first air inlet region, and the lower side panel is arranged with a first air outlet region; a first heat exchanger, arranged in the accommodating cavity; wherein a projection of the first air inlet region along the first direction at least partly falls on the first heat exchanger; and a radiant heating panel arranged on the front panel.

According to the air-conditioning indoor unit of the present disclosure, the air entering the first air inlet region is cooled by the first heat exchanger, and the cooling air sinks and is discharged from the first air outlet region. The process makes the air pressure in the accommodating cavity is reduced, followed by the negative pressure, the air outside the housing from the first air inlet region to continuously generate cooling airflow to achieve low-noise cooling. There is also a radiant heating panel on the front panel, which can generate heat and make the ambient temperature rise, thereby achieving the heating function.

The present disclosure further provides a heat exchanger for an air-conditioning indoor unit, comprising: a plurality of heat exchange tubelines, arranged side by side and spaced apart from each other along a first interval direction; and a plurality of heat exchange fin groups, divided into a first heat exchange region and a second heat exchange region; wherein the first heat exchange region is arranged with a plurality of first heat exchange fins, and the plurality of first heat exchange fins are arranged at intervals along a second interval direction intersecting with the first interval direction and are sleeved in the plurality heat exchange tubelines in the first heat exchange region; the second heat exchange region is arranged with a plurality of second heat exchange fins; the plurality of second heat exchange fins are arranged at intervals along the second interval direction and are sleeved in the plurality of heat exchange tubelines in the second heat exchange region; the plurality of first heat exchange fins and the plurality of second heat exchange fins are arranged such that a heat exchange capacity of the second heat exchange region is greater than a heat exchange capacity of the first heat exchange region.

According to the heat exchanger of the present disclosure, the heat exchange fin groups are divided into a first heat exchange region and a second heat exchange region. The first heat exchange region is arranged with a plurality of first heat exchange fins, and the second heat exchange region is arranged with a plurality of second heat exchange fins. The first heat exchange fins and the second heat exchange fins are arranged such that the heat exchange capacity of the second heat exchange region is greater than the heat exchange capacity of the first heat exchange region. Thus, the heat exchanger of the present disclosure has different heat exchange capacities to be applied to air-conditioning indoor units with different air volumes in different positions.

In some embodiments, the first heat exchange region has a first height in the first interval direction, and the second heat exchange region has a second height in the first interval direction; the second height occupies 5%-40% of a sum of the first height and the second height.

In some embodiments, a beveled edge is arranged between a bottom edge of the plurality of second heat exchange fins away from the plurality of first heat exchange fins and a side edge along the first interval direction.

In some embodiments, the plurality of first heat exchange fins have a first width along a vertical direction of the first interval direction and the second interval direction, and the plurality of second heat exchange fins have a second width along the vertical direction; the second width is greater than the first width.

In some embodiments, the second width is 5%-70% greater than the first width.

In some embodiments, the first width is in a range of 5 mm-50 mm.

In some embodiments, the first heat exchange region and the second heat exchange are space apart, and an interval distance between the first heat exchange region and the second heat exchange is less than or equal to 5 mm.

In some embodiments, each first heat exchange fin and a corresponding second heat exchange fin are disposed on a same plane.

In some embodiments, a distance between each adjacent two of the plurality of first heat exchange fins is in a range of 1 mm-10 mm.

DETAILED DESCRIPTION

Figure 1:
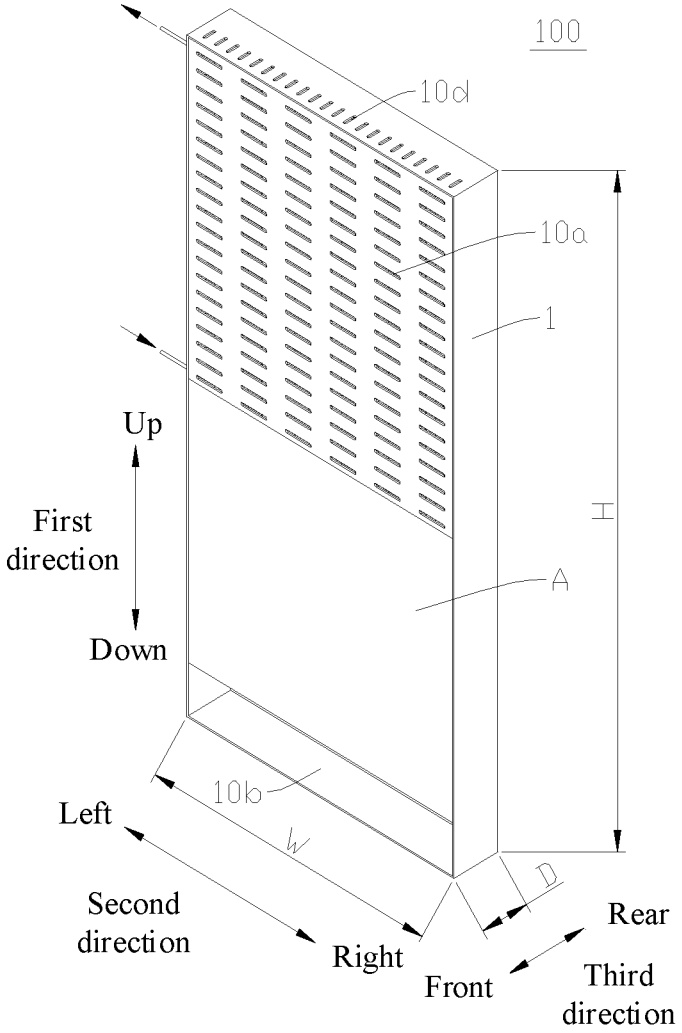
FIG. 1 is a schematic view of a heat exchange device according to some embodiments of the present disclosure.

The embodiments of the present disclosure are described in detail below. Examples of the embodiments are shown in the accompanying drawings, wherein same or similar reference numerals indicate same or similar elements or elements with same or similar functions. The embodiments described below with reference to the drawings are exemplary, and are intended to explain the present disclosure, but should not be understood as a limitation to the present disclosure.

The following disclosure provides many different embodiments or examples for realizing different structures of the present disclosure. In order to simplify the disclosure of the present disclosure, the components and settings of specific examples are described below. Of course, they are only examples, and are not intended to limit the present disclosure. In addition, the present disclosure may repeat reference numbers and/or letters in different examples. This repetition is for the purpose of simplification and clarity, and does not indicate the relationship between the various embodiments and/or settings discussed.

The following describes a heat exchange device 100 according to embodiments of the present disclosure with reference to the accompanying drawings FIGS. 1 to 33. A labeling system used in FIGS. 1 to 33 is as follows:

heat exchange device 100, housing 1, first wall surface A, second wall surface B, first inclined wall surface C, second inclined wall surface D, first air inlet 10*a*, first air outlet 10*b*, second air outlet 10*c*, second air inlet 10*d*, communication chamber 11, upstream communication chamber 111, downstream communication chamber 112, protective member 13, protective net 130, water blocking structure 14, positioning groove 15, support beam 16, positioning part 17, guide surface 170, positioning protrusion 171, first heat exchange component 2, first plane 2*a*, inclined part 20, first single-row heat exchange tube group 21, first heat exchange tube 211, heat exchange fin 212, inlet tube 2111, outlet tube 2112, first group 2113, second group 2114, runner 2121, heat exchange monomer 22, second heat exchange component 4, second plane 4*a*, second single-row heat exchange tube group 41, second heat exchange tube 411, water receiving box 5, water receiving port 50, first water receiving part 51, second water receiving part 52, additional component 6, heat radiation component 61, electric heating component 62, display and control component 63, humidification component 64, air deflector 7, air guiding structure 8, guide surface 81, first switching valve 91, second switching valve 92.

Figure 8:
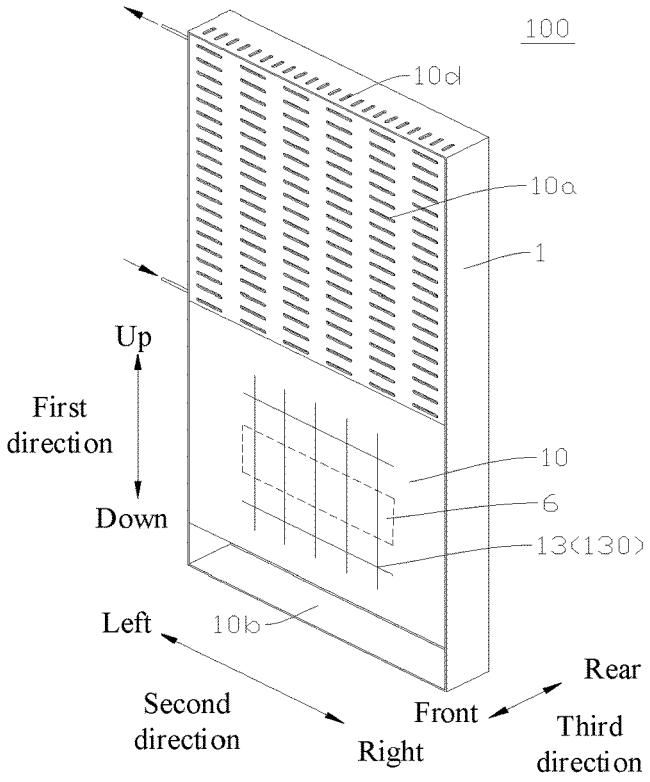
FIG. 8 is a schematic view of a heat exchange device according to other embodiments of the present disclosure.
Figure 22:
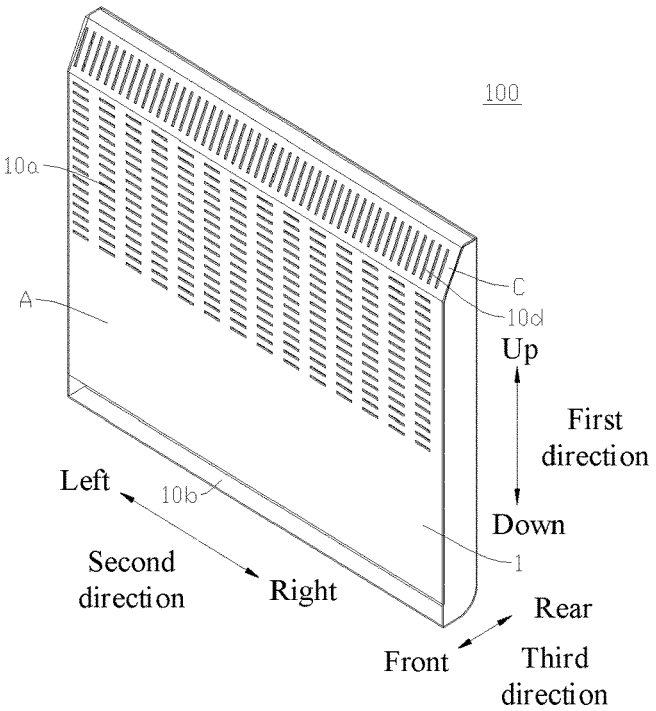
FIG. 22 is a schematic view of a heat exchange device according to other embodiments of the present disclosure.
Figure 23:
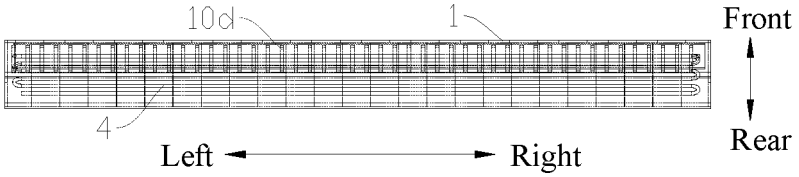
FIG. 23 is another schematic view of the heat exchange device as shown in FIG. 22.

In some embodiments of the present disclosure, as shown in FIG. 1, FIG. 8 and FIG. 22, the heat exchange device 100 includes a housing 1, and the housing 1 defines a first air inlet 10*a* and a first air outlet 10*b*. Air outside the housing 1 may flow into the housing 1 from the first air inlet 10*a*, and the air in the housing 1 may flow to the outside of the housing 1 from the first air outlet 10*b*. The first air outlet 10*b* and the first air inlet 10*a* are spaced apart along a first direction (for example, the up-and-down direction shown in FIG. 1). That is, an orthographic projection of the first air outlet 10*b* and an orthographic projection of the first air inlet

10*a* on a plane parallel to the first direction has no overlapping part. That is, the orthographic projection of the first air outlet 10*b* and the orthographic projection of the first air inlet 10*a* are spaced apart.

In some embodiments as shown in FIG. 2, FIG. 25, FIG. 28 and FIG. 29, the heat exchange device 100 further includes a first heat exchange component 2. The first heat exchange component 2 is arranged in the housing 1 and includes a plurality of heat exchange fins 212 spaced apart along a second direction. The air in the housing 1 may exchange heat with the plurality of heat exchange fins 212 of the first heat exchange component 2, so as to ensure that the heat exchange device 100 has a larger heat exchange area, a greater heat exchange efficiency, thereby meeting cooling or heating needs.

Figure 2:
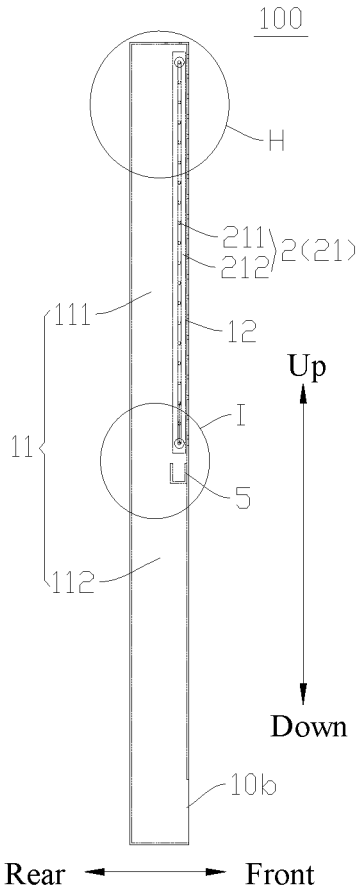
FIG. 2 is another schematic view of the heat exchange device as shown in FIG. 1.
Figure 3:
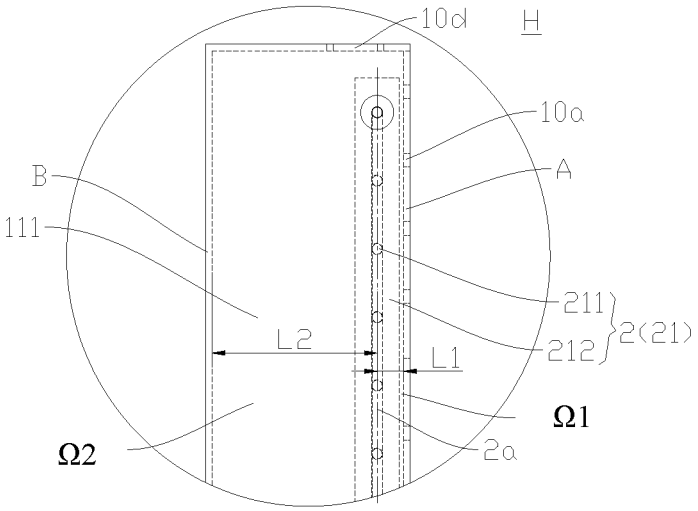
FIG. 3 is an enlarged view of an H part circumscribed in FIG. 2.
Figure 4:
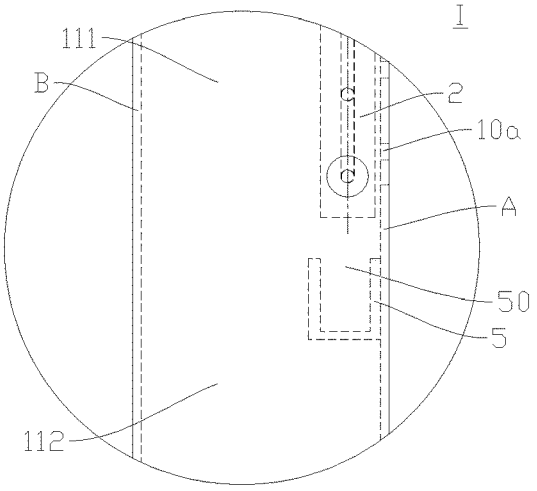
FIG. 4 is an enlarged view of an I part circumscribed in FIG. 2.
Figure 5:
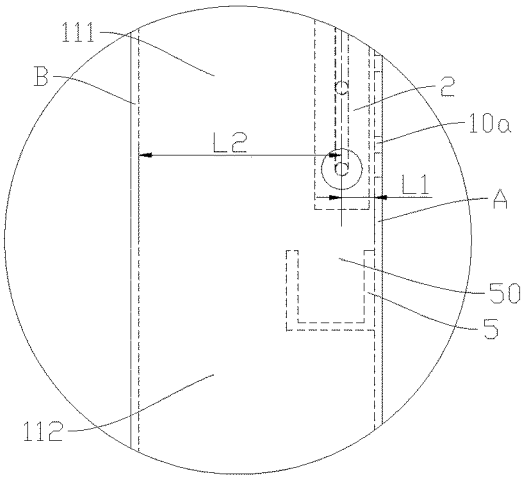
FIG. 5 is a partial schematic view of a heat exchange device according to other embodiments of the present disclosure.

The first heat exchange component 2 and the first air inlet 10*a* are arranged opposite to each other along a third direction (for example, the front-rear direction shown in FIG. 2). That is, an orthographic projection of the first heat exchange component 2 and an orthographic projection of the first air inlet 10*a* along the third direction at least partially overlaps. That is, the orthographic projection of the first heat exchange component 2 and the orthographic projection of the first air inlet 10*a* on a plane perpendicular to the third direction at least partially overlap, such that the air flowing into the housing 1 through the first air inlet 10*a* may exchange heat with the first heat exchange component 2. The third direction may be perpendicular to the first direction and the second direction, that is, the third direction is perpendicular to the first direction, and the third direction is perpendicular to the second direction. A straight line extending in the third direction is at a right angle to a straight line extending in the second direction, and the straight line extending in the third direction is at a right angle to a straight line extending in the second direction.

The heat exchange device 100 has at least a first air outlet mode. In the first air outlet mode, the air in the housing 1 exchanges heat with the first heat exchange component 2, and the heat exchanged air flows to the first air outlet 10*b* in the first direction and is discharged through the first air outlet 10*b*. A negative pressure is formed at the first air inlet 10*a*. The air outside the housing 1 may thus flow into the housing 1 through the first air inlet 10*a*, and exchange heat with the first heat exchange component 2. Therefore, in the first air outlet mode, no active driving device is needed to realize air circulation, noise-free operation of the heat exchange device 100 is realized, and the air and the first heat exchange component 2 transfer heat through natural convection, such that the wind outlet of the heat exchange device 100 is soft, especially suitable for small load application scenarios such as sleep.

Therefore, according to the heat exchange device 100 of the above-mentioned embodiments of the present disclosure, the first air inlet 10*a* and the first air outlet 10*b* are arranged reasonably, and the first heat exchange component 2 is arranged correspondingly, such that the heat exchange device 100 has a soft and effective air output, and the operating noise of the heat exchange device 100 is reduced.

It can be understood that, in some embodiments, one or more first air inlets 10*a* are arranged. For example, the first air inlet 10*a* includes a plurality of air inlets arranged at intervals. In some embodiments, one or more first air outlets 10*b* are arranged. For example, the first air outlet 10*b* includes a plurality of air outlets arranged at intervals.

In some embodiments, as shown in FIGS. 1, 8 and 22, an outer surface of the housing 1 forms an appearance surface of the heat exchange device 100, which facilitates the regular arrangement of the appearance of the heat exchange device 100.

In some embodiments, the first heat exchange component 2 includes at least one heat exchange monomer 22. In an example shown in FIGS. 1 and 10, the first heat exchange component 2 includes a single heat exchange monomer 22. As shown in an example shown in FIG. 27, the first heat exchange component 2 includes a plurality of heat exchange monomers 22 spaced apart along the second direction. That is, orthographic projections of the plurality of heat exchange monomers 22 on a plane parallel to the second direction do not overlap with each other. Therefore, by setting the first heat exchange component 2 to include the plurality of heat exchange monomers 22, compared with setting the first heat exchange component 2 as a whole heat exchange monomer, the length of each heat exchange monomer 22 in the second direction may be effectively shortened, which facilitates the processing of a single heat exchange unit 22.

The plurality of heat exchange monomers 22 may be connected in parallel and/or in series: the heat exchange monomers 22 are arranged in parallel, inlets of the heat exchange monomers 22 are connected, and outlets of the heat exchange monomers 22 are connected; or the heat exchange monomers 22 are arranged in series, the outlet of one of the two adjacent heat exchange monomers 22 is connected to the inlet of the other; or at least two heat exchange monomers 22 are arranged in series, and at least two heat exchange monomers 22 are arranged in parallel, for example, the number of the heat exchange monomers 22 is three, one of the heat exchange monomers 22 is connected in parallel with the other two heat exchange monomers 22, and the other two heat exchange monomers 22 are arranged in series. Therefore, the heat exchange monomers 22 may be arranged flexibly, which facilitates the heat exchange device 100 to better meet differentiated needs of users.

In some embodiments, as shown in FIGS. 10-15, a distance a between adjacent heat exchange fins 212 in the second direction ranges from 2 mm to 10 mm (including the endpoint values), such that two adjacent heat exchange fins 212 have a proper interval therebetween, which is conducive to reduce the wind resistance generated by the heat exchange fins 212, facilitate air flow, and improve heat exchange efficiency.

It can be understood that, in a case that the interval between any adjacent heat exchange fins 212 among the plurality of heat exchange fins 212 is equal, the plurality of heat exchange fins 212 are evenly spaced along the second direction. Of course, in other examples, at least one interval between an adjacent heat exchange fins 212 among the plurality of heat exchange fins 212 is unequal to the interval between other adjacent heat exchangers 212, and the plurality of heat exchange fins 212 are arranged at non-uniform intervals along the second direction.

In some examples of the present disclosure, as shown in FIGS. 10-15, the first heat exchange component 2 is a tube-fin heat exchanger, and the tube-fin heat exchanger includes a plurality of first heat exchange tubes 211 and a plurality of heat exchange fins 212. The plurality of first heat exchange tubes 211 are arranged at intervals along the first direction, and each first heat exchange tube 211 extends in the second direction to sequentially pass through the plurality of heat exchange fins 212. An outer diameter d of each first heat exchange tube 211 satisfies 4 mm≤d≤7.5 mm, which makes the diameter of the first heat exchange tube 211 less, thereby reducing the wind resistance generated by the first heat exchange tube 211 on the premise of meeting the heat exchange demand, and appropriately increasing the number of the first heat exchange tubes 211 to a certain extent. A width w of each heat exchange fin 212 in the third direction satisfies 12 mm≤w≤30 mm, which is conducive to reduce the wind resistance generated by the heat exchange fins 212.

Figure 10:
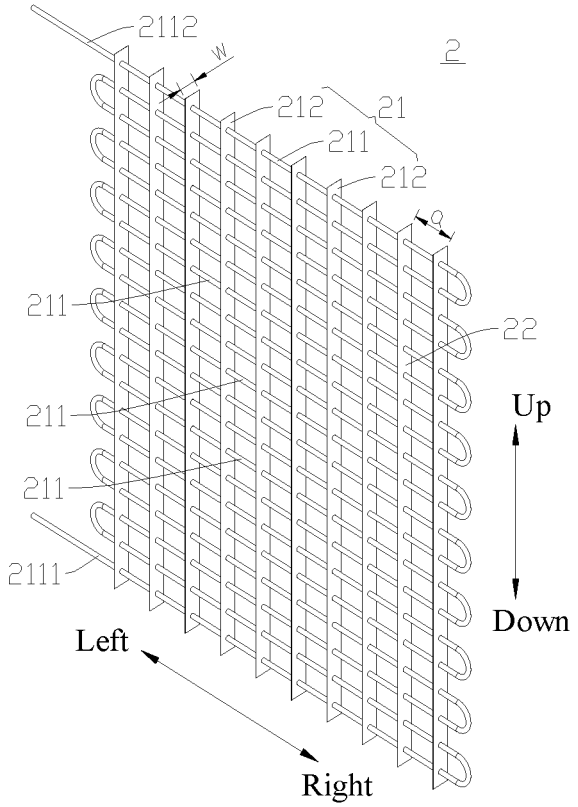
FIG. 10 is a schematic view of a first heat exchange component of a heat exchange device according to other embodiments of the present disclosure.
Figure 11:
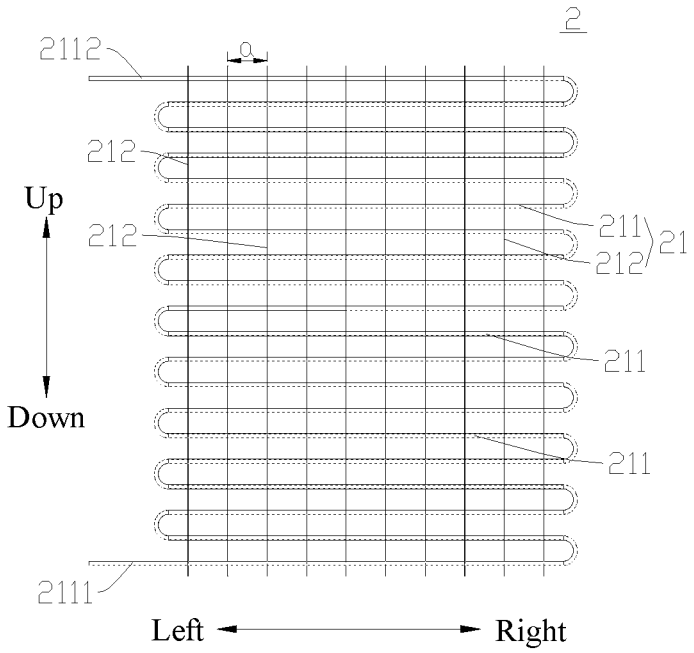
FIG. 11 is another schematic view of the first heat exchange component as shown in FIG. 10.
Figure 12:
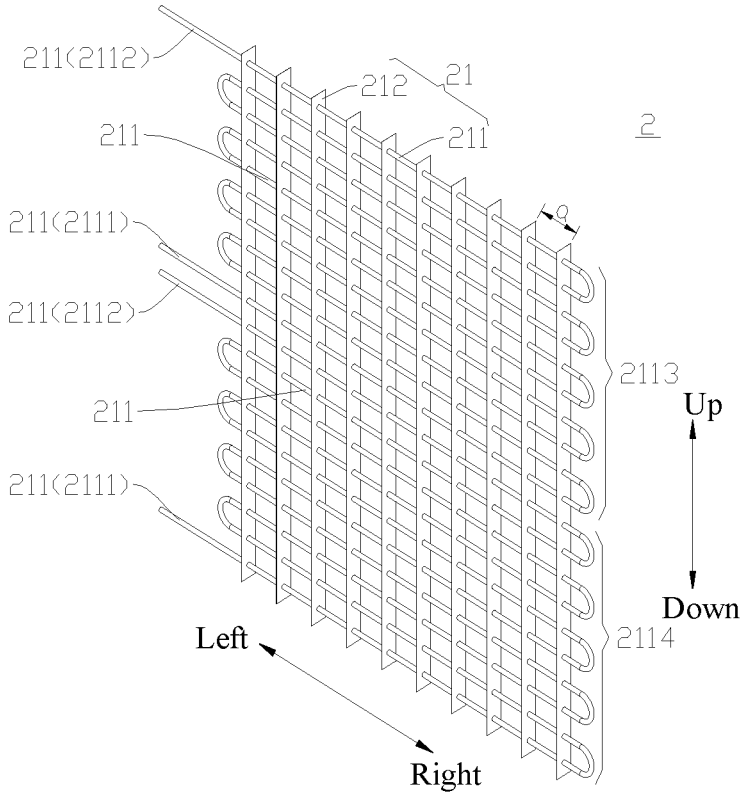
FIG. 12 is a schematic view of a first heat exchange component of a heat exchange device according to other embodiments of the present disclosure.
Figure 13:
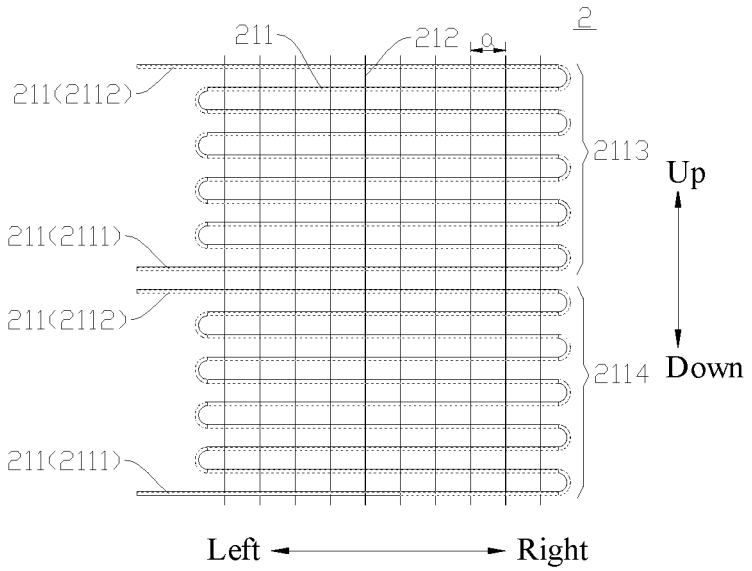
FIG. 13 is another schematic view of the first heat exchange component as shown in FIG. 12.
Figure 14:
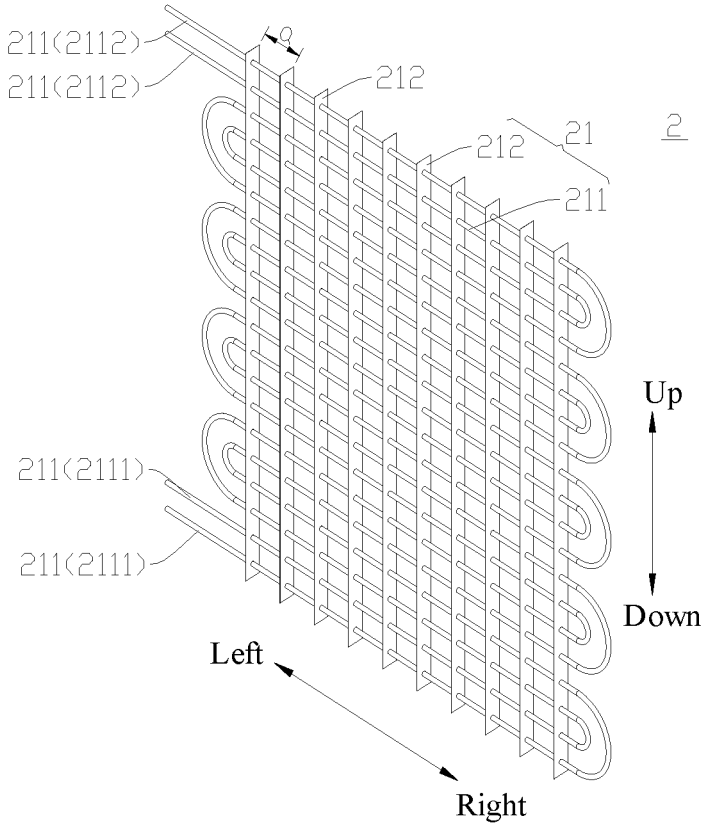
FIG. 14 is a schematic view of a first heat exchange component of a heat exchange device according to other embodiments of the present disclosure.
Figure 15:
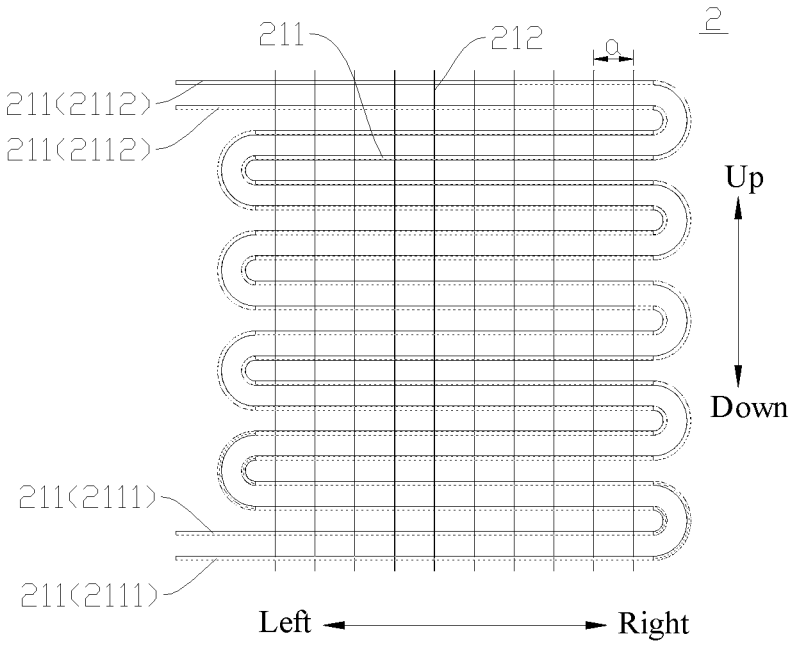
FIG. 15 is another schematic view of the first heat exchange component as shown in FIG. 14.
Figure 16:
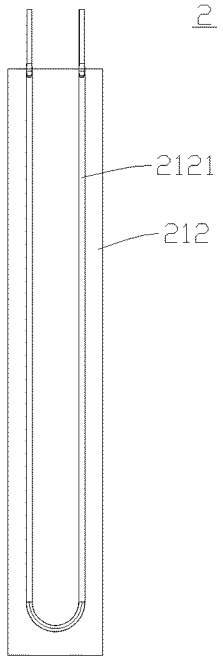
FIG. 16 is a schematic view of a first heat exchange component of a heat exchange device according to other embodiments of the present disclosure.
Figure 17:
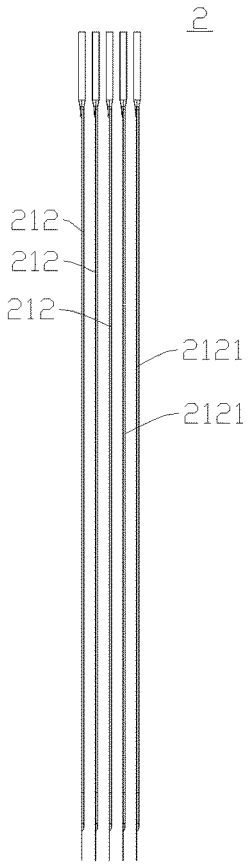
FIG. 17 is another schematic view of the first heat exchange component as shown in FIG. 16.
Figure 18:
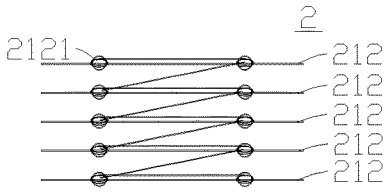
FIG. 18 is further another schematic view of the first heat exchange component as shown in FIG. 16.

Among them, the plurality of first heat exchange tubes 211 are connected in series and/or in parallel. For example, two adjacent first heat exchange tubes 211 are connected in series via an elbow (as shown in FIG. 10 and FIG. 11), one of the adjacent first heat exchange tubes 211 is formed as an inlet tube 2111, and the other first heat exchange tube 211 is formed as an outlet tube 2112. For another example, the plurality of first heat exchange tubes 211 include a first group 2113 and a second group 2114. Each of the first group 2113 and the second group 2114 includes a plurality of first heat exchange tubes 211. The plurality of first heat exchange tubes 211 of the first group 2113 are connected in series, and the plurality of first heat exchange tubes 211 of the second group 2114 are connected in parallel. The first group 2113 and the second group 2114 each include an inlet tube 2111 and an outlet tube 2112, and the first group 2113 is disposed on an upper side of the second group 2114 (as shown in FIGS. 12 and 13), or the first heat exchange tubes 211 of the first group 2113 and the first heat exchange tubes 211 of the second group 2114 are alternately arranged (as shown in FIGS. 14 and 15).

It can be understood that when at least two of the plurality of first heat exchange tubes 211 are connected in parallel, the flow area of the heat exchange medium may be effectively increased, and a large flow resistance of the heat exchange medium due to the small diameter of the first heat exchange tubes 211 may be prevented, thereby ensuring the smooth flow of the heat exchange medium.

In other examples of the present disclosure, as shown in FIGS. 16-19, the first heat exchange component 2 is an inflatable heat exchanger, and there are more than two inflatable heat exchangers arranged. At least two of the inflatable heat exchangers are connected in series and at least two are connected in parallel. For example, a part of the inflatable heat exchangers is connected in series, and then the entire part is connected in parallel with another part; or, the number of the inflatable heat exchangers is two, and the two inflatable heat exchangers are arranged in series or in parallel. The inflatable heat exchanger includes a plurality of heat exchange fins 212. Each heat exchange fin 212 includes a first part and a second part. The first part defines a flow channel 2121, and the second part does not have a flow channel 2121. The flow channels 2121 of two adjacent heat exchange fins 212 are connected in series, a thickness t of the second part of the heat exchange fin 212 in the second direction satisfies 0.5 mm≤t≤1.5 mm, and a thickness t' of the first part of the heat exchange fin 212 in the second direction satisfies 1 mm≤t'≤4 mm, thereby reducing the wind resistance produced by the inflation heat exchanger.

Figure 19:
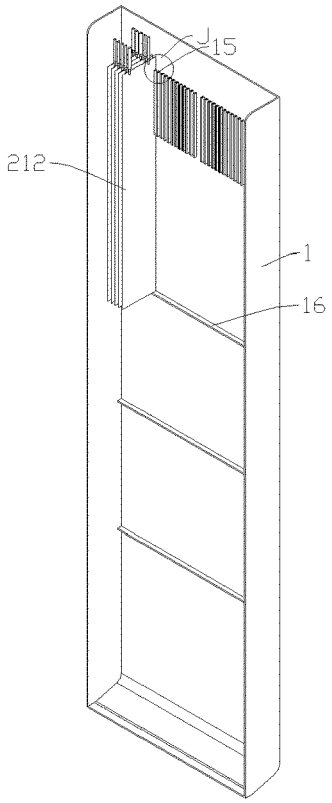
FIG. 19 is a schematic view of an installation of the first heat exchange component as shown in FIG. 16.
Figure 20:
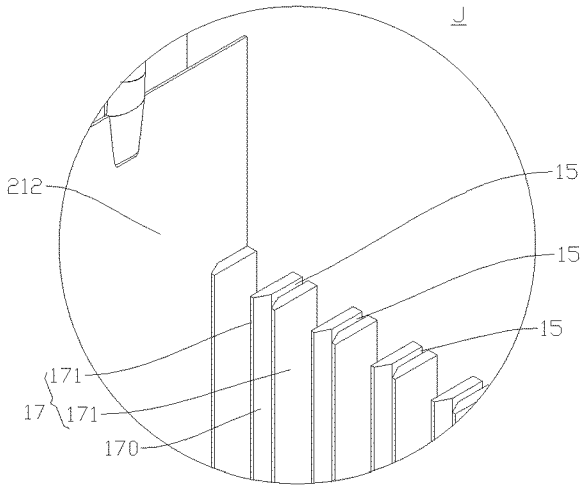
FIG. 20 is an enlarged view of a J part circumscribed in FIG. 19.

In the example of FIGS. 19 and 20, an interval between two adjacent heat exchange fins 212 may be limited by a positioning groove 15 in the housing 1, and the housing 1 may be further arranged with a support beam 16, which may be arranged at a bottom of the inflatable heat exchanger for supporting to facilitate the positioning and installation of the inflatable heat exchanger. A plurality of positioning parts 17 may be arranged on an inner wall of the housing 1, and the plurality of positioning parts 17 are arranged at intervals. Each positioning part 17 includes two positioning protrusions 171, and the two positioning protrusions 171 are arranged at intervals to define the positioning groove 15. A free end of each positioning protrusion 171 is formed with a guiding surface 170, and the guiding surface 170 is formed on a side of the positioning protrusion 171 opposite to the other corresponding positioning protrusion 171. The guiding surface 170 may be configured to guides the installation of the heat exchange fins 212 for improving installation efficiency.

In some embodiments, as shown in FIGS. 3-7 and 26, the housing 1 includes a first wall surface A and a second wall surface B arranged opposite to each other along the third direction. An orthographic projection of the first wall surface A and an orthographic projection of the second wall surface B along the third direction overlap with each other at least partially. For example, when a user installs and uses the heat exchange device 100, taking the third direction as a front-rear direction, the first wall surface A is a front wall of the housing 1 facing the user, and the second wall surface B is a rear wall of the housing 1. The first air inlet **10*a* penetrates the first wall surface A and is defined on the first wall surface A, and a distance L1 between the first heat exchange component 2 and an inner surface of the first wall surface A is less than a distance L2 between the first heat exchange component 2 and an inner surface of the second wall surface B. That is, in the third direction, the distance L1 between the first heat exchange component 2 and the inner surface of the first wall surface A is less than the distance L2 between the first heat exchange component 2 and the inner surface of the second wall surface B, and the first heat exchange component 2 is disposed closer to the inner surface of the first wall surface A compared with the inner surface of the second wall surface B. An upstream communication chamber 111 may be defined between the first heat exchange component 2 and the inner surface of the second wall surface B. The upstream communication chamber 111 has a larger volume. When the heat exchange device 100 is used for cooling, the upstream communication chamber 111** stores cold air with a density greater than that of the outside air, which is conducive to the convergence of cold air, such that the cold air accelerates its natural sinking under the action of gravity.

Since the first air inlet **10*a* penetrates the first wall surface A, the distance L1 between the first heat exchange component 2 and the inner surface of the first wall surface A refers to a distance between first heat exchange component 2 and a plane at which an edge of the first air inlet 10*a*** is located.

For example, in the examples of FIGS. 2-7 and 26, the first wall surface A and the second wall surface B are arranged in parallel and spaced apart, and the first heat exchange component 2 is disposed between the first wall surface A and the second wall surface B. The airflow at the first air inlet **10*a* may flow into the housing 1 in the third direction from the first wall surface A to the second wall surface B (for example, from front to rear in FIG. 2) to exchange heat with the first heat exchange component 2. Since the distance L1 between the first heat exchange component 2 and the inner surface of the first wall surface A is less than the distance L2 between the first heat exchange component 2 and the inner surface of the second wall surface B, the first heat exchange component 2 is disposed closer to the inner surface of the first wall surface A compared with the inner surface of the second wall surface B, such that the first heat exchange component 2 is disposed closer to the first air inlet 10*a* relative to the second wall surface B. The first heat exchange component 2 and the inner surface of the second wall surface B then define the upstream communication chamber 111. In the flow direction of the airflow, the upstream communication chamber 111 is disposed downstream of the first heat exchange component 2, and the airflow flows to the first air outlet 10***b* through the upstream communication chamber 111.

When the heat exchange device 100 is used for cooling, the first air outlet 10*b* is disposed under the first air inlet 10*a*, and the air after heat exchange with the first heat exchange component 2 becomes cold air (which can be understood as air with a lower temperature). The cold air has low temperature and high density and may sink spontaneously. Since the upstream communication chamber 111 has a large volume, it is conducive for convergence of a large amount of cold air. The large amount of cold air is then driven by gravity, which is conducive to the spontaneous sinking of the cold air. For example, the cold air sinks to the first air outlet 10*b* in the first direction and is discharged through the first air outlet 10*b* to realize the refrigeration of the heat exchange device 100. In addition, due to the sinking of the cold air in the upstream communication chamber 111, an upper part of the upstream communication chamber 111 may form a low-pressure area. Driven by the pressure difference, the hot air outside the housing 1 (which can be understood as air with a higher temperature) may continuously flow from the first air inlet 10*a* to the housing 1 to exchange heat with the first heat exchange component 2. In this way, the circulation of air flow and cold-heat changes can be realized without or with a small amount of active driving device such as a fan, which ensures the continuous refrigeration cycle of the heat exchange device 100.

Figure 25:
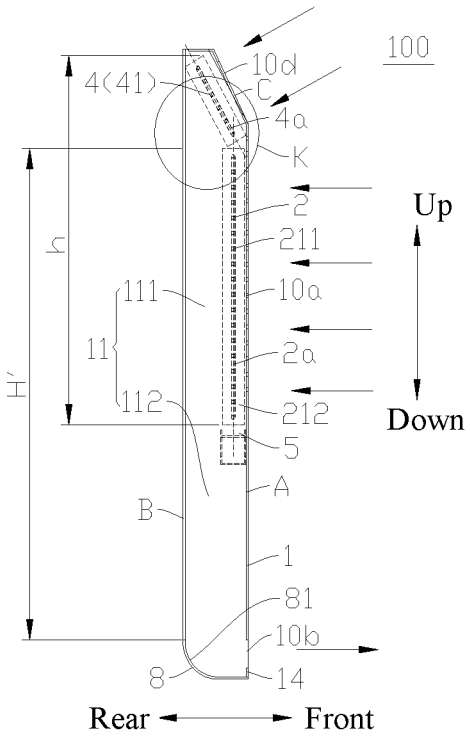
FIG. 25 is further another schematic view of the heat exchange device as shown in FIG. 22.
Figure 26:
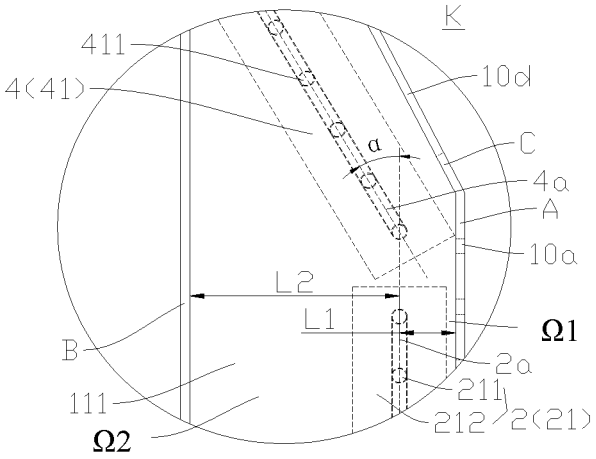
FIG. 26 is an enlarged view of a K part circumscribed in FIG. 25.

In some examples in FIGS. 2, 19, and 25, taking the first direction as an up-down direction, a downstream communication chamber 112 is defined on a lower side of the upstream communication chamber 111, and the downstream communication chamber 112 is defined by the inner side of the first wall surface A and the inner surface of the second wall surface B. The downstream communication chamber 112 is disposed on a lower side of the first heat exchange component 2. The downstream communication chamber 112 is directly connected to the first air outlet 10*b*, and the upstream communication chamber 111 is indirectly connected to the first air outlet 10*b* through the downstream communication chamber 112. The upstream communication chamber 111 and the downstream communication chamber 112 together define the communication chamber 11, such that the communication chamber 11 has a larger volume, which is conducive to the convergence of cold air, further improving the natural sinking effect of cold air.

In other examples, the first heat exchange component 2 is arranged in contact with the inner surface of the second wall surface B. In this case, the upstream communication chamber 111 is not defined between the inner surface of the second wall surface B and the first heat exchange component 2; or a small space between the first heat exchange component 2 and the inner surface of the second wall surface B forms the upstream communication chamber 111, and the downstream communication chamber 112 is defined on the lower side of the first heat exchange component 2. The downstream communication chamber 112 is defined by the inner surface of the first wall surface A and the inner surface of the second wall surface B. The downstream communication chamber 112 communicates with the air flow channel of the first heat exchange component 2, so as to ensure the natural sinking effect of the cold air and save the occupied space of the heat exchange device 100.

In other embodiments of the present disclosure, the first wall surface A and the second wall surface B are arranged non-parallel.

It should be noted that in the description of the present disclosure, the distance L1 between the first heat exchange component 2 and the inner surface of the first wall surface A refers to a distance between a center surface of the first heat exchange component 2 and the inner surface of the first wall surface A. The distance L2 between the first heat exchange component 2 and the inner surface of the second wall surface B refers to a distance between the center surface of the first heat exchange component 2 and the inner surface of the second wall surface B.

The first heat exchange component 2 includes a first single-row heat exchange tube group 21, and the first single-row heat exchange tube group 21 includes a plurality of first heat exchange tubes 211 each with a centerline on a first plane 2*a*. In some examples, the first heat exchange component 2 includes a single first single-row heat exchange tube group 21, and a center plane of the first heat exchange component 2 is the first plane 2*a*. In other examples, the first heat exchange component 2 includes a plurality of first single-row heat exchange tube groups 21, and the plurality of first single-row heat exchange tube groups 21 are sequentially arranged along the third direction. Each first single-row heat exchange tube group 21 has a first plane 2*a*, taking outermost two first planes 2*a* along the third direction, and a plurality of connecting lines are drawn parallel to the third direction to connect the two first planes 2*a*. A plane defined by midpoints of the plurality of connecting lines is the center plane of the first heat exchange component 2.

In some embodiments, as shown in FIGS. 3-7, the housing 1 includes a first wall surface A and a second wall surface B arranged opposite to each other along the third direction. The first air inlet 10*a* is defined on the first wall surface A. The heat exchange component 2 includes a first single-row heat exchange tube group 21. The first heat exchange tube 211 group includes a plurality of first heat exchange tubes 211 each with a centerline on a first plane 2*a*. The first plane 2*a*, an orthographic projection of the first plane 2*a* on the first wall surface A, and corresponding projection lines form a space Ω1. It can be understood that the space Ω1 is a space scanned by the first plane 2*a* moving along a first projection direction to the orthographic projection of the first plane 2*a* on the first wall surface A. The first projection direction is a projection direction of the first plane 2*a* toward the first wall surface A, and the space Ω1 is defined by the first plane 2*a* and the inner surface of the first wall surface A. The first plane 2*a*, an orthographic projection of the first plane 2*a* on the second wall surface B, and corresponding projection lines form a space Ω2. It can be understood that the space Ω2 is a space defined by the first plane 2*a* moving along a second projection direction to the orthographic projection of the first plane 2*a* on the second wall surface B. The second projection direction is a projection direction of the first plane 2*a* toward the second wall surface B, and the space Ω2 is defined by the first plane 2*a* and the inner surface of the second wall surface B. The volume of the space Ω2 is greater than the volume of the space Ω1. The first plane 2*a* is an arrangement plane of the first heat exchange component 2 which will be described later.

When the heat exchange device 100 is used for cooling, the first air outlet 10*b* is disposed under the first air inlet 10*a*, and the air after heat exchange with the first heat exchange component 2 becomes cold air (which can be understood as air with a lower temperature). The cold air has low temperature and high density and may sink spontaneously. Since the space Ω1 has a large volume, it is conducive for convergence of a large amount of cold air. The large amount of cold air is then driven by gravity, which is conducive to the spontaneous sinking of the cold air. For example, the cold air sinks to the first air outlet 10*b* in the first direction and is discharged through the first air outlet 10*b* to realize the refrigeration of the heat exchange device 100. In addition, due to the sinking of the cold air in the space Ω2, an upper part of the space Ω2 may form a low-pressure area. Driven by the pressure difference, the hot air outside the housing 1 (which can be understood as air with a higher temperature) may continuously flow from the first air inlet 10*a* to the housing 1 to exchange heat with the first heat exchange component 2. In this way, the circulation of air flow and cold-heat changes can be realized without or with a small amount of active driving device such as a fan, which ensures the continuous refrigeration cycle of the heat exchange device 100.

It can be understood that when the first heat exchange component 2 includes a plurality of first single-row heat exchange tube groups 21, the plurality of first single-row heat exchange tube groups 21 are sequentially arranged along the third direction, and each first single-row heat exchange tube group 21 has a first plane 2*a*. Taking outermost two first planes 2*a* along the third direction, a plurality of connecting lines are drawn along the third direction to connect the two first planes 2*a*. A plane defined by centers of the plurality of connecting lines is the center plane of the first heat exchange component 2. In this case, the center surface of the first heat exchange component 2, an orthographic projection of the center surface of the first heat exchange component 2 on the first wall surface A, and corresponding projection lines form a space Ω1. That is, the space Ω1 is defined by the center surface of the first heat exchange component 2 and the inner surface of the first wall surface A. The center surface of the first heat exchange component 2, an orthographic projection of the center surface of the first heat exchange component 2 on the second wall surface B, and corresponding projection lines form a space Ω2. That is, the space Ω2 is defined by the center surface of the first heat exchange component 2 and the inner surface of the second wall surface B.

In some embodiments, as shown in FIGS. 2-7, 21, 25, 28, and 29, the first heat exchange component 2 includes a first single-row heat exchange tube group 21. The first single-row heat exchange tube group 21 includes a plurality of first heat exchange tubes 211 each with a centerline on a first plane 2*a*. An included angle α' between the first plane 2*a* and the first direction satisfies: $-5° \leq \alpha' \leq 5°$. When α' is non-zero, the first plane 2*a* has an intersection with the first direction. When α' is positive, an orthographic projection of a straight line parallel to the first direction rotates counterclockwise around the intersection to be parallel to the first plane 2*a*, and the angle of rotation is α'. When α' is negative, the orthographic projection of the straight line parallel to the first direction rotates clockwise around the intersection point to be parallel to the first plane 2*a*, and the angle of rotation is −α'. When α' is 0°, the first plane 2*a* is arranged parallel to the first direction, which is conducive to save the space occupied by the heat exchange device 100 in the third direction. Therefore, the arrangement of the first heat exchange component 2 is flexible, which facilitates the flexible design of the heat exchange device 100.

In some embodiments, as shown in FIG. 2, FIG. 25, FIG. 28, and FIG. 29, the number of the first single-row heat exchange tube group 21 is one. For example, the first heat exchange component 2 is a single-row serpentine heat exchanger. In other embodiments, the number of the first single-row heat exchange tube groups 21 is multiple, and the multiple first single-row heat exchange tube groups 21 are sequentially arranged along the third direction.

In some specific examples, the number of the first single-row heat exchange tube groups 21 is multiple, each first single-row heat exchange tube group 21 has a first plane 2*a*, and first planes 2*a* are arranged at intervals in parallel.

In some embodiments, as shown in FIGS. 1, 8, and 21-29, the housing 1 further defines a second air inlet 10*d*. The air outside the housing 1 may flow from the second air inlet 10*d* into the housing 1, such that the heat exchange device 100 has a larger air inlet area and the heat exchange efficiency of the heat exchange device 100 is improved. The second air inlet 10*d* and the first air inlet 10*a* are spaced apart along the first direction, and the second air inlet 10*d* is disposed on a side of the first air inlet 10*a* away from the first air outlet 10*b*. In the first direction, the first air inlet 10*a* is disposed between the second air inlet 10*d* and the first air outlet 10*b*. That is, on a plane parallel to the first direction, an orthogonal projection of the first air inlet 10*a* is located between an orthographic projection of the second air inlet 10*d* and an orthographic projection of the first air outlet 10*b* at intervals. Therefore, by reasonably setting the position of the second air inlet 10*d*, the heat exchange performance of the heat exchange device 100 can be further improved.

Figure 21:
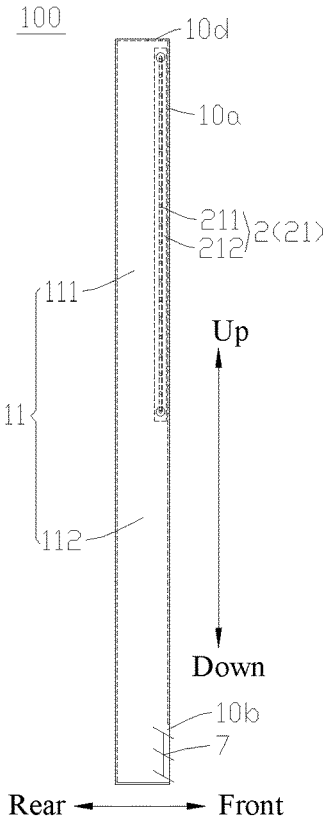
FIG. 21 is a schematic view of a heat exchange device according to other embodiments of the present disclosure.

For example, taking the first direction as an up-down direction and the third direction as a front-rear direction, the first air inlet 10*a* is defined on a front wall surface of the housing 1, the first air outlet 10*b* is spaced under the first air inlet 10*a*, and the second air inlet 10*d* is spaced above the first air inlet 10*a*. In other embodiments, the second air inlet 10*d* is defined on a top wall of the housing 1 (as shown in FIGS. 1, 8 and 21), and an opening direction of the second air inlet 10*d* is arranged upward. In other embodiments, the second air inlet 10*d* is defined on the front wall surface of the housing 1, and the opening direction of the second air inlet 10*d* is arranged forward. In other embodiments, the second air inlet 10*d* is defined on a first inclined wall surface C (as shown in FIGS. 22-29). The first inclined wall surface C is inclined with respect to the front wall surface of the housing 1, and the opening direction of the second air inlet 10*d* is inclined forward and upward. That is, the second air inlet 10*d* and the first air inlet 10*a* are defined on the same wall surface of the housing 1, or on different wall surfaces of the housing 1. The air outside the housing 1 may flow into the housing 1 from the first air inlet 10*a* and the second air inlet 10*d* respectively, which is conducive to increase the air inlet volume of the heat exchange device 100, thereby improving the heat exchange performance of the heat exchange device 100.

In some embodiments, as shown in FIGS. 22-29, the heat exchange device 100 further includes a second heat exchange component 4. The first heat exchange component 2 includes a first single-row heat exchange tube group 21, and the heat tube group 21 includes a plurality of first heat exchange tubes 211 each with a centerline on a first plane 2*a*. The second heat exchange component 4 includes a second single-row heat exchange tube group 41, and the second single-row heat exchange tube group 41 includes a plurality of second heat exchange tubes 411 each with a centerline on a second plane 4*a*. The first plane 2*a* and the second plane 4*a* have a non-zero included angle, that is, an angle between an arrangement plane of the second heat exchange component 4 and an arrangement plane of the first heat exchange component 2 is not equal to 0°.

For example, the first plane 2*a* is arranged vertically, and the second plane 4*a* is arranged inclinedly along a direction with an angle not equal to 0° with the vertical direction, which is conducive to realize the reasonable arrangement of the second heat exchange component 4 relative to the first heat exchange component 2, making the arrangement of the second heat exchange component 4 and the first heat exchange component 2 more compact, thereby preventing the second heat exchange component 4 and the first heat exchange component 2 from occupying a large space in a certain direction, improving the heat exchange area of the heat exchange device 100, and therefore improving the heat exchange efficiency and enhancing the heat exchange effect. When the heat exchange device 100 is used for cooling, the above arrangement further facilitates the gathering of a large amount of cold air, which facilitate the spontaneous sinking of cold air and reduces wind resistance.

The arrangement plane of the second heat exchange component 4 is a plane defined by an arrangement direction of the plurality of second heat exchange tubes 411 of the second single-row heat exchange tube group 41 and an extension direction of the second heat exchange tubes 411. When the second heat exchange component 4 includes a single second single-row heat exchange tube group 41, for example, the second heat exchange component 4 is a single-row serpentine heat exchanger, and the arrangement plane of the second heat exchange component 4 may be understood as the same as the second plane 4*a*. In other embodiments, the second heat exchange component 4 includes a plurality of parallel second single-row heat exchange tube groups 41, and the second heat exchange component 4 has a plurality of arrangement planes arranged in parallel and spaced apart.

In some examples shown in FIGS. 25, 26, 28 and 29, at least part of an orthographic projection of the second heat exchange component 4 along the third direction is staggered from an orthographic projection of the first heat exchange component 2 along the third direction. That is, on a plane perpendicular to the third direction, at least part of the orthographic projection of the second heat exchange component 4 is staggered from the orthographic projection of the first heat exchange component 2. That is, on a plane perpendicular to the third direction, at least part of the orthographic projection of the second heat exchange component 4 does not coincide with the orthographic projection of the first heat exchange component 2. It can also be understood that, on a plane perpendicular to the third direction, at least part of the orthographic projection of the second heat exchange component 4 is located outside the orthographic projection of the first heat exchange component 2, which further facilitates the reasonable layout of the first heat exchange component 2 and the second heat exchange component 4, and facilitates the heat exchange device 100 to better take into account the first air inlet 10*a* and the second air inlet 10*d* at the same time, thereby preventing air from flowing through the first heat exchange component 2 and the second heat exchange component 4 in turn, and preventing the second heat exchange component 4 from causing a large wind resistance on the air after heat exchange with the first heat exchange component 2.

In some examples of FIGS. 25, 26, 28, and 29, on a plane perpendicular to the third direction, the orthographic projection of the second heat exchange component 4 is completely staggered from the orthographic projection of the first heat exchange component 2. That is, the orthographic projection of the second heat exchange component 4 does not coincide with the orthographic projection of the first heat exchange component 2 at all. That is, the orthographic projection of the second heat exchange component 4 is located outside the orthographic projection of the first heat exchange component 2. Of course, in other examples of the present disclosure, on a plane perpendicular to the third direction, the orthographic projection of the second heat exchange component 4 partially overlaps with the orthographic projection of the first heat exchange component 2. That is, a part of the orthographic projection of the second heat exchange component 4 is located within the orthographic projection of the first heat exchange component 2, and another part is located outside the orthographic projection of the first heat exchange component 2.

Figure 30:
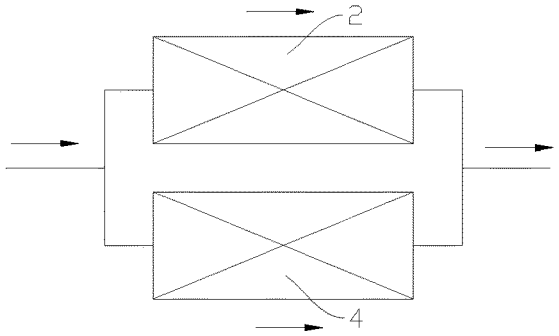
FIG. 30 is a schematic view of a connection between a first heat exchange component and a second heat exchange component of a heat exchange device according to other embodiments of the present disclosure, in which an arrow indicates a flow direction of a heat exchange medium.
Figure 31:
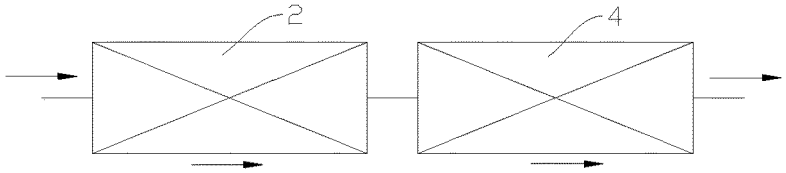
FIG. 31 is a schematic view of a connection between a first heat exchange component and a second heat exchange component of a heat exchange device according to other embodiments of the present disclosure, in which an arrow indicates a flow direction of a heat exchange medium.
Figure 32:
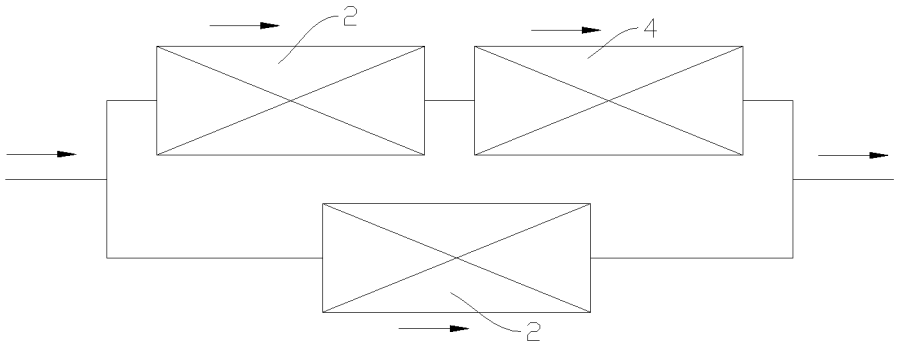
FIG. 32 is a schematic view of a connection between a first heat exchange component and a second heat exchange component of a heat exchange device according to other embodiments of the present disclosure, in which an arrow indicates a flow direction of a heat exchange medium.

As shown in FIGS. 30-32, the second heat exchange component 4 is connected in parallel and/or in series with the first heat exchange component 2. In some embodiments, as shown in FIG. 30, the second heat exchange component 4 is arranged in parallel with the first heat exchange component 2, an inlet of the second heat exchange component 4 is connected with an inlet of the first heat exchange component 2, and an outlet of the component 4 is connected to an outlet of the first heat exchange component 2, a part of the heat exchange medium is distributed to the second heat exchange component 4 and the other part is distributed to the first heat exchange component 2. In other embodiments, as shown in FIG. 31, the second heat exchange component 4 and the first heat exchange component 2 are arranged in series, and the heat exchange medium flows through the first heat exchange component 2 and the second heat exchange component 4 in sequence, or flows through the second heat exchange component 4 and the first heat exchange component 2 in sequence. In other embodiments, as shown in FIG. 32, the second heat exchange component 4 is connected in parallel and in series with the first heat exchange component 2. For example, there are multiple first heat exchange components 2 arranged, at least one first heat exchange component 2 is connected in series with the second heat exchange component 4, and at least one first heat exchange component 2 is connected in parallel with the second heat exchange component 4; or there are multiple second heat exchange components 4 arranged, at least one second heat exchange component 4 is connected in series with the first heat exchange component 2, and at least one second heat exchange component 4 is connected in parallel with the first heat exchange component 2. Therefore, the flexible arrangement between the second heat exchange component 4 and the first heat exchange component 2 is conducive to improve the structural diversity of the heat exchange device 100. Among them, the heat exchange medium may be refrigerant or water, etc. When the heat exchange medium is used for cooling, the heat exchange medium may flow into the first heat exchange component 2 from a lower part of the first heat exchange component 2 and flow out from an upper part of the first heat exchange component 2. The air may flow substantially from top to bottom in the housing 1. In this way, the heat exchange medium and the air are generally arranged in a countercurrent flow, which is conducive to improve the cooling effect of the first heat exchange component 2.

As shown in FIGS. 25, 26, 28 and 29, at least part of the second heat exchange component 4 is disposed on a side of the first heat exchange component 2 close to the second air inlet 10*d* in the first direction. That is, the first heat exchange component 2 has a first end and a second end in the first direction. The first end is located close to the second air inlet 10*d*, and the second end is located away from the second air inlet 10*d*. On a plane perpendicular to the first direction, an orthographic projection of the second heat exchange component 4 and an orthographic projection of the first end at least partially overlap, such that the air flowing into the housing 1 through the second air inlet 10*d* may exchange heat with the second heat exchange component 4, which is conducive to reduce the thickness of the heat exchange device 100. Taking the first direction as an up-down direction, on a plane perpendicular to the third direction, at least part of an orthographic projection of the second heat exchange component 4 is higher than an orthographic projection of the first heat exchange component 2. The cold air after heat exchange directly sinks in the first direction, and there is no need to set a turning on the cold air flow path, such that the resistance of the part of the cold air is small, which is conducive to enhance the natural sinking effect of the cold air and accelerate the spontaneous sinking of the air flow. In addition, the sinking of the part of the cold air creates a negative pressure on the downstream side of the first heat exchange component 2, which is conducive to driving more outside air to flow into the housing 1 through the first air inlet 10*a* in the third direction. After a heat exchange with the first heat exchange component 2, the air turns and sinks along the first direction to the first air outlet 10*b* with the cold air after heat exchange with the second heat exchange component 4, which is conducive to realize the circulation of air flow and improve the heat exchange efficiency. When the heat exchange device 100 is used for cooling, the condensed water generated by the second heat exchange component 4 may be collected together with the condensed water generated by the first heat exchange component 2, which facilitates the collection and discharge of the condensed water.

For example, in examples of FIGS. 25, 26, 28, and 29, taking the first direction as a vertical direction, the second air inlet 10*d* is disposed above the first heat exchange component 2, and the second heat exchange component 4 is disposed in the housing 1. At least part of the second heat exchange component 4 is disposed above an upper end of the first heat exchange component 2. In this case, along the first direction, an orthographic projection of the second heat exchange component 4 may overlap at least partially with an orthographic projection of the upper end of the first heat exchange component 2. A part of the second heat exchange component 4 is disposed directly above the upper end of the first heat exchange component 2, and another part of the second heat exchange component 4 is disposed inclinedly above the upper end of the first heat exchange component 2. Alternatively, along the first direction, the orthographic projection of the second heat exchange component 4 is disposed within the orthographic projection of the upper end of the first heat exchange component 2, and the second heat exchange component 4 is completely disposed directly above the upper end of the first heat exchange component 2. Therefore, the condensed water generated by the second heat exchange component 4 may flow down to the first heat exchange component 2 to be collected together with the condensed water generated by the first heat exchange component 2, which is conducive to the discharge of the condensed water.

It can be understood that the second heat exchange component 4 and the first heat exchange component 2 may be the same type of heat exchanger. In this case, the second heat exchange component 4 and the first heat exchange component 2 have the same structure to facilitate processing. The second heat exchange component 4 and the first heat exchange component 2 may also be different types of heat exchangers.

In some embodiments, as shown in FIG. 25, the housing 1 includes a first wall surface A and a second wall surface B arranged opposite to each other along the third direction, and the housing 1 is arranged with a first heat exchange component 2 and a second heat exchange component 4. An upstream communication chamber 111 is defined between the first heat exchange component 2 and the second wall surface B, a downstream communication chamber 112 is defined on a lower side of the upstream communication chamber 111, and the downstream communication chamber 112 is defined by the inner surface of the first wall surface A and the inner surface of the second wall surface B, such that the upstream communication chamber 111 and the downstream communication chamber 112 together constitute a communication chamber 11. At least part of the second heat exchange component 4 is disposed on a side of the first heat exchange component 2 close to the second air inlet 10*d* in the first direction. In the first direction, the height of the communication chamber 11 is H', and the sum of the heights of the first heat exchange component 2 and the second heat exchange component 4 is h. H' and h satisfy $0.2<h/H\leq 1$, which is conducive to the actual structural layout of the heat exchange device 100, while ensuring the overall effect of the heat exchange device 100. The less the value of h/H', the larger the space for storing cold air, the more cold air is stored. The gravity effect of the cold air is enhanced, thereby enhancing the spontaneous sinking effect of the cold air, which is conducive to improving the performance of the heat exchange device 100.

In some embodiments, as shown in FIG. 25, FIG. 26, FIG. 28, and FIG. 29, the second heat exchanging component 4 extends inclinedly along a direction from the first air inlet 10*a* to the first heat exchange component 2 in the third direction (for example, the front-rear direction in FIG. 25), and extends inclinedly along a direction from the first air inlet 10*a* to the second air inlet 10*d* in the first direction (for example, the up-down direction in FIG. 25). For example, the second heat exchange component 4 extends inclinedly from front to rear and from bottom to top, which is conducive to further increase the heat exchange area of the heat exchange device 100 and take advantage of the second air inlet 10*d*, such that the air flow into the housing 1 through the second air inlet 10*d* can better exchange heat with the second heat exchange component 4, improving the heat exchange efficiency. When the heat exchange device 100 is used for cooling, the cold air generated after heat exchange with the second heat exchange component 4 and the cold air generated after heat exchange with the first heat exchange component 2 can converge in a large amount, facilitating the spontaneous sinking of the cold air. Under the effect of the inclined arrangement of the second heat exchange component 4, the vertical downward velocity component of the cold air generated after heat exchange with the second heat exchange component 4 is increased, which further improves the sinking effect of the cold air, reduces the number of changes in the flow direction of the cold air, and reduces the wind resistance. In addition, the condensed water generated by the second heat exchange component 4 may flow downward along the inclined direction of the second heat exchange component 4, which facilitates the convergence and collection of the condensed water.

It can be understood that an inclination angle $\alpha$ of the second heat exchange component 4 relative to the first direction may be specifically set according to actual applications, for example, $\alpha$ may satisfy $-30'\leq\alpha\leq 30°$.

In addition, the arrangement of the second heat exchange component 4 is not limited to this. In some embodiments, the second heat exchange component 4 is arranged in parallel to the third direction. For example, during installation and use, the second heat exchange component 4 is arranged horizontally.

In other embodiments of the present disclosure, the housing 1 does not define the second air inlet 10*d*. In other embodiments, the heat exchange device 100 does not define the second air inlet 10*d* and the second heat exchange component 4 is not arranged, such that the heat exchange device 100 has a small number of components and a simple structure, which facilitates the reasonable layout of the components of the heat exchange device 100.

In some embodiments, as shown in FIGS. 2, 4-7, 25, 28 and 29, a water receiving box 5 is arranged on a side of the first heat exchange component 2 close to the first air outlet 10*b* in the first direction. The first heat exchange component 2 is configured to at least collect the condensed water generated by the first heat exchange component 2. At least most of an orthographic projection of the water receiving box 5 in the first direction is located within an orthographic projection of the first heat exchange component 2 in the first direction. That is, on a plane perpendicular to the first direction, at least most of the orthographic projection of the water receiving box 5 is located within the orthographic projection of the first heat exchange component 2. That is, in the first direction, the first heat exchange component 2 may cover at least most of the water receiving box 5, so as to ensure that the water receiving box 5 can effectively collect the condensed water generated by the first heat exchange component 2, and it is conducive to reduce the occupied space of the water receiving box 5 in the second direction and the third direction, thereby preventing the water receiving box 5 from being too long in the second direction to cause high costs, and preventing the water receiving box 5 from being too long in the third direction to cause greater wind resistance to the air after heat exchange. In this way, the cost of the water receiving box 5 is reduced, and it is conducive to the spontaneous sinking of cold air. Among them, most of the orthographic projection of the water receiving box 5 may occupy more than half of the total area of the orthographic projection of the water receiving box 5.

In the description of the present disclosure, "at least most" can be understood as more than half, and at least most of the orthographic projection occupies more than 50% of the total area of the orthographic projection. Then at least most of the orthographic projection of the water receiving box 5 occupies more than half of the total orthographic projection region of the water receiving box 5, that is, at least most of the orthographic projection of the water receiving box 5 occupies 50% of the total orthographic projection region of the water receiving box 5. "On a plane perpendicular to the first direction, at least most of the orthographic projection of the water receiving box 5 is disposed within the orthographic projection of the first heat exchange component 2", which can be understood as "on a plane perpendicular to the first direction, more than half of the orthographic projection of the water receiving box 5 is disposed within the orthographic projection of the first heat exchange component 2".

In examples of FIGS. 4-6, 25, 28, and 29, the first air outlet 10*b* is disposed under the first heat exchange component 2, the water receiving box 5 is arranged in the housing 1, and the water receiving box 5 is arranged on a lower side of the first heat exchange component 2. On a plane perpendicular to the first direction (i.e., the vertical direction of this embodiment), most of the orthographic projection of the water receiving box 5 is disposed within the orthographic projection of the first heat exchange component 2, and another small part is disposed outside the orthographic projection of the first heat exchange component 2. That is, in the first direction, the first heat exchange component 2 may only cover a part of the water receiving box 5. That is, in the first direction, most of the water receiving box 5 may be hidden under the first heat exchange component 2.

Figure 7:
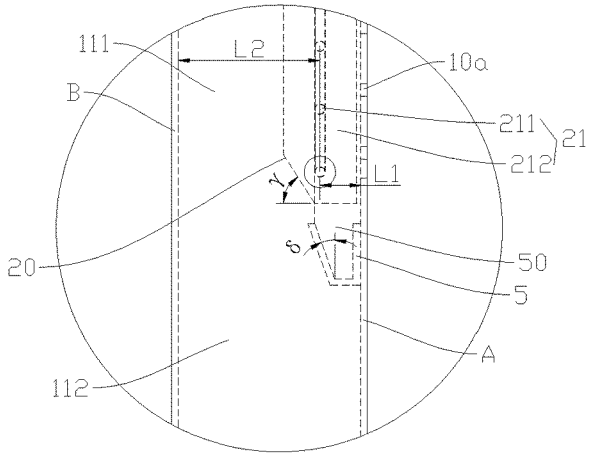
FIG. 7 is a schematic view of a heat exchange device according to other embodiments of the present disclosure.

Of course, the present disclosure is not limited to this. In some embodiments, as shown in FIG. 7, on a plane perpendicular to the first direction, the orthographic projection of the water receiving box 5 is completely disposed within the orthographic projection of the first heat exchange component 2. That is, in the first direction, the first heat exchange component 2 may completely shield the water receiving box 5, thereby further reducing the wind resistance of the water receiving box 5, which is conducive to the spontaneous sinking of cold air.

It can be understood that the condensed water collected in the water receiving box 5 can be recycled and reused. For example, a humidifying device may be arranged on the housing 1. The humidifying device is configured to convert the condensed water in the water receiving box 5 into a humidified air flow and deliver it to an air duct of the housing 1, or to the first air outlet 10*b*, or directly delivered to the indoor environment, for adjusting the humidity of the indoor air. In some examples, the humidifying device is an ultrasonic atomization device.

In some embodiments, the water receiving box 5 is arranged on the housing 1, and the water receiving box 5 is arranged under the first heat exchange component 2 at intervals. In the second direction, the length of the water receiving box 5 is greater than or equal to the length of the first heat exchange component 2, such that the water receiving box 5 effectively collects all the condensed water dripping from the first heat exchange component 2.

Figure 24:
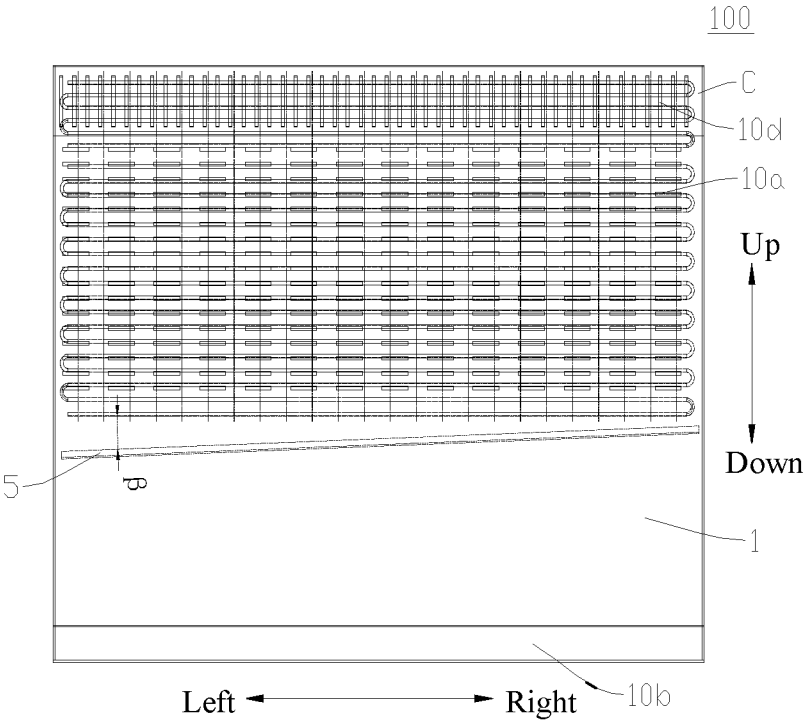
FIG. 24 is further another schematic view of the heat exchange device as shown in FIG. 22.
Figure 27:
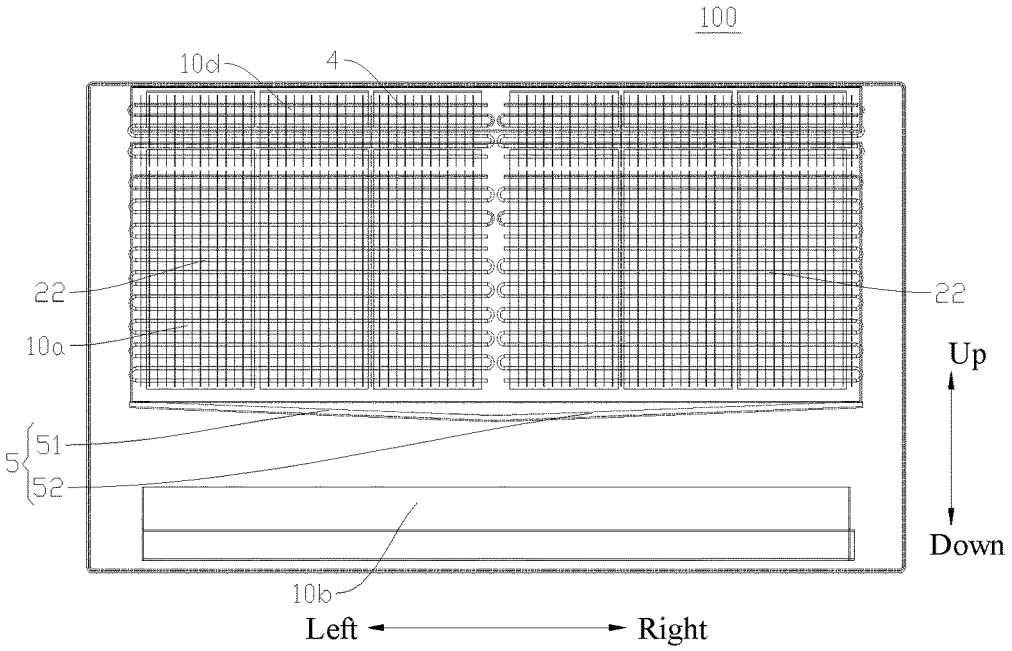
FIG. 27 is a schematic view of a heat exchange device according to other embodiments of the present disclosure.

In some embodiments as shown in FIG. 24, the water receiving box 5 extends linearly, and there is an included angle β between the extending direction of the water receiving box 5 and the second direction. β may be greater than 0°, such that the water receiving box 5 is inclined relative to the second direction, and the condensed water collected in the water receiving box 5 may flow spontaneously to an end of the water receiving box 5, which facilitates the discharge of the condensed water. Among them, β may satisfy $2° \leq \beta \leq 10°$. Of course, the present disclosure is not limited to this. For example, as shown in FIG. 27, the water receiving box 5 includes a first water receiving part 51 and a second water receiving part 52. The first receiving part 51 and the second receiving part 52 extend downward in a direction close to each other. A connection between the first water receiving part 51 and the second water receiving part 52 is the lowest, which also facilitates the discharge of condensate water. The connection between the first water receiving part 51 and the second water receiving part 52 may be located at any position of the water receiving box 5 in the second direction.

Figure 6:
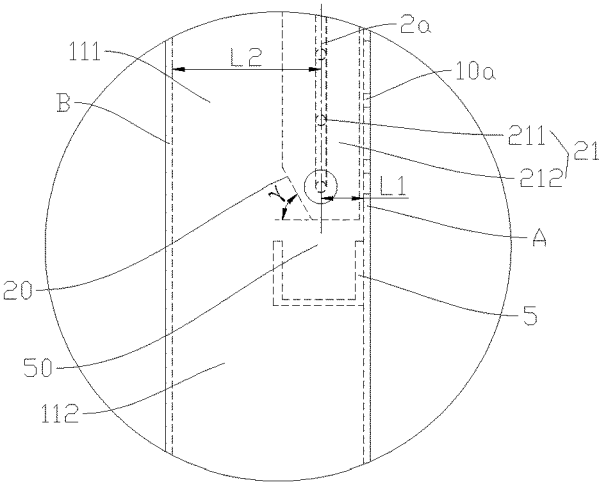
FIG. 6 is a partial schematic view of a heat exchange device according to other embodiments of the present disclosure.

In some embodiments, as shown in FIGS. 6 and 7, a side surface of the first heat exchange component 2 close to the water receiving box 5 is formed with an inclined part 20. At least part of the inclined part 20 is inclined with respect to the first direction. At least part of the inclined part 20 extends inclinedly along a direction from the first heat exchange component 2 to the water receiving box 5 in the first direction, and along a direction from the first heat exchange component 2 to the first air inlet 10*a* in the third direction. For example, at least part of the inclined part 20 extends inclinedly from top to bottom and from rear to front. Thus, the condensed water generated by the first heat exchange component 2 may flow downward, and when the condensed water flows to the inclined part 20, the condensed water may flow along the extending direction of the inclined part 20 and finally flow to the water receiving box 5. In this way, the inclined part 20 may guide the flow of condensed water, such that when the condensed water flows from the first heat exchange component 2 to the water receiving box 5, the space occupied by the condensed water in the third direction is small, which can reduce the width of the water receiving box 55 in the third direction, further reducing the wind resistance caused by the water receiving box 5.

For example, in example of FIGS. 6 and 7, taking the first direction as a vertical direction, and the third direction as a front-rear direction. The first heat exchange component 2 is a tube-fin heat exchanger, and the tube-fin heat exchanger includes a plurality of heat exchange fins 212 arranged at intervals. Each heat exchange fin 212 extends in the first direction. The heat exchange fins 212 may guide the flow of condensate water, and an inclined part 20 is formed on a lower edge of the heat exchange fins 212. The inclined part 20 extends inclinedly from top to bottom and from rear to front, such that the width of the lower edge of the heat exchange fins 212 in the third direction is less, and the width of the lower edge of the heat exchange fins 212 is less than the width of the upper edge of the heat exchange fins 212, which is conducive to guide the condensed water to the water receiving box 5. In some embodiments, as shown in FIGS. 6 and 7, the first heat exchange component 2 includes a plurality of first heat exchange tubes 211 and a plurality of heat exchange fins 212. The plurality of first heat exchange tubes 211 are arranged at intervals in the first direction, and the plurality of heat exchange fins 212 are arranged at intervals in the second direction. Each heat exchange fin 212 extends in the first direction, and each first heat exchange tube 211 extends in the second direction to sequentially pass through the plurality of heat exchange fins 212. A front end of the inclined part 20 extends forward to not exceed a vertical outer tangent line of a rear side of the first heat exchange tubes 211. When the front end of the inclined part 20 extends forward to the vertical outer tangent line of the rear side of the first heat exchange tubes 211, the front end of the inclined part 20 and the rear side wall of the first heat exchange tubes 211 face each other directly up and down.

It can be understood that an included angle $\gamma$ between the inclined part 20 and the third direction may be specifically set according to actual applications. In some embodiments, $\gamma$ satisfies $50° \leq \gamma \leq 85°$, for example, $\gamma$ is 60°.

As shown in FIGS. 4-7, the top of the water receiving box 5 is open to form a water receiving port 50. In the third direction, the width of the water receiving port 50 is greater than or equal to the width of the lower edge of the heat exchange fin 212. When the width of the water receiving port 50 is equal to the width of the lower edge of the heat exchange fin 212, the water receiving port 50 and the lower edge of the heat exchange fin 212 are aligned up and down, which is conducive to reduce the wind resistance generated by the water receiving box 5. The rear side wall of the water receiving box 5 is inclined with respect to the third direction, and the rear side wall of the water receiving box 5 extends from top to bottom and from rear to front to further reduce the wind resistance generated by the water receiving box 5 and prevent the airflow from forming a larger stagnation region under the water receiving box 5, ensuring smooth airflow.

An included angle between the rear side wall of the water receiving box 5 and the first direction is $0° < \delta \leq 40°$, for example, $\delta$ is 20°.

Figure 9:
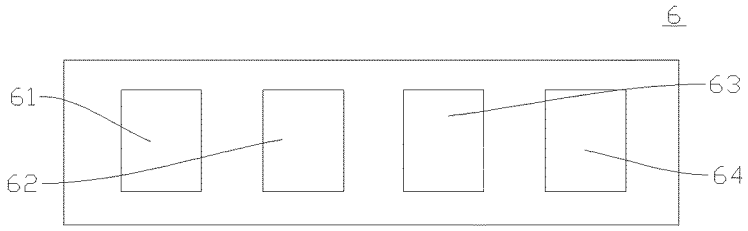
FIG. 9 is a schematic view of an additional component as shown in FIG. 8.

In some embodiments, as shown in FIGS. 8 and 9, the heat exchange device 100 further includes an additional component 6 disposed in the housing 1. The additional component 6 includes at least one of a heat radiation component 61, an electric heating component 62, a display and control component 63, and a humidification component 64. For example, when the additional component 6 includes the heat radiation component 61, the heat radiation component 61 may transfer heat to the surrounding air by means of heat radiation to prevent cold suspicion of water on a radiation surface of the heat radiation component 61 due to exposure to the indoor environment, which can easily breed mold in long-term use. The present disclosure is conducive to the long-term use of the additional component 6 and facilitates the maintenance of the additional component 6. When the heat exchange device 100 heats, it can be heated by combining radiation and convection. When the additional component 6 includes the electric heating component 62 such as a heating wire or other heating element, the electric heating component 62 may transfer heat to the surrounding air by means of convection. When the additional component 6 includes the display and control component 63, the display and control component 63 may be configured to display operating status and/or environmental parameters, such as wind speed, ambient temperature, environmental humidity, etc. of the heat exchange device 100. When the additional component 6 includes the humidification component 64, the humidification component 64 may be configured to deliver humidified air to the environment to increase the environmental humidity and improve user comfort.

Among them, the additional component 6 may be disposed on a side of the first heat exchange component 2 close to the first air outlet **10*b* in the first direction, thereby facilitating the arrangement of the additional component 6, which can effectively facilitate the internal space of the housing 1 and enhance the utilization of the internal space of the housing 1. At least most of an orthographic projection of the additional component 6 in the first direction is disposed within the orthographic projection of the first heat exchange component 2 in the first direction. That is, on a plane perpendicular to the first direction, at least most of the orthographic projection of the additional component 6 is disposed within the orthographic projection of the first heat exchange component 2. In this way, in the first direction, the first heat exchange component 2 may shield at least most of the additional component 6, which is conducive to reduce the space occupied by the additional component 6 in the second and third directions. The additional component 6 is not too long in the second direction, which reduces the wind resistance of the additional component 6 to the air after heat exchange in the third direction, thereby reducing the cost of the additional component 6 and further facilitating the spontaneous sinking of cold air. Among them, the most of the orthographic projection of the additional component 6 may occupy more than half of the total orthographic projection region of the additional component 6**.

It can be understood that when the surface temperature of the additional component 6 is relatively high, for example, in some embodiments where the additional component 6 includes the heat radiation component 61 and/or an electric heating component 62, the outer surface of the housing 1 may be arranged with a protective member 13 facing the additional component 6 to effectively isolate the additional component 6 from the user, thereby preventing the user from directly touching the outer surface of the housing 1 and being burned, effectively ensuring the safety of the user. The protective member 13 may be a protective net 130, which is not limited in the present disclosure.

In some embodiments, as shown in FIG. 21, the heat exchange device 100 further includes an air deflector 7, which is movably arranged at the first air outlet 10*b* to adjust the outlet direction of the first air outlet 10*b* and/or to open and close the first air outlet 10*b*. Following situations may be included: (1) the air deflector 7 is configured to move relative to the first air outlet 10*b* to adjust the air outlet direction of the first air outlet 10*b*; (2) the air deflector 7 is configured to move relative to the first air outlet 10*b* to open and close the first air outlet 10*b*; (3) the air deflector 7 is configured to move relative to the first air outlet 10*b* to adjust the air outlet direction of the first air outlet 10*b*, and the air deflector 7 also realizes the opening and closing of the first air outlet 10*b*.

For example, the air deflector 7 is formed as a deflector sheet, and the movement of the deflector sheet changes the air outlet direction of the first air outlet 10*b*. To a certain extent, it is conducive to further expand the air supply range of the heat exchange device 100, such that the entire indoor air may form a wide range of circulation. Of course, the deflector sheet may be configured to open and close the first air outlet 10*b*. For another example, the air deflector 7 is formed as an opening and closing door, and the first air outlet 10*b* is opened and closed by the movement of the opening and closing door. The first air outlet 10*b* is opened to realize normal air outlet of the first air outlet 10*b*, and the first air outlet 10*b* is closed to prevent external dust from entering the housing 1 through the first air outlet 10*b*, ensuring the cleanliness of the heat exchange device 100. Of course, the opening and closing the door may also be configured to adjust the air outlet direction of the first air outlet 10*b*.

In some embodiments, as shown in FIG. 25, the heat exchange device 100 further includes an air guiding structure 8, which is arranged opposite to the first air outlet 10*b* along the third direction. The air-inducing structure 8 includes a guide surface 81 extending toward the first air outlet 10*b*. The guide surface 81 guides the airflow in the housing 1 toward the first air outlet 10*b*, which is conducive to reduce the flow resistance of the airflow and realize the smooth flow of the airflow to the first air outlet 10*b*.

In an example of FIG. 25, taking the third direction as a front-rear direction, the first air outlet 10*b* is defined on the front wall surface of the housing 1, the air guiding structure 8 is disposed on the rear side of the first air outlet 10*b*, and at least a part of the front side wall surface of the air guiding structure 8 forms the guide surface 81. The air guiding structure 8 is formed as a guide plate, and the cross section of the guide surface 81 is formed as a curve, such as a circular arc, to guide the heat exchanged air smoothly towards the first air outlet 10*b*. Among them, a diversion angle of the guide surface 81 is between 0° and 90° (including the endpoint values) to better meet the requirements of different scenarios.

It can be understood that, in some examples, the outer surface of the air guiding structure 8 is a part of the outer surface of the housing 1; in other examples, the air guiding structure 8 is arranged in the housing 1.

In some embodiments, as shown in FIG. 25, taking the first direction as a vertical direction and the third direction as a front-rear direction, the first air outlet 10*b* is defined on the front wall surface of the housing 1, and a water blocking structure 14 is arranged at the lower end of the first air outlet 10*b*. The water blocking structure 14 is formed as a water blocking strip. The water blocking strip extends vertically upward from the lower end edge of the first air outlet 10*b*, or extends upward inclinedly, so as to prevent the condensed water generated on the inner wall of the housing 1 from dropping into the room through the first air outlet 10*b*, which ensures the cleanliness of the room. Of course, no water blocking structure 14 may be arranged at the first air outlet 10*b*.

In some embodiments, as shown in FIGS. 1-8, 21 and 22, the heat exchange device 100 does not include a fan, that is, the heat exchange device 100 is not arranged with a fan and does not use a fan to drive the airflow. When the heat exchange device 100 is working, the airflow and the first heat exchange component 2 naturally convectively exchange heat, which effectively reduces the operating noise of the heat exchange device 100, simplifies the structure of the heat exchange device 100, and reduces the power consumption of the heat exchange device 100, reducing costs. Compared to the heat exchange device with a fan, the heat exchange device 100 without a fan avoids the noise and abnormal noise generated by the operation of the fan, which is conducive to improve the comfort for the heat exchange device 100.

In some embodiments, as shown in FIG. 1, the thickness of the housing 1 in the third direction is D, the width of the housing 1 in the second direction is W, and the height of the housing 1 in the first direction is H. D, W and H satisfy the relationship: $D \times W \times H \geq 0.15\ m^3$, $0.05 \leq D/W \leq 2$, $0.1 \leq H/W \leq 5$, $0.05 \leq D/H \leq 4$. Therefore, the housing 1 has a reasonable design size, which is convenient to be applied to various occasions.

In some embodiments, as shown in FIGS. 1, 8, 22, 25, 28, and 29, the first air outlet 10*b* is disposed at an end of the housing 1 in the first direction, and the air after heat exchange with the first heat exchange component 2 may flow in the first direction to the first air outlet 10*b* and be discharged through the first air outlet 10*b*, so as to reduce the number of changes in the air flow direction after heat exchange to a certain extent. Under the premise that the size of the convergence space of the air after heat exchange is fixed, it is convenient to ensure that the air outlet parameters of the first air outlet 10*b* meet requirements and improve the comfort of users. In addition, under the premise that the heat exchanger 100 occupies a certain space, it is convenient to provide a larger convergence space for the air after heat exchange, which is conducive to the spontaneous flow of air and enhances the velocity air volume in the first direction. For example, when the heat exchange device 100 is used for cooling, it is convenient for the heat exchange device 100 to provide a larger convergence space for the cold air after heat exchange, which is conducive to the spontaneous sinking of the cold air.

Figure 28:
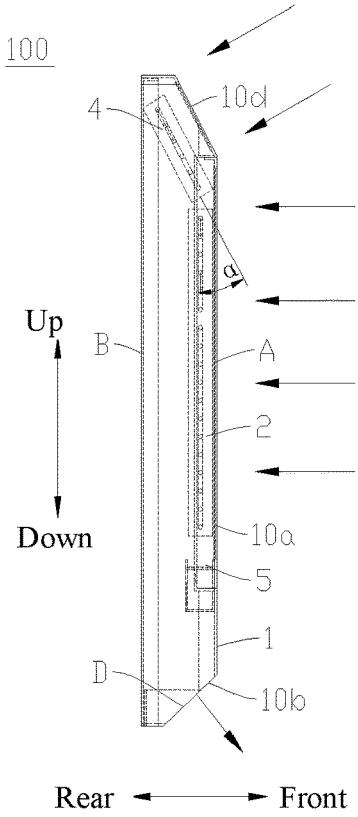
FIG. 28 is a schematic view of a heat exchange device according to other embodiments of the present disclosure.
Figure 29:
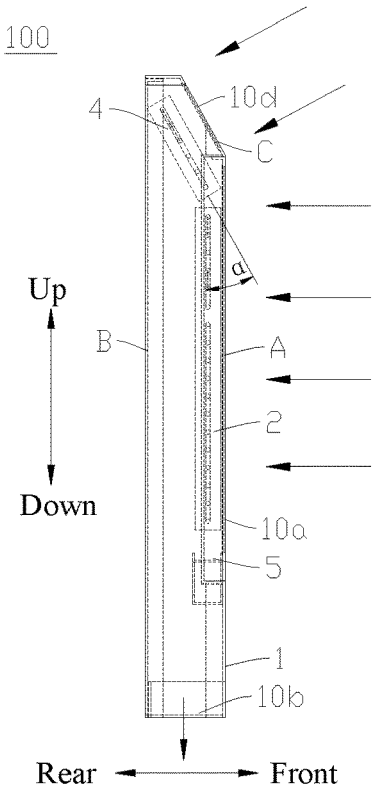
FIG. 29 is a schematic view of a heat exchange device according to other embodiments of the present disclosure.

Taking the first direction is as an up-down direction, and the third direction as a front-rear direction, in an example of FIG. 29, the first air outlet 10*b* is defined on the bottom wall of the lower end of the housing 1, and the opening direction of the first air outlet 10*b* is set downward. The cold air after heat exchange with the first heat exchange component 2 may flow downward and be discharged downward through the first air outlet 10*b*, which further reduces the number of changes in the flow direction of the cold air, reduces the wind resistance, and facilitates ensuring that the cold air parameters of the first air outlet 10*b* meet the requirements. In examples of FIGS. 1, 8, 22 and 27, the first air outlet 10*b* is defined on the front wall surface of the lower end of the housing 1. In still other examples, the first air outlet 10*b* may be defined on the side wall surface (for example, the left side wall and the right side wall) of the lower end of the housing 1; or, the first air outlet 10*b* may be defined on a second inclined wall surface D (as shown in FIG. 28), the second inclined wall surface D is inclined with respect to the front wall surface of the housing 1, that is, the opening direction of the first air outlet 10*b* is inclined forward and downward. In addition, in some other examples, the first air outlet 10*b* is defined at the upper end of the housing 1.

Figure 33:
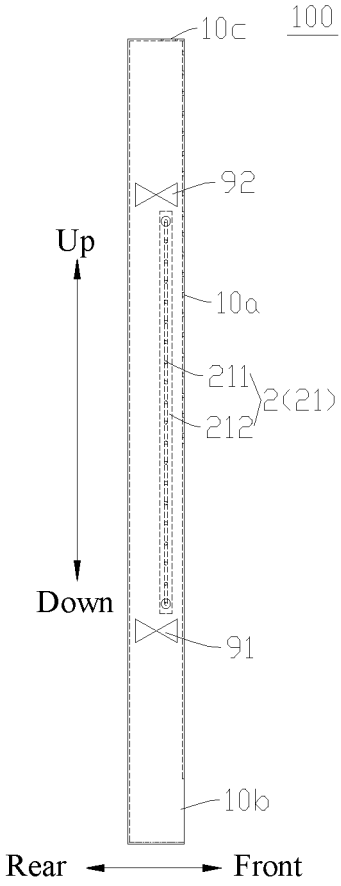
FIG. 33 is a schematic view of a heat exchange device according to other embodiments of the present disclosure.

In some embodiments, as shown in FIG. 33, the housing 1 defines a second air outlet 10*c*, and the air in the housing 1 may flow from the second air outlet 10*c* to the outside of the housing 1. The second air outlet 10*c* and the first air inlet 10*a* are arranged at intervals along the first direction. That is, on a plane parallel to the first direction, the orthographic projection of the second air outlet 10*c* and the orthographic projection of the first air inlet 10*a* have no overlap. That is, the orthographic projection of the second air outlet 10*c* and the orthographic projection of the first air inlet 10*a* are spaced apart. The second air outlet 10*c* and the first air outlet 10*b* are disposed at both ends of the housing 1 in the first direction; that is, the first air outlet 10*b* is disposed at an end of the housing 1 in the first direction, and the second air outlet 10*c* is disposed at the other end of the housing 1 in the first direction. Therefore, by providing the second air outlet 10*c*, the first air outlet 10*b* and the second air outlet 10*c* may be respectively suitable for cooling and heating of the heat exchange device 100, which is convenient to ensure the cooling effect and heating effect of the heat exchange device 100.

Taking the first direction as an up-down direction, the first air outlet 10*b* is disposed at the lower end of the housing 1, and the second air outlet 10*c* is disposed at the upper end of the housing 1. When the heat exchange device 100 is used for cooling, the air in the housing 1 enters the housing 1 through the first air inlet 10*a* and exchanges heat with the first heat exchange component 2. The heat exchanged air becomes cold air, and the cold air is with greater density and can sink spontaneously. The cold air flows downward in the first direction to the first air outlet 10*b*, and is discharged through the first air outlet 10*b*. A negative pressure is formed at the first air inlet 10*a*, and the air outside the housing 1 flows into the housing 1 through the first air inlet 10*a* and then exchanges heat with the first heat exchange component 2. In this way, the refrigeration cycle of the heat exchange device 100 is realized, and during the cooling operation of the heat exchange device 100, the air and the first heat exchange component 2 naturally convectively transfer heat, such that the heat exchange device 100 has a softer wind, which is conducive to improve comfort for the heat exchange device 100 in use.

When the heat exchange device 100 is used for heating, the air in the housing 1 enters the housing 1 through the first air inlet 10*a* and exchanges heat with the first heat exchange component 2. The heat exchanged air is formed into hot air, and the hot air is with less density and can rise spontaneously. The hot air flows upward in the first direction to the second air outlet 10*c*, and is discharged through the second air outlet 10*c*. A negative pressure is formed at the first air inlet 10*a*, and the air outside the housing 1 flows into the housing 1 through the first air inlet 10*a*, and then exchanges heat with the first heat exchange component 2. In this way, the heating cycle of the heat exchange device 100 is realized, and during the heating operation of the heat exchange device 100, the air and the first heat exchange component 2 naturally convectively transfer heat, such that the heat exchange device 100 has a softer wind, which is conducive to improve comfort for the heat exchange device 100 in use.

In an example of FIG. 33, the second air outlet 10*c* is defined at the upper end of the housing 1, the second air outlet 10*c* is defined on the top wall of the housing 1, and the opening direction of the second air outlet 10*c* is set upwards. The hot air after heat exchange with the heat exchange component 2 can flow upwards and be discharged upwards through the second air outlet 10*c*, which is conducive to further reduce the number of changes in the flow direction of the hot air, reduce wind resistance, and facilitate ensuring that the hot air parameters of the second air outlet 10*c* meet the requirements. In other examples, the second air outlet 10*c* is defined on the front wall surface of the upper end of the housing 1, and the opening direction of the second air outlet 10*c* is set forwards. In still other examples, the second air outlet 10*c* may be defined on the side wall surface (for example, the left side wall surface and the right side wall surface) of the upper end of the housing 1. In still other examples, the second air outlet 10*c* is defined on a first inclined wall surface C, and the first inclined wall surface C is inclinedly arranged with respect to the front wall surface of the housing 1, that is, the opening direction of the second air outlet 10*c* is inclined forward and upward.

In some embodiments, as shown in FIG. 33, the heat exchange device 100 further includes a first switching valve 91 arranged in the housing 1. The first switching valve 91 is configured to control the connection and blocking of the first air inlet 10*a* and the first air outlet 10*b*. For example, the first switching valve 91 is arranged on a side of the first heat exchange component 2 close to the first air outlet 10*b*, such that the first switching valve 91 controls the communication and blocking of the first air inlet 10*a* and the first air outlet 10*b*.

The first switching valve 91 has a first state and a second state. When the first switching valve 91 is switched to the first state, the first air inlet 10*a* communicates with the first air outlet 10*b*, the air enters the housing 1 from the first air inlet 10*a* and exchanges heat with the first heat exchange component 2, and the heat exchanged air flows to the first air outlet 10*b* and is discharged from the first air outlet 10*b*. When the first switching valve 91 is switched to the second state, the first air inlet 10*a* is blocked from the first air outlet 10*b*, that is, the first air inlet 10*a* and the first air outlet 10*b* are not connected; the air enters the housing 1 from the first air inlet 10*a* and exchanges heat with the first heat exchange component 2, and the heat exchanged air cannot be discharged from the first air outlet 10*b*.

As shown in FIG. 33, the heat exchange device 100 further includes a second switching valve 92 arranged in the housing 1. The second switching valve 92 is configured to control the connection and blocking of the first air inlet 10*a* and the second air outlet 10*c*. For example, the second switching valve 92 is arranged on a side of the first heat exchange component 2 close to the second air outlet 10*c*, such that the second switching valve 92 controls the communication and blocking of the first air inlet 10*a* and the second air outlet 10*c*.

The second switching valve 92 has a first state and a second state. When the second switching valve 92 is switched to the first state, the first air inlet 10*a* communicates with the second air outlet 10*c*, the air enters the housing 1 from the first air inlet 10*a* and exchanges heat with the first heat exchange component 2, and the heat exchanged air flows to the second air outlet 10*c* and is discharged from the second air outlet 10*c*. When the second switching valve 92 is switched to the second state, the first air inlet 10*a* is blocked from the second air outlet 10*c*, that is, the first air inlet 10*a* and the second air outlet 10*c* are not connected; the air enters the housing 1 from the first air inlet 10*a* and exchanges heat with the first heat exchange component 2, and the heat exchanged air cannot be discharged from the second air outlet 10*c*.

In this way, by arranging the first switching valve 91 and the second switching valve 92, and relatively switching the states of the first switching valve 91 and the second switching valve 92, it is conducive to the concentration of the air after the heat exchange in the heat exchange device 100 and the spontaneous flow effect of air. For example, when the heat exchange device 100 is used for refrigeration, the first switching valve 91 is switched to the first state and the second switching valve 92 is switched to the second state, which is conducive to improve the spontaneous sinking effect of cold air. When the heat exchange device 100 is used for heating, the first switching valve 91 is switched to the second state and the second switching valve 92 is switched to the first state, which is conducive to enhance the spontaneous rise effect of the hot air.

It should be noted that in the description of the present disclosure, "spaced" means that two components are separated from each other without contacting each other, such that the spatial separation distance between the two components is greater than zero.

Hereinafter, a refrigerant circulation system 200 according to embodiments of the second aspect of the present disclosure will be described with reference to the accompanying drawings FIGS. 34-35. A labeling system used in FIGS. 34-35 is as follows:

refrigerant circulation system 200, compressor 101, heat exchange device 102, throttling device 103, reversing device 104, heat exchange device 100.

Figure 34:
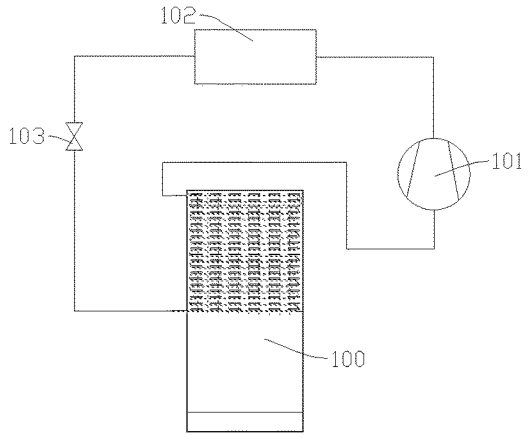
FIG. 34 is a schematic view of a refrigerant circulation system according to some embodiments of the present disclosure.
Figure 35:
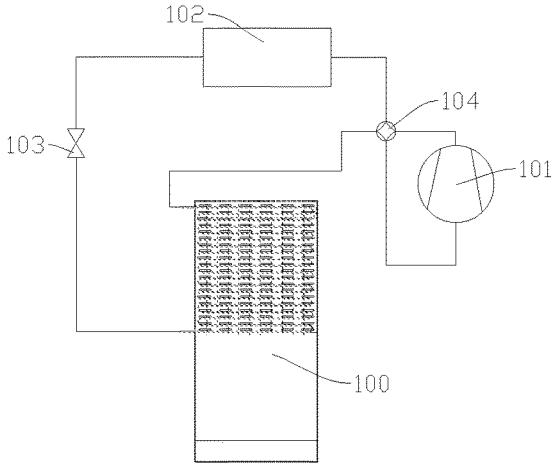
FIG. 35 is a schematic view of a refrigerant circulation system according to other embodiments of the present disclosure.

As shown in FIGS. 34-35, the refrigerant circulation system 200 includes a compressor 101 and a heat exchange device 100. The compressor 101 is disposed outside the housing 1 of the heat exchange device 100, which may save the space occupied by the housing 1. The compressor 101 communicates with the first heat exchange component 2. The heat exchange device 100 is the heat exchange device 100 according to the embodiments of the first aspect of the present disclosure.

The compressor 101 and the first heat exchange component 2 are directly connected through tubelines (as shown in FIG. 34), or a reversing device 104 is arranged between the compressor 101 and the first heat exchange component 2. In this case, the compressor 101 may communicate with the first heat exchange component 2 through the reversing device 104 (as shown in FIG. 35). The present disclosure does not limit the specific implementation thereof, as long as the heat exchange medium flowing out of the compressor 101 can flow into the first heat exchange component 2. The reversing device 104 may be a four-way valve, which is not limited herein.

In examples in FIGS. 34 and 35, the refrigerant circulation system 200 further includes a heat exchange device 102 and a throttling device 103. The throttling device 103 is connected between the heat exchange device 100 and the heat exchange device 102. It can be understood that the refrigerant circulation system 200 is formed as a single cooling system, and the refrigerant circulation system 200 may be used only for refrigeration. In this case, the heat exchange device 100 is used as an evaporator and the heat exchange device 102 is used as a condenser. Alternatively, the refrigerant circulation system 200 is formed as a cooling and heating system. The refrigerant circulation system 200 may be used for both cooling and heating. In this case, the heat exchange device 100 is used as an evaporator, and the heat exchange device 102 is used as a condenser; or the heat exchange device 100 is used as a condenser, and the heat exchange device 102 is used as an evaporator, which is not limited herein.

According to the refrigerant circulation system 200 of the embodiments of the present disclosure, by adopting the above-mentioned heat exchange device 100, the air output is soft, the operation noise is low, and it has good practicability.

Other configurations and operations of the refrigerant circulation system 200 according to the embodiments of the present disclosure are known to those skilled in the art, and will not be described in detail here.

The following describes an air-conditioning indoor unit of embodiments of the third aspect of the present disclosure with reference to the accompanying drawings FIGS. 36-50. A labeling system used in FIGS. 36-50 is as follows:

air-conditioning indoor unit 100, first heat exchanger 11, first heat exchange tubeline 111, first heat exchange fin 112 second heat exchanger 12, second heat exchange tubeline 121, second heat exchange fin 122 housing 13, front panel 131, rear panel 132, upper side panel 133, lower side panel 134, left side panel 135, right side panel 136 settlement enhancement region 137, first air inlet region 1311, second air inlet region 1331, first air outlet region 1341, second air outlet region 1351 (1361)

radiant heating panel 1312, protective net 1313 water collection tank 14, first fan 15, second fan 16, fan 17, injection device 18

The air-conditioning indoor unit in FIGS. 36-50 corresponds to the heat exchange device in FIGS. 1-33. The first heat exchanger corresponds to the first heat exchange component, and the second heat exchanger corresponds to the second heat exchange component.

Figure 36:
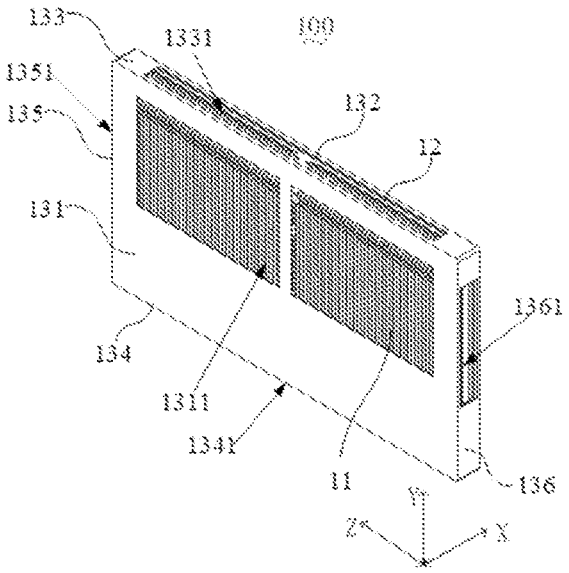
FIG. 36 is a structural schematic view of an air-conditioning indoor unit according to some embodiments of the present disclosure.

Referring to FIG. 36, which is a structural schematic view of an air-conditioning indoor unit according to some embodiments of the present disclosure. The air-conditioning indoor unit 100 of the present embodiments include a first heat exchanger 11, a second heat exchanger 12, and a housing 13.

The housing 13 includes a front panel 131 and a rear panel 132 oppositely arranged along a first direction X, an upper side panel 133 and a lower side panel 134 oppositely arranged along a second direction Y, and a left side panel 135 and a right side panel 136 oppositely arranged along a third direction Z. The first direction X, the second direction Y and the third direction Z are perpendicular to each other. In other embodiments, the left side panel 135 and the right side panel 136 may be omitted in the housing 13.

In the embodiments, the front panel 131 is arranged with a first air inlet region 1311, the upper side panel 133 is arranged with a second air inlet region 1331, and the lower side panel 134 is arranged with a first air outlet region 1341. Outside air enters from the first air inlet region 1311 and the second air inlet region 1331, and is discharged from the first air outlet region 1341.

Plates constituting the housing 13 are enclosed to define an accommodating cavity, that is, the housing 13 defines the accommodating cavity. The first heat exchanger 11 is arranged in the accommodating cavity, and the projection of the first air inlet region 1311 along the first direction X at least partly falls on the first heat exchanger 11, that is, the outside air entering from the first air inlet region 1311 is cooled by the first heat exchanger 11. The second heat exchanger 12 is arranged in the accommodating cavity, and the projection of the second air inlet region 1331 along the second direction Y at least partly falls on the second heat exchanger 12, that is, the outside air entering from the second air inlet region 1331 is cooled by the second heat exchanger 12.

The outside air enters the accommodating cavity from the second air inlet region 1331 of the upper side panel 133, becomes cooling air after passing through the second heat exchanger 12, and is discharged from the first air outlet region 1341 of the lower side panel 134. The outside air enters the accommodating cavity from the first air inlet region 1311 of the front panel 131 enters the accommodating cavity, becomes cooling air after passing through the first heat exchanger 11, and is discharged from the first air outlet region 1341 of the lower side panel 134.

In order to realize the above-mentioned refrigeration process, the first heat exchanger 11 is spaced apart from the rear panel 132 along the first direction X, and a space between the two forms a settlement enhancement region 137. The projection of the second heat exchanger 12 in the second direction at least partially falls into the settlement enhancement region 137.

The specific principle is that the first heat exchanger 11 and the second heat exchanger 12 cool the air in the accommodating cavity. Since the air density is different at different temperatures, and the cold air will sink and the hot air will rise, a cooling airflow will be thus formed in the accommodating cavity. At least part of the cooling airflow, such as the part cooled by the second heat exchanger 12, will sink in the settlement enhancement region 137 and be discharged through the first air outlet region 1341, such that the accommodating cavity is in a negative pressure state. The air outside the housing 13 enters the accommodating cavity from the first air inlet region 1311 and the second air inlet region 1331 under the action of the negative pressure in the accommodating cavity, and continues to be cooled through the first heat exchanger 11 and the second heat exchanger 12, thereby continuously generating a cooling airflow. Therefore, the embodiments can meet the refrigeration requirement without the need of a fan.

The whole process is to form a chimney effect in the settlement enhancement region 137, and a large amount of cold air accumulation is formed through the chimney effect, and then cold air flows from the first air outlet region 1341. This enhanced air sinking will further cause a continuous flow of indoor return air from the first inlet region 1311 and the second inlet region 1331 for entering to complete the circulation of indoor air supply and return air. The embodiments rely on the principle of natural circulation formed by the change of air density with temperature, and do not need a fan to operate, thereby realizing the effect of no noise and low wind feeling.

In addition, in the embodiments, the first heat exchanger 11 and the second heat exchanger 12 are combined, and the second heat exchanger 12 further enhances the air cooling and negative pressure formation in the settlement enhancement region 137, such that the overall cooling efficiency is higher.

The air-conditioning indoor unit 100 of some embodiments may include a first heat exchanger 11 and a housing 13. In these embodiments, the front panel is arranged with a first air inlet region 1311, and the lower side panel 134 is arranged with a first air outlet region 1341. The outside air enters from the first air inlet region 1311 and is discharged from the first air outlet region 1341. Plates constituting the housing 13 are enclosed to define an accommodating cavity, that is, the housing 13 defines the accommodating cavity. The first heat exchanger 11 is arranged in the accommodating cavity, and the projection of the first air inlet region 1311 along the first direction X at least partly falls on the first heat exchanger 11, that is, the outside air entering from the first air inlet region 1311 is cooled by the first heat exchanger 11. The first heat exchanger 11 is spaced apart from the rear panel 132 along the first direction X, and the space between the two forms a settlement enhancement region 137.

The specific principle is that the first heat exchanger 11 cools the air in the accommodating cavity. Since the air density is different at different temperatures, the cold air will sink and the hot air will rise, a cooling airflow will be thus formed in the accommodating cavity. At least part of the cooling airflow sinks in the settlement enhancement region 137 and is discharged through the first air outlet region 1341, such that the accommodating cavity is in a negative pressure state. The air outside the housing 13 enters the accommodating cavity from the first air inlet region 1311 under the action of the negative pressure in the accommodating cavity, and continues to be cooled by the first heat exchanger 11, thereby continuously generating a cooling airflow. Therefore, the embodiments can meet the refrigeration requirement without the need of a fan.

Further, in order to achieve an efficient cooling effect, in the embodiments, the thickness of the first heat exchanger 11 along the first direction X is T1, the distance between the inner wall surface of the front panel 131 and the inner wall surface of the rear panel 132 in the first direction is G1, and the distance between the surface of the first heat exchanger 11 facing the rear panel 132 and the inner wall surface of the rear panel 132 in the first direction is G2. The ratio between T1 and G1 is 0.06-0.5, and the ratio between T1 and G2 is 0.068-1, which makes the settlement enhancement region have a certain width in the first direction to form a chimney effect, such that the overall refrigeration efficiency is higher. Therefore, in the embodiments, the entire air-conditioning indoor unit may be designed to be light and thin, and the thickness T2 of the entire air-conditioning indoor unit 100 along the first direction X may be designed to be less than 90 mm, which realizes the light and thin design and can also have efficient cooling effect.

Figure 37:
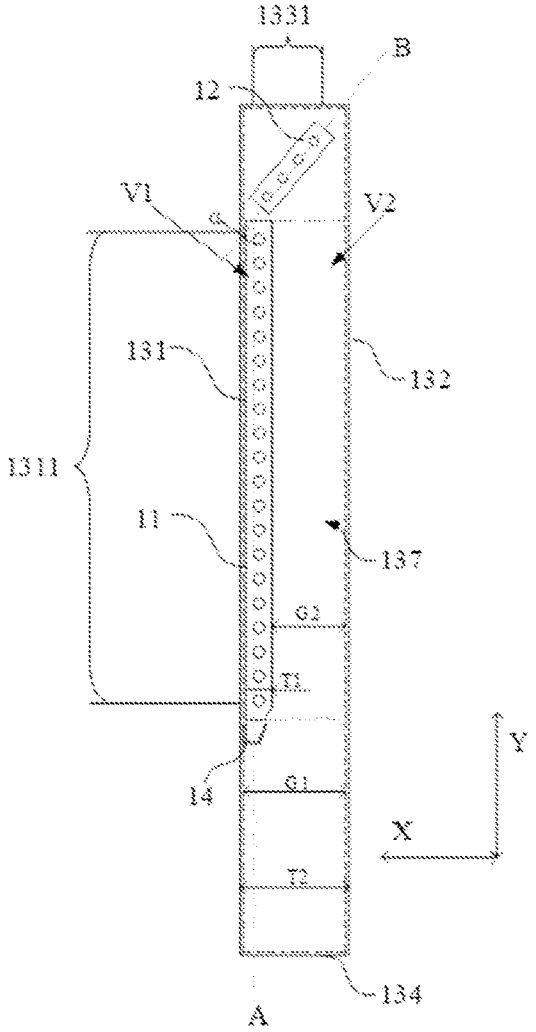
FIG. 37 is a side schematic view of the air-conditioning indoor unit as shown in FIG. 36.

In order to enhance the effect of the chimney effect, the lower edge of the projection region of the first heat exchanger 11 on the front panel 131 is disposed between the lower edge of the first air inlet region 1311 and the lower side panel 134. As shown in FIG. 37, FIG. 37 is a schematic side view of the air-conditioning indoor unit shown in FIG. 36. Further, the projection region of the second heat exchanger 12 on the upper side panel 133 covers the second air inlet region 1331 to improve the cooling effect.

The present disclosure also proposes an air-conditioning indoor unit 100 including a first heat exchanger 11, a radiant heating panel 1312 and a housing 13. Among them, the air-conditioning indoor unit 100 of the present embodiments not only realizes the cooling function, but also realizes the heating function. The radiant heating panel 1312 is arranged on the front panel 131 for realizing the environmental heating effect through the radiant heating panel 1312. An electric heating wire or other heating elements may be arranged in the radiant heating panel 1312.

Considering that the temperature of the radiant surface may be too high, a protective net 1313 may be arranged on the outer surface of the radiant heating panel 1312 to prevent users from directly touching the high-temperature surface.

The radiant heating panel 1312 is specifically disposed between the first air inlet region 1311 and the lower side panel 134, and the area of the radiant heating panel 1312 is smaller than the area of the first air inlet region 1311.

The first air inlet region 1311 is a region on the front panel 131 for the outside air to enter, and it may be an overall opening. In this case, the entire opening is the first air inlet region 1311. A dust-proof design may also be considered, that is, the first air inlet region 131 is designed with an opening. In this case, a region enclosed by multiple openings may be taken as the first air inlet region 1311, and in order to improve the efficiency of the air inlet, the first air inlet region 1311 in these embodiments is a region with an aperture rate of not less than 0.15 per square decimeter. For aesthetics or other considerations, one or two small holes opened separately are not considered to belong to the first air inlet region 1311. The second inlet region 1331 is defined in the same way.

For the entire air-conditioning indoor unit, in order to obtain an efficient chimney effect, in a region between the first heat exchanger 11 and the lower side panel 134, a part of housing may be designed with a hollow board for heat insulation, or thermal insulation materials may be pasted inside, thereby insulating the cooling airflow temperature to improve sinking efficiency.

In view of the difference in the user's perception of heating and cooling, the lower side panel 134 of the air-conditioning indoor unit 100 may be designed to rotate. For example, the lower side panel 134 may be rotatably connected to the rear panel 132, or rotatably connected to the left side panel 135 and the right side panel 136. In this way, the air supply direction of the wind region 1341 is adjustable. Alternatively, a part of the housing 13 close to the lower side panel 134 may be capable of moving up and down or rotating, such that the position or the air supply direction of the first air outlet region 1341 may be adjusted.

Figure 38:
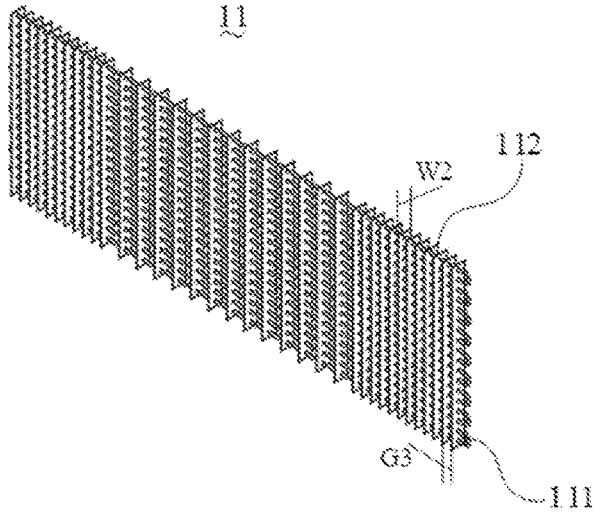
FIG. 38 is a structural schematic view of a first heat exchanger of the air-conditioning indoor unit as shown in FIG. 36.
Figure 39:
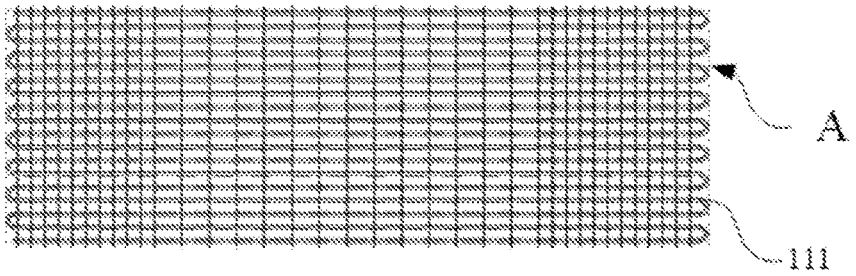
FIG. 39 is a structural front schematic view of the first heat exchanger as shown in FIG. 38.

The above-mentioned fanless design in the embodiments may correspond to the use of a heat exchanger with a simple structure. For example, as shown in FIGS. 37-39, in some embodiments, the first heat exchanger 11 includes a plurality of first heat exchange tubes 111 arranged at intervals along a first reference plane A. The first heat exchanger tubelines 111 in FIG. 38 have a single-row structure, that is, the first heat exchange tubelines 111 are arranged along a single reference plane. In other embodiments, they may also be a double-row or multi-row structure. That is, there are multiple sets of heat exchange tubelines, each set of heat exchange tubelines are arranged along a reference plane, and multiple sets of heat exchange tubelines are arranged along multiple parallel reference planes.

The first reference plane A is a plane on which the 111 are disposed. An angle between the first reference plane A and the second direction Y is greater than or equal to 0 degrees and less than or equal to 5 degrees. A space V1 defined by the orthographic projection of the first reference plane A on the front panel 131 along the first direction X is smaller than a space V2 defined by the orthographic projection of the first reference plane A on the rear panel 132 along the first direction X. That is, the volume of the space V1 is less than the volume of the space V2. The area of the first reference plane A and the distance from the first reference plane A to the front panel 131 or the rear panel 132 are necessary when calculating the space volume. The first reference plane A is a region enclosed by the first heat exchange tubes 111, which is shown as the dashed frame A in FIG. 39. Therefore, the area of the first reference plane A is the area of the region enclosed by edges of the heat exchange tubelines, such that a region between the first heat exchanger 11 and the rear panel 132 may define the settlement enhancement region.

The first heat exchanger 11 further includes a plurality of first heat exchange fins 112 arranged at intervals along the third direction Z. A thermally conductive connection is formed between the first heat exchange fins 112 and the first heat exchange tubelines 111.

In order to obtain small wind resistance of natural air supply and good cooling effect, the ratio of the width W1 of the first heat exchange fins 112 to the distance G3 between two adjacent first heat exchange fins 112 in these embodiments is greater than or equal to 2.5 and less than or equal to 7.

Figure 40:
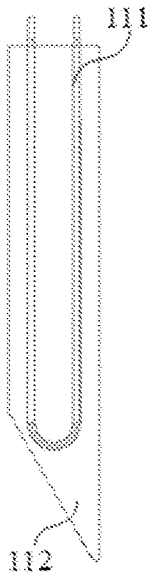
FIG. 40 is a structural schematic view of an air-conditioning indoor unit according to other embodiments of the present disclosure.
Figure 41:
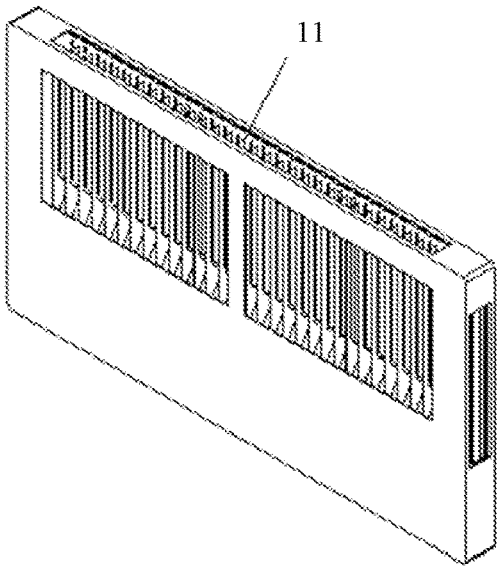
FIG. 41 is a structural schematic view of the first heat exchanger as shown in FIG. 40 applied to an air-conditioning indoor unit.

The heat exchanger may also be arranged in another way, as shown in FIGS. 40 and 41. Taking the first heat exchanger 11 as an example, it includes a plurality of first heat exchange fins 112. A plurality of first heat exchange tubelines 111 are integrated in the first heat exchange fins 112. The first heat exchange fins 112 have a first thickness T3 in a region where the first heat exchange tubelines 111 are disposed, and the first heat exchange fins 112 have a second thickness T4 in another region outside the first heat exchange tubelines 111. The ratio T3/T4 of the first thickness T3 to the second thickness T4 is greater than or equal to 1.1 and less than or equal to 2.5, and the ratio of G3/T3 of an interval G3 between two adjacent first heat exchange fins to the second thickness T3 is greater than or equal to 2 and less than or equal to 20.

The plurality of first heat exchange fins 112 are placed in the housing in series or in parallel. The first heat exchange tubelines 111 are configured as a refrigerant flow path, which may be formed by means of blowing on the first heat exchange fins 112. Generally, the refrigerant flow path may be set in a U shape. The arrangement of the first heat exchange tubelines 111 on the first heat exchange fins 112 makes the temperature on the first heat exchange fins 112 as uniform as possible. This kind of heat exchanger can reduce the obstruction to the air.

For the second heat exchanger 12, in conjunction with FIG. 37, in order to prevent the condensed water generated on the second heat exchanger 12 from directly dripping from the first air outlet region 1341 in the lower side panel 134, the second heat exchanger 12 in these embodiments is arranged inclinedly. The second heat exchanger 12 is arranged inclinedly, along a direction from the rear panel 132 to the front panel 131, toward the lower side panel 134. The projection of the second heat exchanger 12 along the second direction Y at least partially falls on the first heat exchanger 11. In this way, the condensed water on the second heat exchanger 12 can flow down along or through the region of the first heat exchanger 11. Further, in order to control the condensed water to flow down along the first heat exchanger 11 stably, the second heat exchanger 12 may be arranged in close contact with the first heat exchanger 11.

For the second heat exchanger 12 itself, the second heat exchanger 12 may be adopted with the above-mentioned two design methods of the first heat exchanger 11. In the embodiments, a plurality of second heat exchange tubelines 121 arranged at intervals along a second reference plane B are included. An included angle $\alpha$ between the first reference plane A and the second reference plane B is greater than 0 degrees and less than or equal to 30 degrees, that is, the second heat exchanger 12 may be arranged inclinedly without being too oblique, ensuring the cooling effect of the air entering the second air inlet region 1331.

The second heat exchanger 12 further includes a plurality of second heat exchange fins 122 arranged at intervals along the third direction, and the fin-width of the second heat exchange fins 122 may be greater than the fin-width of the first heat exchange fins 112.

Figure 42:
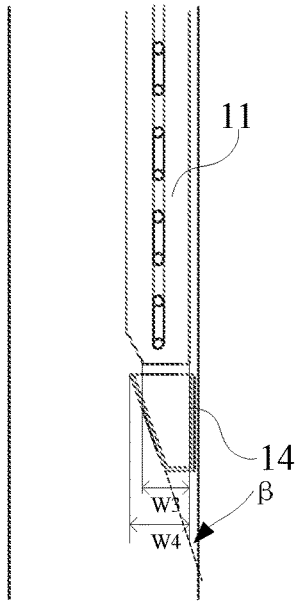
FIG. 42 is a structural side schematic view of a water collection tank in the air-conditioning indoor unit as shown in FIG. 36.
Figure 43:
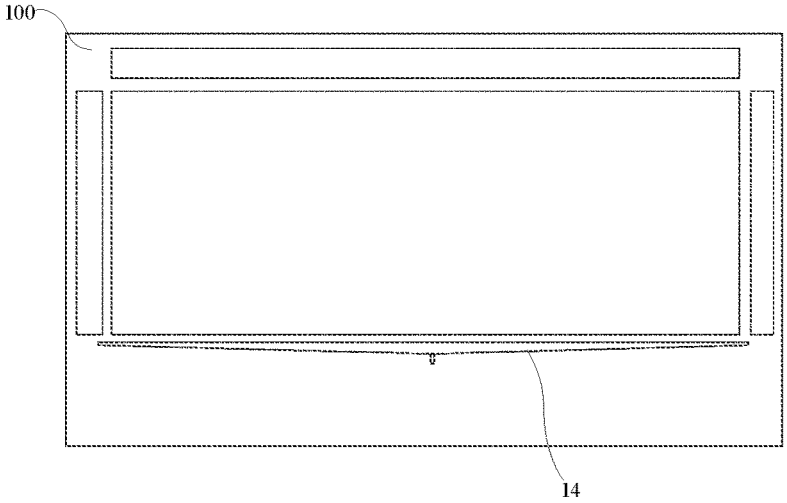
FIG. 43 is a structural front schematic view of a water collection tank in the air-conditioning indoor unit as shown in FIG. 36.

Since the heat exchanger generates condensed water when cooling the air, the air-conditioning indoor unit 100 may further include a water collection tank 14, referring to FIG. 42 and FIG. 43. The water collection tank 14 is arranged on a side of the first heat exchange fins 112 facing the lower side panel 134. The condensed water on the first heat exchanger 11 and the second heat exchanger 12 may be introduced into the water collection tank 14. The width W3 of the bottom edge of the first heat exchange fins 112 in the first direction is less than or equal to the width W4 of an opening of the water collection tank 14 in the first direction.

In the first direction, the water collecting tank 14, of which the width is greater than that of the first heat exchange fins 112, may affect the sinking of the cooling air flow. Therefore, a beveled edge may be arranged between a side edge of the first heat exchange fins 112 toward the rear panel 132 and a bottom edge of the first heat exchange fins 112 toward the lower side panel 134. The beveled edge is inclined, along a direction from the upper side panel 133 to the lower side panel 134, toward the front panel 131. In this way, the influence of the water collection tank 14 on the sinking of the cooling airflow is reduced. Specifically, the ratio between the maximum width of the water collection tank 14 in the first direction X (W4 in this embodiment) and the distance G1 between the front panel 131 and the rear panel 132 in the first direction X is less than or equal to 0.5.

Since the water collection tank 14 hinders the natural flow of airflow on a plane formed by the first direction and the third direction, and the side surface of the water collection tank 14 facing the rear panel 132 is a slope. The slope is inclined, along a direction from the upper side panel 133 to the lower side panel 134, toward the front panel 131, and an included angle β between the slope and the front panel 131 is greater than 0 degrees and less than 60 degrees.

The water collection tank 14 may be designed as a V-shaped structure as shown in FIG. 43 when viewed from the first direction, such that the collected condensate water may flow out smoothly. In addition, the water collection tank 14 may be designed to tilt unilaterally along the third direction.

The above embodiments realize continuous natural refrigeration convection, which is a natural air supply mode. In the embodiments, a fan may be further arranged to realize active refrigeration, that is, a forced air supply mode. In practical applications, when the indoor temperature is required to be quickly cooled, the forced air supply mode may be adopted first, and when the indoor temperature drops to an acceptable range, the natural air supply mode may be switched to.

Figure 44:
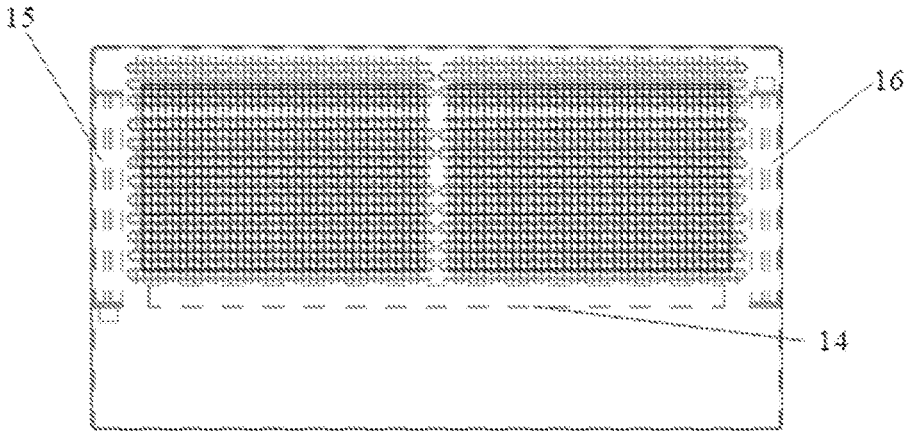
FIG. 44 is a structural schematic view of a fan applied in the air-conditioning indoor unit as shown in FIG. 36.

Referring to FIGS. 36 and 44, in the air-conditioning indoor unit 100 of these embodiments, the left side panel 135 and the right side panel 136 are arranged with a second air outlet region 1351/1361. A first fan 15 and the second fan 16 are respectively arranged near the left side panel 135 and the right side panel 136 to blow the cooling airflow in the accommodating cavity to the second air outlet region 1351/1361 of the left side panel 135 and the right side panel 136, respectively.

That is, fans are installed on the left and right side panels to form an enveloping forced air supply. The indoor return air is mainly sucked in from the first air inlet region 1311, cooled by the first heat exchanger 11 and then blown out by the second air outlet region 1351/1361 on both sides, forming a hug air supply method with air-in in the middle and air-out on both sides.

Figure 45:
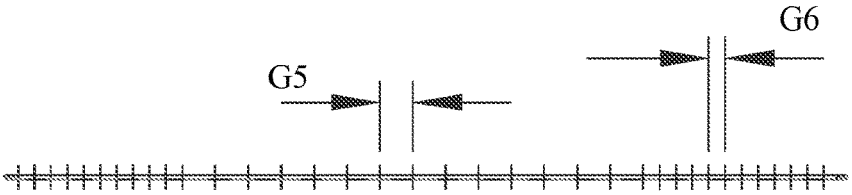
FIG. 45 is a structural top schematic view of a first heat exchanger in the air-conditioning indoor unit with the fan as shown in FIG. 34.

In this way, further, a heat exchanger near the fan region has a larger forced convection heat exchange area than a heat exchanger near other regions. Reference may be made to FIG. 45.

There is a first interval G5 between two adjacent first heat exchange fins 112 in a middle region where the first heat exchanger 11 is centrally arranged along the third direction Z. There is a second interval G6 between two adjacent first heat exchange fins 112 in regions on both sides of the first heat exchanger 11 along the third direction Z near the left side panel 135 and the right side panel 136. The first interval G5 is greater than the second interval G6.

The heat exchange fins with the first interval G5 are far away from the fan and are mainly configured for heat exchange for natural convection air. The first interval G5 is set to 1 mm-10 mm, and further set to 2 mm-8 mm. The heat exchange fins with the second interval G6 are close to the fan, and the heat exchange fins are denser to increase the heat exchange area of forced convection. Therefore, the ratio between the first interval G5 and the second interval G6 is greater than 1 and less than or equal to 2.5.

Among them, a dense fin region and a sparse fin region of the heat exchanger are not required to be arranged in one heat exchanger. It is only intended to describe the density of the fins in the heat exchanger region at different positions relative to the fan. Therefore, specifically, the dense and sparse fin regions may be all concentrated on the same heat exchanger. Alternatively, several heat exchangers with different fin intervals may be applied in combination.

Figure 46:
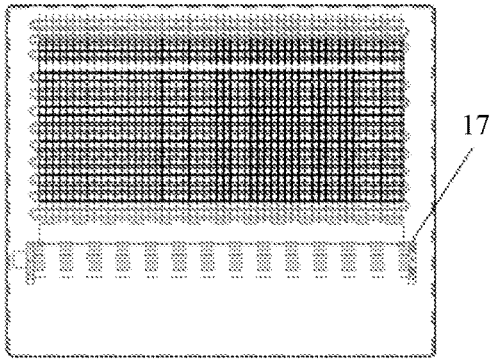
FIG. 46 is a structural top schematic view of a fan applied in the air-conditioning indoor unit as shown in FIG. 36.
Figure 47:
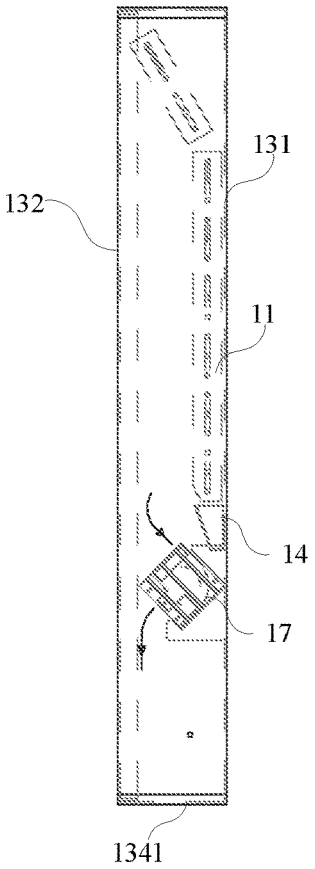
FIG. 47 is a structural side schematic view of a fan applied in the air-conditioning indoor unit as shown in FIG. 36.

For another arrangement method of the fan, referring to FIG. 46 and FIG. 47. A fan 17 may be arranged in the air-conditioning indoor unit 100. The fan 17 is arranged under the water collection tank 14. In order to achieve the best active air guiding effect, the fan 17 is arranged as close to the first heat exchanger 11 as possible. In addition, in order to make the rear natural convection smooth, the fan 17 is arranged as close to the front panel 131 as possible, and is inclined at a certain angle with respect to the front panel 131. The fan 17 has the air inlet direction and the air outlet direction as shown in FIG. 12. In the natural air supply mode, the cooling air flows from a region between the fan 17 and the rear panel 132. In the forced air supply mode, the cooling air is discharged from the first air outlet region 1341 via the fan 17.

In addition, the air-conditioning indoor unit of these embodiments may also be combined with a fresh air system to solve the problem of poor indoor air quality while increasing the cooling speed.

Figure 48:
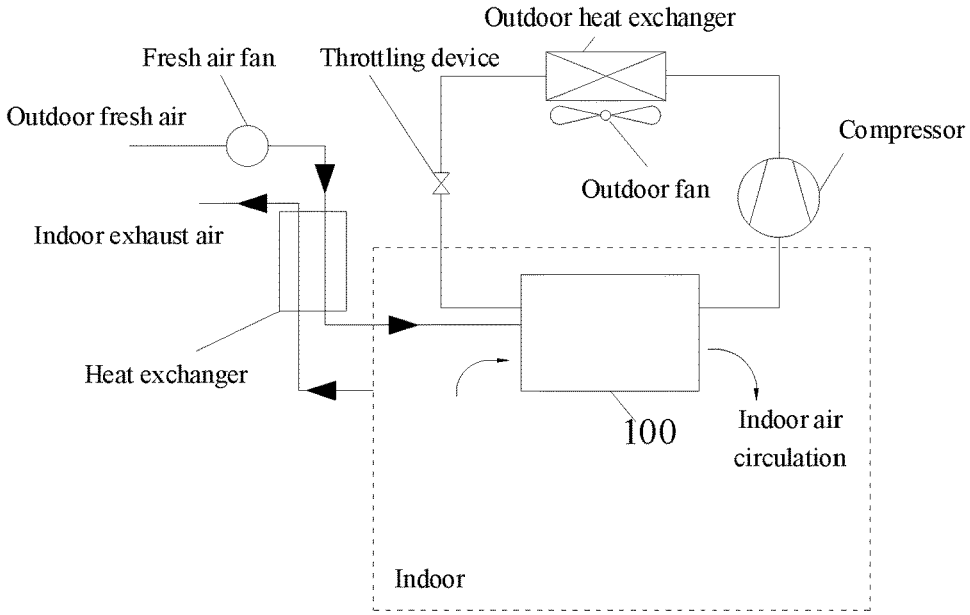
FIG. 48 is a schematic view of a principle of combining the air-conditioning indoor unit as shown in FIG. 36 with a fresh air system.

As shown in FIG. 48, the fresh air is introduced into the internal unit through the fresh air fan or by using an outdoor fan to isolate part of the air without passing through an outdoor heat exchanger. A heat exchanger may be arranged between the fresh air and the indoor exhaust air to exchange heat and even humidity, improving the utilization rate of refrigeration.

Figure 49:
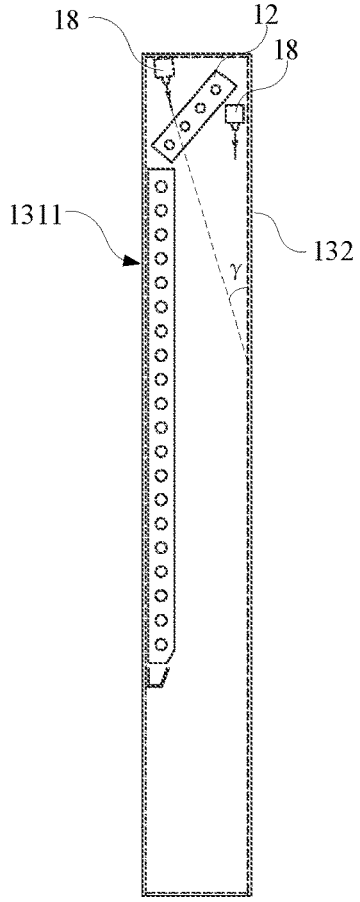
FIG. 49 is a structural side schematic view of a fresh air injection device arranged in the air-conditioning indoor unit as shown in FIG. 36.

The air-conditioning indoor unit 100 may include a fresh air injection device 18, which is arranged in the accommodating cavity and configured to inject outdoor fresh air into the accommodating cavity. The fresh air injection device 18 may be in the form of a nozzle or a slit, as shown in FIG. 49.

In order to reduce the influence of the fresh air injection device 18 on the natural inlet air, the fresh air injection device 18 may be arranged close to the second heat exchanger 12. The fresh air injection device 18 may be arranged on a side of the second heat exchanger 12 facing the lower side panel 134, and the injection direction of the fresh air injection device 18 is directed to the lower side panel 134 along the second direction.

The fresh air injection device 18 may also be arranged on a side of the second heat exchanger 12 away from the lower side panel 134, and the injection direction of the fresh air injection device 18 is directed to the rear panel 132. An included angle γ between the fresh air injection device 18 and the rear panel 132 is greater than or equal to 2 degrees and less than or equal to 20 degrees, thereby preventing a large number of jets directly colliding with the rear panel 132 and reflecting, which adversely affects air inlet of the first air inlet region 1311.

Figure 50:
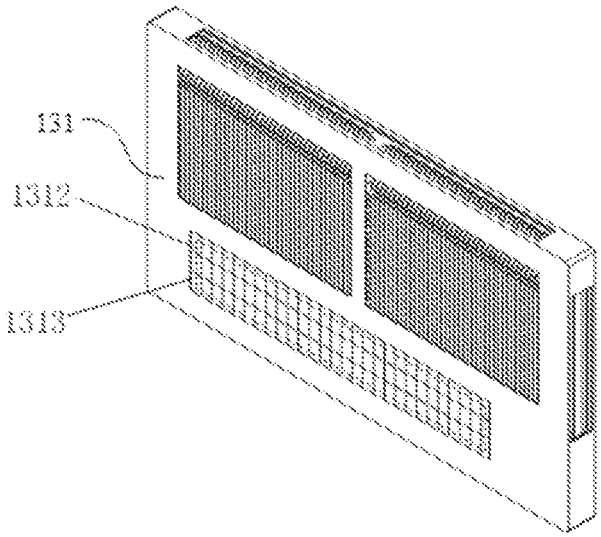
FIG. 50 is a structural side schematic view of a radiant heating panel arranged in the air-conditioning indoor unit as shown in FIG. 36.

In addition to the cooling function, the air-conditioning indoor unit 100 of these embodiments can also realize heating function, as shown in FIG. 50.

A radiant heating panel 1312 is arranged on the front panel 131. When heating is required, the indoor unit 100 may achieve the effect of radiant heating combined with the radiant heating panel 1312. Further, it may be combined with the fan installed in the indoor unit 100 to achieve the effect of forced convection co-heating.

The radiant heating panel 1312 may be arranged with electric heating wires or other heating elements for heating, and radiant heat is performed through the outer surface. In this case, the fan may be activated to blow hot air, such that both radiation and convection heating methods can be performed simultaneously. Considering that the temperature of the radiant surface may be too high, a protective net 1313 may be arranged on the outer surface of the radiant heating panel 1312 to prevent users from directly touching the high-temperature surface.

Figure 51:
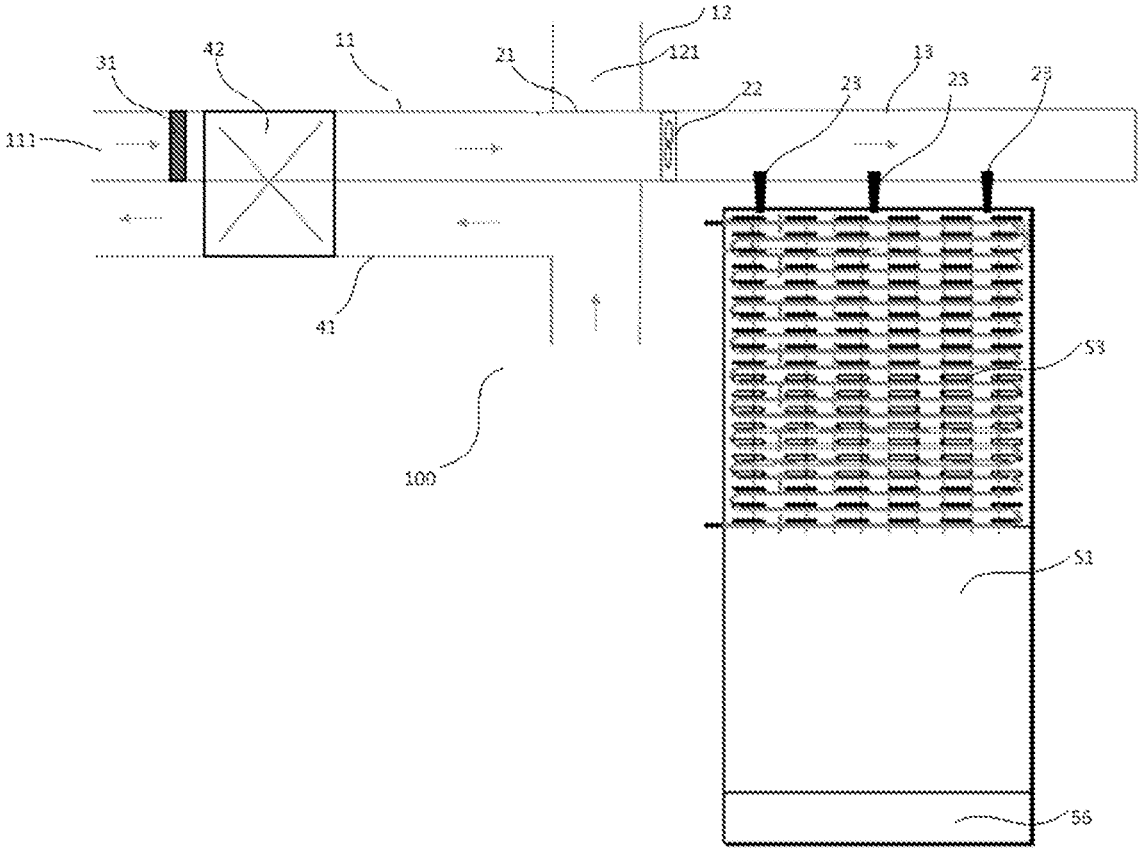
FIG. 51 is a structural schematic view of a fresh air system (in an outdoor circulation state) according to some embodiments of the present disclosure.
Figure 52:
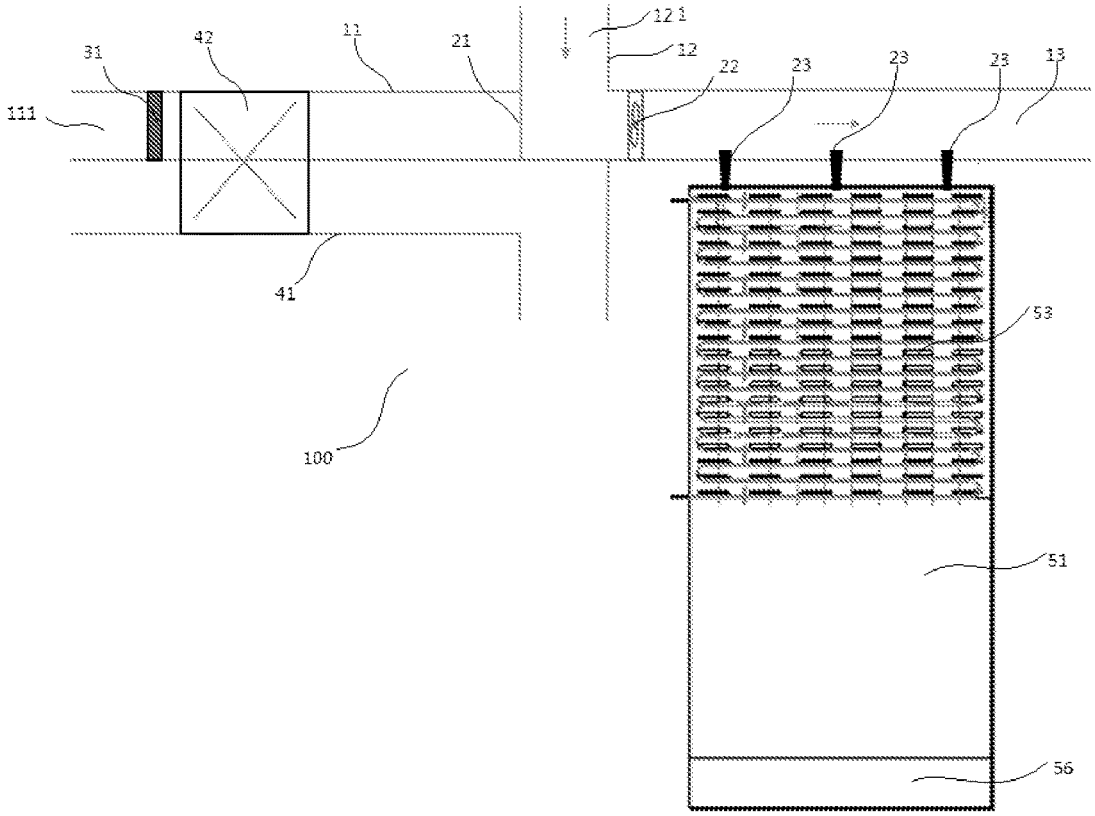
FIG. 52 is a structural schematic view of a fresh air system (in an outdoor circulation state) according to other embodiments of the present disclosure.
Figure 53:
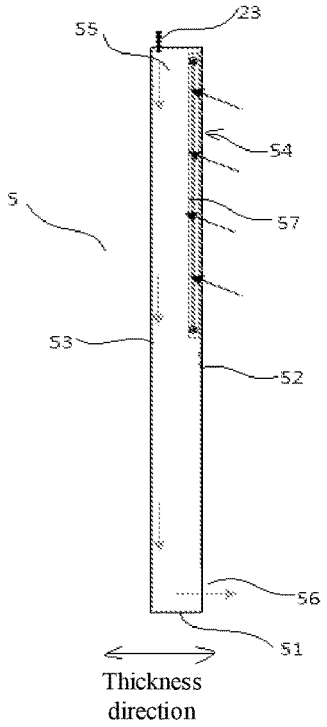
FIG. 53 is a structural schematic view of a heat exchanger of a fresh air system according to some embodiments of the present disclosure.

The following describes an air-conditioning indoor unit according to embodiments of the third aspect of the present disclosure with reference to the accompanying drawings FIGS. 51-53. A labeling system used in FIGS. 51-53 is as follows:

fresh air system 100, first tube section 11, first air entering port 111, second tube section 12, second air entering port 121, third tube section 13, switching valve 21, fan 22, nozzle 23, first filter device 31, exhaust tube 41, total heat exchanger 42, heat exchanger 5, housing 51, first wall surface 52, second wall surface 53, first air inlet 54, second air inlet 55, air outlet 56, heat exchange component 57.

As shown in FIGS. 51-53, the fresh air system 100 according to some embodiments of the present disclosure includes: an air inlet tube assembly and a heat exchanger 5.

As shown in FIGS. 51 and 52, the air inlet tube assembly includes an air inlet tube, a switching device, a fan 22 and a nozzle 23. The air inlet tube has a first air entering port 111 and a second air entering port 121. The first air entering port 111 is suitable for connection to the outdoors, and the second air entering port 121 is suitable for connection to the indoors. The switching device is configured to switch at least one of the first air entering port 111 and the second air entering port 121 to communicate with an inlet of the nozzle 23. The fan 22 is configured to induce air from at least one of the first air entering port 111 and the second air entering port 121 to enter the air inlet tube and flow toward the nozzle 23. The air may then gradually diffuse into the room through the nozzle 23.

Therefore, by adjusting the state of the switching device, at least one of the first air entering port 111 and the second air entering port 121 may be taken as an airflow inlet, such that different air inlet modes may be selected according to actual needs. For example, the first air entering port 111 may be connected with the inlet of the nozzle 23 by the action of the switching device, that is, the first air entering port 111 is individually configured as the air inlet. Alternatively, the second air entering port 121 may be connected with the inlet of the nozzle 23 by the action of the switching device, that is, the first second air entering port 121 individually configured as the air inlet. Of course, the first air entering port 111 and the second air entering port 121 may also be connected to the inlet of the nozzle 23, such that the first air entering port 111 and the second air entering port 121 are both configured as air inlets.

It can be understood that the first air entering port 111 is connected to the outdoors, and when the first air entering port 111 is connected to the nozzle 23 through the switching device, the air inlet tube assembly may introduce outdoor fresh air into the room. The second air entering port 121 is connected to the room, and when the second air entering port 121 is connected to the nozzle 23 through the switching device, the air inlet tube assembly may promote the air circulation in the room.

The fan 22 is arranged in the air inlet tube assembly and may push the air flow in the air inlet tube assembly to enhance the flow rate of the air flow and facilitate the exchange of refrigerant.

In a specific implementation, when the air condition in the room is required to be improved, the switching device connects the first air entering port 111 with the nozzle 23, and the fan 22 rotates. The outdoor fresh air flow enters the air inlet tube assembly from the first air entering port 111, gradually flows to the nozzle 23 driven by the fan 22, and gradually spreads to the indoor space through the nozzle 23, thereby introducing fresh and refreshing air flow into the indoor space, realizing fresh air circulation, and making the indoor environment more comfortable.

When the indoor air quality is good and there is no need to introduce fresh air, the switching device connects the second air entering port 121 to the nozzle 23, and the fan 22 rotates. The airflow in the room enters the air inlet tube assembly from the second air entering port 121 and gradually flows to the nozzle 23 driven by the fan 22 to realize the air circulation in the room.

Among them, in the fresh air circulation or indoor circulation, the fan 22 guides the airflow to the nozzle 23 and flows from the nozzle 23 to the heat exchanger 5 to exchange heat in the heat exchanger 5, thereby achieving cooling or heating. In this way, the circulating air flow temperature is more suitable for the temperature required in the user's environment.

As shown in FIG. 53, the heat exchanger 5 includes a housing 51 and a heat exchange component 57. A first air inlet 54 is defined on a side surface of the housing 51 in the thickness direction. For example, a surface of the right side of the housing 51 (right in FIG. 53) defines the first air inlet 54. A second air inlet 55 is defined at an end of the housing 51 in the first direction perpendicular to the thickness direction. For example, the upper end of the housing 51 (upper end in FIG. 53) defines the second air inlet 55, such that the air inlet direction of the first air inlet 54 is perpendicular to the air inlet direction of the second air inlet 55. Among them, the thickness direction of the housing 51 is the left-right direction as shown in FIG. 53.

As shown in FIG. 53, the housing 51 may further define an air outlet 56 on a side of the first air inlet 54 away from the second air inlet 55. As shown in FIG. 53, the second air inlet 55 and the air outlet 56 are respectively disposed on the upper and lower sides of the first air inlet 54. In this way, when the air flows from the second air inlet 55 to the air outlet 56, the flow path of the air flow is located in the air inlet direction of the first air inlet 54.

The heat exchange component 57 is arranged in the housing 51, and the heat exchange component 57 is opposite to the first air inlet 54 in the thickness direction, that is, the heat exchange component 57 is disposed in the air inlet direction of the first air inlet 54. The outlet of the nozzle 23 is connected to the second air inlet 55 and sprays air flow toward the air outlet 56.

In this way, during fresh air circulation or indoor circulation, the fan 22 pushes the airflow to the nozzle 23. The airflow flows from the nozzle 23 into the housing 51 through the second air inlet 55, and gradually flows toward the air outlet 56. When the airflow flows from the second air inlet 55 to the air outlet 56, the air pressure in the surrounding space in the direction of the airflow decreases. For example, the air pressure at the first air inlet 54 decreases, which makes the airflow at the first air inlet 54 gradually flows into the housing 51, is mixed with the airflow in the housing 51 from the second air inlet 55, and flows out from the air outlet 56 into the indoor space together. In this way, the lower air pressure at the first air inlet 54 may induce the airflow in the room, such that more indoor airflow may flow into the housing 51 from the first air inlet 54.

In this process, the airflow flowing in from the first air inlet 54 passes through the heat exchange component 57, such that the airflow flowing in from the first air inlet 54 may effectively exchange heat with the heat exchange component 57, and is remixed with the airflow flowing in from the second air inlet 55 after the heat exchange. Among them, the heat exchange function of the heat exchange component 57 may be flexibly adjusted according to the actual needs of the user. For example, when the indoor temperature is too low, the heat exchange component 57 may be set for heating, and when the indoor temperature is too high, the heat exchange component 57 may be set for heating. In this way, the temperature of the airflow from the air outlet 56 may more appropriately meet the needs of users.

Therefore, through the arrangement of the heat exchange component 57, the fresh air system 100 can not only improve the indoor air quality, but also enhance the heat exchange and increase the cooling/heating capacity during the fresh air circulation process; in the indoor circulation process, the indoor fan 22 is used for circulation, thereby improving cooling and heating speed, and improving user experience.

According to the fresh air system 100 of the embodiments of the present disclosure, the state of fresh air circulation or indoor circulation may be flexibly switched according to the actual use needs of users, so as to be suitable for different application environments. In the process of fresh air circulation, both indoor air quality can be improved and heat exchange can be strengthened to improve cooling/heating. In the process of indoor circulation, the indoor fan 22 is used for circulation to improve cooling and heating speed.

In some embodiments, the fresh air system 100 further includes: an exhaust tube 41 and a total heat exchanger 42.

As shown in FIGS. 51 and 52, the inlet end of the exhaust tube 41 is suitable for communicating with the room, the outlet end of the exhaust tube 41 is suitable for communicating with the outside, and the total heat exchanger 42 is configured to cause the exhaust tube 41 to exchange heat with the air inlet tube. In this way, the indoor airflow may be discharged to the outside through the outlet end of the exhaust tube 41. When the airflow is discharged, the airflow that can flow through the exhaust tube 41 may exchange heat with the airflow in the air inlet tube through the total heat exchanger 42.

In some embodiments, the total heat exchanger 42 includes a housing and a heat exchange core arranged in the housing. The housing has a first tuyere, a second tuyere, a third tuyere, and a fourth tuyere. The heat exchange core defines a first air channel connecting the first tuyere and the second tuyere, and a second air channel connecting the third tuyere and the fourth tuyere. The first air channel and the second air channel exchange heat through the heat exchange core. The first tuyere is communicated with the inlet end of the air inlet tube, the third tuyere is communicated with the outlet end of the exhaust tube, and the second air outlet and the fourth air outlet are both connected to the outside.

It should be noted that the structure of the heat exchange core is not limited. For example, in some specific embodiments, the heat exchange core may be formed by stacking multiple layers of heat exchange fins. The first air channel is defined between each heat exchanger and a heat exchanger on a side, and the second air channel is defined between each heat exchanger and another heat exchanger on another side. In this way, the fin-type heat exchange core may make the airflow in the first air channel and the airflow in the second air channel have a larger heat exchange area, improving the heat exchange efficiency, and improving the cooling or heating efficiency of the fresh air system 100.

In some embodiments, the switching device includes a switching valve 21 disposed upstream of the fan 22 and disposed downstream of the first air entering port 111 and the second air entering port 121. In this way, the switching valve 21 may simultaneously switch the air inlet states of the first air entering port 111 and the second air entering port 121 to realize the switching of the two circulation modes of the fresh air system 100. In addition, the airflow through the switching valve 21 may flow to the nozzle 23 under the action of the fan 22 for entering into the heat exchanger 5 for heat exchange.

In a specific implementation, a spool of the switching valve 21 may be set to have two working positions. When the spool is in a first working position, the switching valve 21 connects the first air entering port 111 with the nozzle 23, and the second air entering port 121 is not connected with the nozzle 23. In this case, the fresh air system 100 is in the fresh air circulation state. When the spool is in a second working position, the switching valve 21 connects the second air entering port 121 with the nozzle 23, and the first air entering port 111 is not connected to the nozzle 23. In this case, the fresh air system 100 is in the indoor circulation state. Therefore, the working mode of the fresh air system 100 may be flexibly switched by setting the switching valve 21. The structure is simple and the control of switching mode is easy to operate.

In some embodiments, the switching device includes a first on-off valve and a second on-off valve. The first on-off valve is arranged at the first air entering port 111, and the first on-off valve is configured to control the opening and closing of the first air entering port 111. The second on-off valve is arranged at the second air entering port 121, and the second on-off valve is configured to control the opening and closing of the second air entering port 121. In this way, the communication state of the first air entering port 111, the second air entering port 121 and the nozzle 23 may be controlled respectively through the first on-off valve and the second on-off valve, which is conducive to reduce the difficulty of arrangement and installation.

In this way, when the first on-off valve connects the first air entering port 111 with the nozzle 23, and the second on-off valve disconnects the second air entering port 121 from the nozzle 23, the fresh air system 100 is in the fresh air circulation state. When the second on-off valve connects the second air entering port 121 with the nozzle 23, and the first on-off valve disconnects the first air entering port 111 from the nozzle 23, the fresh air system 100 is in the indoor circulation state, In this way, the first air entering port 111 and the second air entering port 121 are controlled separately. For example, by switching the state of the first on-off valve and the second on-off valve, the fresh air system 100 can be switched between the fresh air circulation mode and the indoor circulation mode, and it is also possible to open both the first air entering port 111 and the second air entering port 121, or to close both the first air entering port 111 and the second air entering port 121, such that the opening and closing state of the first air entering port 111 and that of the second air entering port 121 do not interfere with each other, and the flexibility is better.

In some embodiments, the fresh air system 100 further includes: at least one of a first filter device 31 and a second filter device. As shown in FIGS. 51 and 52, the first filter device 31 is arranged at the first air entering port 111, such that the first filter device 31 may filter the outdoor airflow entering the first air entering port 111, thereby preventing the entry of external debris and ensuring the cleanliness of airflow into the room. The second filter device is arranged at the second air entering port 121, such that the second filter device may filter the air circulating indoors, thereby reducing the amount of dust in the indoor space and improving air quality.

In some embodiments, as shown in FIGS. 51 and 52, the air inlet tube includes a first tube section 11, a second tube section 12 and a third tube section 13.

As shown in FIG. 51, the inlet end of the first tube section 11 is formed as the first air entering port 111, the inlet end of the second tube section 12 is formed as the second air entering port 121, and the inlet end of the third tube section 13 communicates with the outlet end of the first tube section 11 and the outlet end of the second tube section 12 respectively. The inlet of the nozzle 23 communicates with the third tube section 13.

In this way, the outdoor airflow is suitable for entering the air inlet tube assembly from the first tube section 11 and flowing to the third tube section 13, and the indoor airflow is suitable for entering the air inlet tube assembly from the second tube section 12 and flowing to the third tube section. 13. In this way, the outdoor airflow and the indoor airflow may enter the air inlet tube assembly from different tubes, and when flowing in the air inlet tube assembly, the indoor airflow and the outdoor airflow may share the third tube section 13 and be discharged from the air inlet assembly into the indoor space in the same path and manner. In this way, the third tube section 13, the nozzle 23, and the heat exchanger 5 are shared in the two circulation modes, reducing the cost of separately setting up the third tube, reducing the number of parts, and reducing the setup cost of the fresh air system 100.

In some embodiments, the air inlet tube includes a third tube section 13, and the inlet of the nozzle 23 is in communication with the third tube section 13. The number of the nozzles 23 is multiple, and the multiple nozzles 23 are arranged at intervals along the axial direction of the third tube section 13. In this way, both outdoor airflow and indoor airflow may flow into the third tube section 13 and may flow to the heat exchanger 5 through the multiple nozzles 23 in the third tube section 13 at the same time, increasing the airflow. In addition, the multiple nozzles 23 spaced along the axial direction of the third tube section 13 may make full use of the internal space of the third tube section 13 and improve space utilization.

The cross-sectional area of an inner cavity of the nozzle 23 gradually decreases along the direction from the inlet of the nozzle 23 to the outlet of the nozzle 23. That is, the inner cavity of the nozzle 23 shrinks in the direction from the inlet of the nozzle 23 to the outlet of the nozzle 23 as a whole. Therefore, after the airflow in the third tube passes through the nozzle 23, the airflow concentration is higher, which in turn makes the airflow flowing from the nozzle 23 into the second air inlet 55 faster, and enhances the induction effect of the airflow at the first air inlet 54, causing more indoor airflow from the first air inlet 54 to enter the housing 51 to mix with the airflow from the second air inlet 55, thereby increasing the cooling or heating speed.

As shown in FIG. 53, the housing 51 includes a first wall surface 52 and a second wall surface 53 that are opposed to each other in the thickness direction. That is, the first wall surface 52 and the second wall surface 53 are directly opposite to each other in the left-right direction in FIG. 53. The first air inlet 54 is defined on the first wall surface 52, and the distance L1 between the heat exchange component 57 and the first wall surface 52 is less than the distance L2 between the heat exchange component 57 and the second wall surface 53. That is, the heat exchange component 57 is arranged in the housing 51 close to the first wall surface 52, and a ventilation channel is defined between the heat exchange component 57 and the second wall surface 53. The outlet of the nozzle 23 is arranged opposite to the ventilation channel.

In this way, after the airflow flowing in from the nozzle 23 enters the ventilation channel, it flows along a side of the heat exchange component 57 toward the second wall surface 53. During the flow, the air pressure at both the heat exchange component 57 and the first air inlet 54 is reduced. Currently, the airflow at the first air inlet 54 flows toward the heat exchange component 57 under the action of the pressure difference, such that the heat exchange component 57 performs heat exchange, and the airflow after the heat exchange enters the ventilation channel and merges with the airflow from the nozzle 23, thereby enhancing the heat exchange effect on the airflow. The structural design of the housing 51 is simple and reasonable, which is conducive to realizing the induction effect of indoor air and improving the cooling or heating efficiency. Among them, the heat exchange component 57 may be a heat exchange fin.

The present disclosure also proposes a refrigerant circulation system.

The refrigerant circulation system according to some embodiments of the present disclosure includes a compressor and the fresh air system 100 of any of the above embodiments. The compressor is disposed outside the housing 51 and is communicated with the heat exchange component 57. By selecting the working state of the compressor, the heat exchange component 57 may be caused to cool or heat the induced air at the first air inlet 54, and the fresh air system 100 may flexibly switch the state of fresh air circulation or indoor circulation according to the actual needs of the user, suitable for different application environments. In the process of fresh air circulation, it can not only improve indoor air quality, but also strengthen heat exchange, and increase cooling/heating. In the indoor circulation process, the indoor fan 22 is used to circulate to improve cooling and heating speed.

Hereinafter, a heat exchanger in an air-conditioning indoor unit according to embodiments of the present disclosure will be described with reference to the accompanying drawings FIGS. 54-61. A labeling system used in FIGS. 54-61 is as follows:

heat exchanger 100 heat exchange tubeline 11(21)

heat exchange fin group 12 (22), first heat exchange fin 121 (221), second heat exchange fin 122 (222)

first heat exchange region 13 (23), second heat exchange region 14 (24), first air inlet region 15 (25), second air inlet region 16 (26)

air-conditioning indoor unit 300 housing 31, front panel 311, rear panel 312, upper side panel 313, lower side panel 314, air inlet region 315, air outlet region 316, heat exchanger 32, first heat exchange region 321, second heat exchange region 322 water collection tank 33

The heat exchanger in FIGS. 54-60 may be applied with the first heat exchanger in FIGS. 36-50 and may also be applied with the first heat exchange component in FIGS. 1-33.

Figure 54:
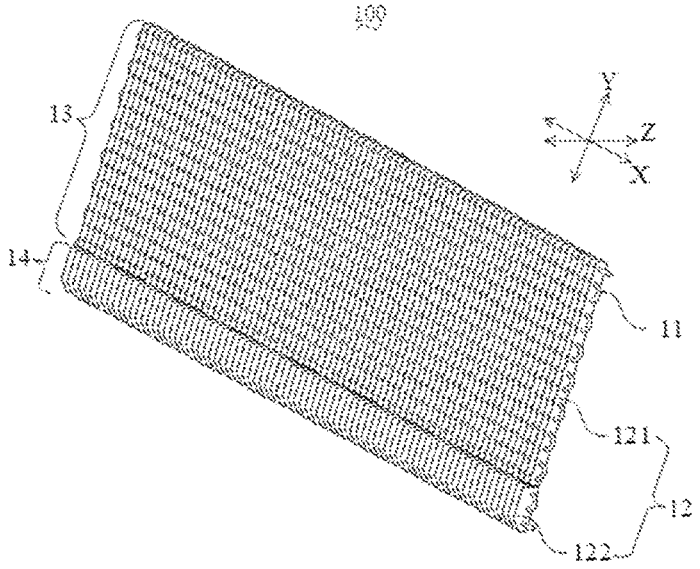
FIG. 54 is a structural schematic view of a heat exchanger for an air-conditioning indoor unit according to some embodiments of the present disclosure.
Figure 56:
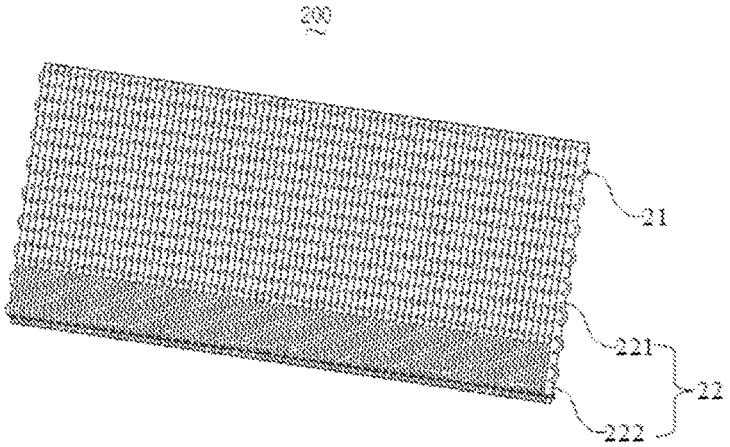
FIG. 56 is a structural schematic view of a heat exchanger for an air-conditioning indoor unit according to other embodiments of the present disclosure.

The heat exchanger of the present disclosure is applied to air-conditioning indoor units with different air volumes at different positions, that is, the heat exchanger has different heat exchange capabilities for different positions. The heat exchanger of the present disclosure is composed of a plurality of heat exchange tubelines and heat exchange fin groups. The heat exchange fin groups are sleeved on the heat exchange tubelines. The heat exchange fin group is divided into a first heat exchange region and a second heat exchange region. The first heat exchange region is arranged with a plurality of first heat exchange fins, and the second heat exchange region is arranged with a plurality of second heat exchange fins. The first heat exchange fins and the second heat exchange fins are arranged such that the heat exchange capacity of the second heat exchange region is greater than the heat exchange capacity of the first heat exchange region. That is, for the same area of the air inlet region, the total surface area formed by the multiple second heat exchange fins is larger than the total surface area formed by the multiple first heat exchange fins. Specifically, two embodiments in FIG. 54 and FIG. 56 are taken as examples for description. The specific arrangement of the first heat exchange fins and the second heat exchange fins is not limited to the two ways of FIG. 54 and FIG. 56, and other conceivable structural designs satisfying the foregoing principles are within the scope described in the present disclosure.

Figure 55:
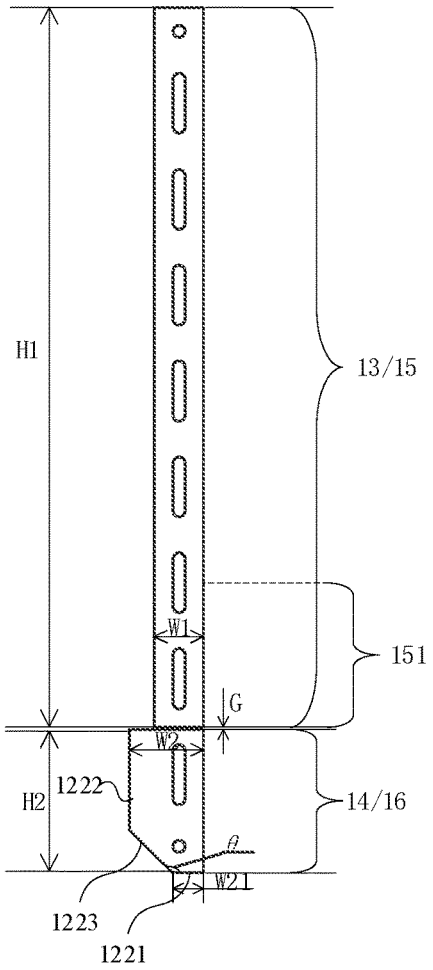
FIG. 55 is a structural side schematic view of the heat exchanger as shown in FIG. 54.

Referring to FIG. 54 and FIG. 55, the heat exchanger 100 of these embodiments includes a plurality of heat exchange tubelines 11 and heat exchange fin groups 12.

The plurality of heat exchange tubelines 11 are arranged side by side and spaced apart from each other along a first interval direction Y. Two adjacent heat exchange tubelines 11 are connected to each other, and the whole is arranged in an S-shape. The heat exchange tubelines 11 specifically are adopted with copper tubes, because copper has higher heat exchange efficiency. The diameter of the copper tubes is 3 mm-10 mm, and specifically may be 3 mm, 5 mm, 7 mm, 10 mm, etc.

The heat exchange fin groups 12 are divided into a first heat exchange region 13 and a second heat exchange region 14 along the first interval direction Y. A plurality of first heat exchange fins 121 are arranged in the first heat exchange region 13, and a plurality of second heat exchange fins 122 are arranged in the second heat exchange region 14. The design of the first heat exchange fins 121 and second hear exchange fins 122 makes the heat exchange capacity of the second heat exchange region 14 greater than that of the first heat exchange region 13. Therefore, it is suitable for air-conditioning indoor units with different air volumes in different positions.

Specifically, in these embodiments, the plurality of first heat exchange fins 121 are arranged at intervals along a second interval direction X and are sleeved in the heat exchange tubelines 11 in the first heat exchange region 13. The second interval direction X crosses the first interval direction Y. The plurality of second heat exchange fins 122 are arranged at intervals along the second interval direction X and are sleeved in the heat exchange tubelines 11 in the second heat exchange region 14. Further, the first interval direction Y and the second interval direction X are perpendicular to each other.

The first heat exchange region 13 is defined by the edges of the plurality of first heat exchange fins 121, and the second heat exchange region 14 is defined by the edges of the plurality of second heat exchange fins 122. The shape formed by the edge is the shape of the heat exchange region.

For a square air inlet region, the entire heat exchange fin groups 12 in these embodiments are also in a square shape. The upper edge of the first heat exchange fins 121 and the lower edge of the second heat exchange fins 122 are arranged flush. For other shapes of the air inlet region, the heat exchange fin groups 12 of corresponding shapes may be arranged. To facilitate production, the multiple first heat exchange fins 121 all adopt the same design, and the multiple second heat exchange fins 122 also adopt the same design. That is, the lower edge of the first heat exchange fins 121 and the upper edge of the second heat exchange fins 122 are also arranged flush.

In these embodiments, the first heat exchange region 13 corresponds to the first air inlet region 15, and the second heat exchange region 14 corresponds to the second air inlet region 16. For the same area of the inlet region. For example, for the same area of the second inlet area 16 and a partial region 151 of the first air inlet region 15, the total surface area of the second heat exchange fins 122 is correspondingly larger than the total surface area of the first heat exchange fins 121.

Specifically, the first heat exchange fins 121 have a first width W1 along the vertical direction Z of the first interval direction Y and the second interval direction X, and the second heat exchange fins 122 have a second width W2 along the vertical direction Z. The second width W2 is greater than the first width W1.

Since the plurality of first heat exchange fins 121 may have different designs, and the plurality of second heat exchange fins 122 may also have different designs, the above-mentioned first width W1 may be an average first width, and the second width W2 may be an average second width. When the second width W2 is too large, a certain resistance to the wind flow may occur. Therefore, in these embodiments, the second width W2 is 5%-70% greater than the first width W1.

These embodiments are specifically applied to an indoor unit that achieves cooling by natural convection. The cold air sinks from the first heat exchange region 13 to the second heat exchange region 14. Therefore, a larger air volume will be formed in the second heat exchange region 14, which requires that the heat exchange capacity of the second heat exchange region 14 is relatively high. The lower 5%-40% of the entire heat exchange region will have an increase in air volume, therefore, the first heat exchange region 13 and the second heat exchange region 14 are correspondingly designed.

The first heat exchange region 13 has a first height H1 in the first interval direction Y, and the second heat exchange region 14 has a second height H2 in the first interval direction Y. The second height H2 occupies 5%-40% of a sum of the first height H1 and the second height H2. That is, H2=(5%-40%)×(H1+H2). When the first heat exchange region 13 and the second heat exchange region 14 have multiple heights, a corresponding average height shall prevail.

In addition, in these embodiments, the first heat exchange region 13 and the second heat exchange region 14 are arranged at intervals, and a separation distance G between the two heat exchange regions is less than or equal to 5 mm. The edges of the plurality of first heat exchange fins 121 constitute the edges of the first heat exchange region 13. The edges of the plurality of second heat exchange fins 122 constitute the edges of the second heat exchange region 14. The distance between the lower edge of the first heat exchange regions 13 and the upper edge of the second heat exchange region 14 is the separation distance. Further, when the distance between the lower edge of the first heat exchange region 13 and the upper edge of the second heat exchange region 14 is not unique, then an average distance thereof is the separation distance.

Further, in heat exchange applications, when the first heat exchange region 13 and the second heat exchange region 14 are vertically arranged from top to bottom, the condensed water on the heat exchange fins will drip from the second heat exchange fins 122. Therefore, in the indoor unit, a water collection tank may be arranged under the second heat exchange fins 122. In some embodiments, the width of the water collection tank may be required to be greater than the width of the bottom edge 1221 of the second heat exchange fins 122. A too wide water collection tank will affect the discharge flow rate of the sunk cold air. Therefore, in these embodiments, the width of the bottom edge 1221 of the second heat exchange fins 122 is reduced.

A beveled edge 1223 may be arranged between the bottom edge 1221 of the second heat exchange fins 122 away from the first heat exchange fins 121 and the side edge 1222 along the first interval direction Y to form a guiding angle. The condensed water flows from the guiding angle to the bottom edge 1221 and finally drips into the water collection tank. An angle β of the guiding angle is set to 95°-175°. In these embodiments, the width W21 of the bottom edge 1221 of the second heat exchange fins 122 is 2 mm-45 mm.

The width W2 of the first heat exchange fins 121 is 5 mm-50 mm, and the thickness T1 along the X direction is 0.01 mm-0.5 mm. The thickness T2 of the second heat exchange fins 122 along the X direction may also be 0.01 mm-0.5 mm. To ensure the heat exchange efficiency and prevent the heat exchanger from obstructing the air in the direction of wind flow, the distance between two adjacent first heat exchange fins 121 may be 1 mm-10 mm, and the distance between two adjacent second heat exchange fins 122 may also be set to 1 mm-10 mm.

In these embodiments, the width of the second heat exchange fins is increased to increase the heat exchange capacity of the second heat exchange region. In some embodiments shown in FIG. 56, another method is applied to increase the heat exchange capacity of the second heat exchange region.

Figure 57:
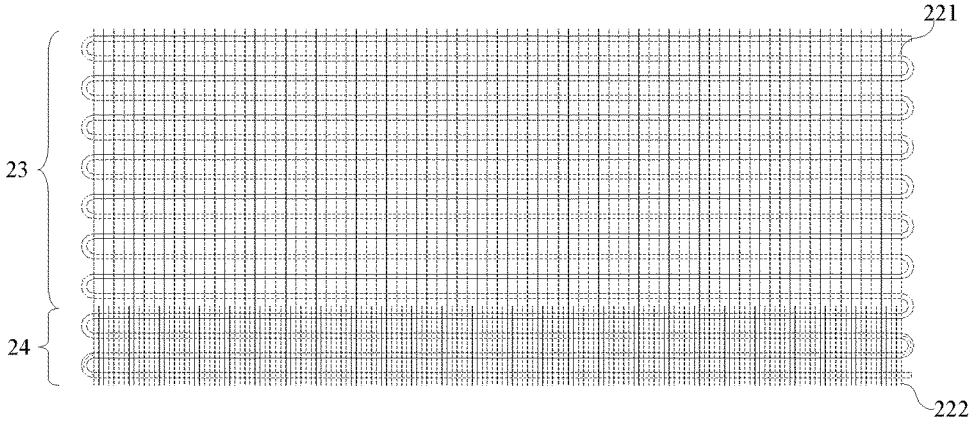
FIG. 57 is a structural front schematic view of the heat exchanger as shown in FIG. 56.
Figure 58:
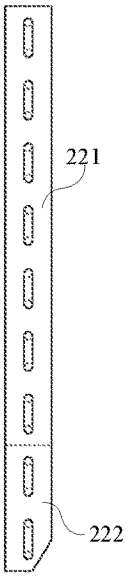
FIG. 58 is a structural side schematic view of the heat exchanger as shown in FIG. 56.

Referring to FIGS. 56-58, the heat exchanger 200 also includes a plurality of heat exchange tubelines 21 and heat exchange fin groups 22. The arrangement of the heat exchange tubelines 21 and the heat exchange fin groups 22 is similar to that of the heat exchanger 100 in the above-mentioned embodiments, and same parts will not be repeated.

The difference between the two designs is that different ways are adopted such that the heat exchange capacity of the second heat exchange region 24 is greater than the heat exchange capacity of the first heat exchange region 23.

The method adopted in these embodiments is that the widths of the first heat exchange fins 221 and the second heat exchange fins 222 in the vertical direction Z are the same, and the average setting density of the second heat exchange fins 222 is greater than that of the first heat exchange fins 221. Therefore, it can be realized that for the same area of the air inlet region, the total surface area formed by the plurality of second heat exchange fins 222 is greater than the total surface area formed by the plurality of first heat exchange fins 221. That is, it is realized that the heat exchange capacity of the second heat exchange region 24 is greater than the heat exchange capacity of the first heat exchange region 23.

In these embodiments, a part of the second heat exchange fins 222 and the first heat exchange fins 221 are integrally arranged, which is more conducive to reducing air flow resistance. Since the average setting density of the second heat exchange fins 222 is greater than that of the first heat exchange fins 221, the second heat exchange fins 222 may be staggered from the first heat exchange fins 221. In some applications, when the cold air sinks from the first heat exchange region 23 to the second heat exchange region 24, the staggered second heat exchange fins 222 will affect the flow of cold air. Therefore, it is preferable that the first heat exchange fins 221 and the second heat exchange fins 222 are integrally arranged to reduce air flow resistance.

Specifically, between two adjacent second heat exchange fins 222 integrated with the first heat exchange fins 221, at least one second heat exchange fin 222 that is not integrated with the first heat exchange fin 221 is included. In these embodiments, there is no interval between the first heat exchange region 23 and the second heat exchange region 24.

Similar to the heat exchanger 100 of the above-mentioned embodiments, the distance between two adjacent first heat exchange fins 221 and the distance between two adjacent second heat exchange fins 222 are both 1 mm-10 mm. The bottom of the second heat exchange fin 222 is designed with a guiding angle. The thickness of the first heat exchange fins 221 and the thickness of the second heat exchange fin 222 are both designed to be 0.01 mm-0.5 mm, and the widths are designed to be 5 mm-50 mm. The height of the second heat exchange region 24 accounts for 5%-40% of the sum of the heights of the first heat exchange region 23 and the second heat exchange region 24. Similar features will not be repeated in detail.

In these embodiments, the average setting density of the second heat exchange fins is designed to be greater than the average setting density of the first heat exchange fins, such that the heat exchange capacity of the second heat exchange region is greater than the heat exchange capacity of the first heat exchange region.

Figure 59:
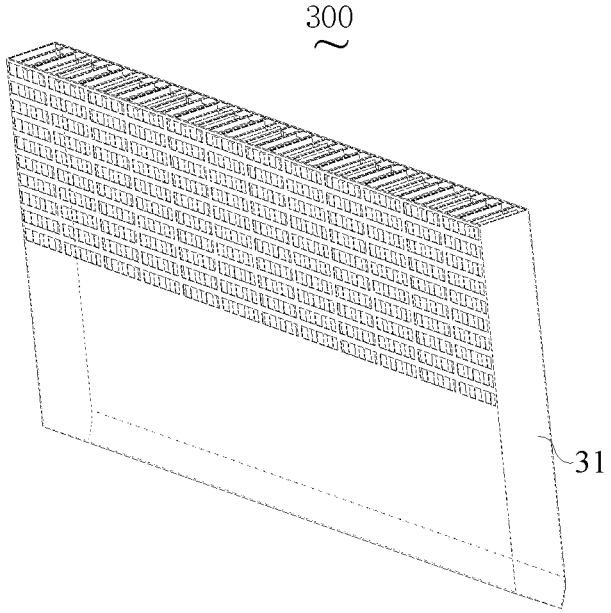
FIG. 59 is a structural schematic view of an air-conditioning indoor unit according to other embodiments of the present disclosure.
Figure 60:
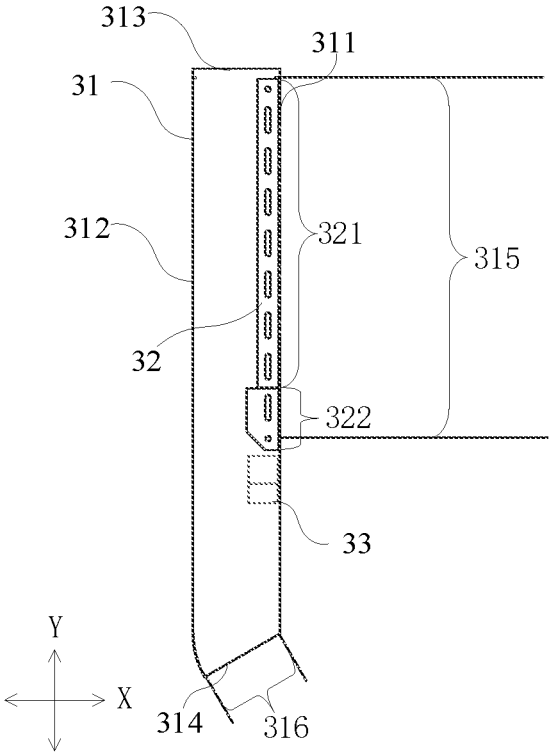
FIG. 60 is a structural schematic view of an air-conditioning indoor unit applied with the heat exchanger as shown in FIG. 54.
Figure 61:
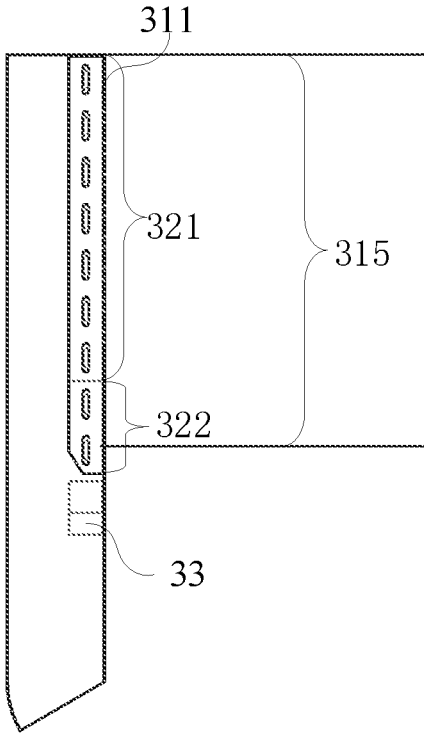
FIG. 61 is a structural schematic view of an air-conditioning indoor unit applied with the heat exchanger as shown in FIG. 56.

The heat exchanger of the present disclosure may be applied to an air-conditioning indoor unit. Referring to FIG. 59, the air-conditioning indoor unit 300 includes a housing 31 and a heat exchanger 32. In the heat exchanger 32, the heat exchange capacity of the second heat exchange region 322 is greater than the heat exchange capacity of the first heat exchange region 321. Specifically, the heat exchanger 32 may be the heat exchanger 100 or 200 described above, referring to FIGS. 60 and 61.

The housing 31 includes a front panel 311 and a rear panel 312 oppositely arranged along the first direction X, and an upper side panel 313 and a lower side panel 314 oppositely arranged along the second direction Y. The front panel 311 is arranged with an air inlet region 315, and the lower side panel 314 is arranged with an air outlet region 316.

The heat exchanger 32 is arranged between the front panel 311 and the rear panel 312, the distance from the front panel 311 is 0.5 mm-5 mm, and the distance from the upper side panel 313 is also 0.5 mm-5 mm to ensure the thickness of the air channel for cold air flow and facilitate the deposition of cold air.

The first heat exchange region 321 and the air inlet region 315 are arranged directly opposite, and a part of the second heat exchange region 322 is disposed between the lower edge of the air inlet region 315 and the lower side panel 314. In these embodiments, the indoor unit 300 uses natural convection to cool down. The air enters from the air inlet region 315, passes through the heat exchanger 32 to achieve condensation to form cold air, and the cold air sinks and is discharged from the air outlet region 316. Since the cold air is discharged from the air outlet region 316 of the lower side panel 314, there will be a larger amount of air inlet in the lower region of the air inlet region 315 close to the lower side panel 314. In some embodiments, the lower region of the air inlet region 315 may be required to correspond to a heat exchange region with higher heat exchange capacity, e.g., the second heat exchange region 322. In addition, to ensure that the air entering the air inlet region 315 is all heat exchanged, a part of the second heat exchange region 322 is disposed between the lower edge of the air inlet region 315 and the lower side panel 314.

A water collection tank 33 may be arranged under the heat exchanger 32. The width of the water collection tank 33 is slightly greater than the width of the bottom edge of the heat exchange fins to realize the collection of condensed water.

The air-conditioning indoor unit 300 of these embodiments can realize balanced heat exchange, preventing the problem of excessive heat exchange capacity or insufficient heat exchange capacity in some regions.

In the description of the present disclosure, it should be understood that the orientation or positional relationship indicated by terms "center", "length", "width", "thickness", "upper", "lower", "front", "rear", "left", "right", "vertical", "horizontal", "top", "bottom", "inner", "outer", "axial", etc. are based on the orientation or positional relationship shown in the drawings It is only for the convenience of describing the present disclosure and simplifying the description, and does not indicate or imply that the device or element referred to must have a specific orientation, be constructed and operated in a specific orientation, and therefore cannot be understood as a limitation of the present disclosure.

In addition, terms "first" and "second" are only intended for descriptive purposes, and cannot be understood as indicating or implying relative importance or implicitly indicating the number of indicated technical features. Thus, the features defined with "first" and "second" may explicitly or implicitly include one or more of these features. In the description of the present disclosure, "plurality" means two or more than two, unless otherwise specifically defined.

In the present disclosure, unless otherwise clearly specified and limited, terms "install", "connect", "couple", "fix", etc. should be understood in a broad sense, for example, it can be a fixed connection, a removable connection, or in one piece; a mechanical connection, an electrical connection, or a communication; a direct connection or an indirect connection through an intermediate medium, a connection within two elements or an interactive relationship between two elements. To those skilled in the art, the specific meaning of the above terms in the present disclosure can be understood on a case-by-case basis.

In the present disclosure, unless expressly stipulated and defined otherwise, the first feature "on" or "under" the second feature may be that the first and second features are in direct contact with, or the first and second features may be in indirect contact through an intermediate medium. Moreover, the first feature "on", "above" and "on the top of" the second feature may mean that the first feature is directly above or inclinedly above the second feature, or simply means that the level of the first feature is higher than the second feature. The first feature "under", "below" and "below" the second feature may mean that the first feature is directly under or diagonally under the second feature, or it simply means that the level of the first feature is lower than the second feature.

In the description of this specification, descriptions with reference to the terms "an embodiment", "some embodiments", "examples", "specific examples", or "some examples" etc. mean specific features, structures, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics can be combined in any one or more embodiments or examples in a suitable manner. In addition, those skilled in the art can combine the different embodiments or examples and the features of the different embodiments or examples described in this specification without contradicting each other.

Although the embodiments of the present disclosure have been shown and described, those skilled in the art can understand that various changes, modifications, substitutions and modifications can be made to these embodiments without departing from the principle and purpose of the present disclosure. The scope of the present disclosure is defined by the claims and their equivalents.

What is claimed is:

1. An air-conditioning indoor unit, comprising:

a housing, comprising a front panel and a rear panel oppositely arranged along a first direction, and comprising an upper side panel and a lower side panel oppositely arranged along a second direction; wherein the first direction is perpendicular to the second direction; the housing defines an accommodating cavity; the front panel is arranged with a first air inlet region, the upper side panel is arranged with a second air inlet region, and the lower side panel is arranged with a first air outlet region;

a first heat exchanger, arranged in the accommodating cavity; wherein a projection of the first air inlet region along the first direction at least partly falls on the first heat exchanger; the first heat exchanger and the rear panel are spaced apart along the first direction, and a space between the first heat exchanger and the rear panel defines a settlement enhancement region; and a second heat exchanger, arranged in the accommodating cavity; wherein a projection of the second air inlet region along the second direction at least partly falls on the second heat exchanger; the projection of the second heat exchanger along the second direction at least partially falls into the settlement enhancement region, wherein a ratio between a thickness of the first heat exchanger along the first direction and a distance between the front panel and the rear panel in the first direction is 0.06-0.5; a ratio between the thickness of the first heat exchanger along the first direction and a distance between the first heat exchanger and the rear panel in the first direction is 0.068-1.

2. The air-conditioning indoor unit according to claim 1, wherein the second heat exchanger is arranged inclinedly, along a direction from the rear panel to the front panel, toward the lower side panel; the projection of the second heat exchanger along the second direction at least partially falls on the first heat exchanger.

3. The air-conditioning indoor unit according to claim 2, wherein the first heat exchanger comprises a plurality of first heat exchange tubes arranged at intervals along a first reference plane; an included angle between the first reference plane and the second direction is greater than or equal to 0 degrees and less than or equal to 5 degrees.

4. The air-conditioning indoor unit according to claim 3, wherein the second heat exchanger comprises a plurality of second heat exchange tubelines arranged at intervals along a second reference plane; an included angle between the first reference plane and the second reference plane is greater than 0 degrees and less than or equal to 30 degrees.

5. The air-conditioning indoor unit according to claim 3, wherein a space defined by an orthographic projection of the first reference plane on the front panel along the first direction is smaller than a space defined by an orthographic projection of the first reference plane on the rear panel along the first direction.

6. The air-conditioning indoor unit according to claim 1, wherein the housing further comprises a left side panel and a right side panel oppositely arranged along a third direction; the first direction, the second direction, and the third direction are perpendicular to each other; the first heat exchanger comprises a plurality of first heat exchange fins arranged at intervals along the third direction.

7. The air-conditioning indoor unit according to claim 6, further comprising a water collection tank; wherein the water collection tank is arranged on a side of the first heat exchange fins toward the lower side panel; a beveled edge is arranged between a side edge of the first heat exchange fins toward the rear panel and a bottom edge of the first heat exchange fins toward the lower side panel; the beveled edge is inclined, along a direction from the upper side panel to the lower side panel, toward the front panel; a width of the bottom edge of the first heat exchange fins in the first direction is less than or equal to a width of an opening of the water collection tank in the first direction.

8. The air-conditioning indoor unit according to claim 6, wherein a left second air outlet region is arranged on the left side panel and a right second air outlet is arrange on the right side panel; the air-conditioning indoor unit further comprises a first fan and a second fan arranged in the accommodating cavity; the first fan is arranged near the left side panel to blow a cooling airflow in the accommodating cavity to the left second air outlet region of the left side panel, and the second fan is arranged near the right side panel to blow the cooling airflow in the accommodating cavity to the right second air outlet region of the right side panel.

9. The air-conditioning indoor unit according to claim 6, wherein a plurality of first heat exchange tubelines are integrated in the plurality of first heat exchange fins; the plurality of first heat exchange fins have a first thickness in a region on which the plurality of first heat exchange tubelines are disposed, and the plurality of first heat exchange fins have a second thickness in another region outside the plurality of first heat exchange tubelines; a ratio of the first thickness to the second thickness is greater than or equal to 1.1 and less than or equal to 2.5; a ratio of a distance between adjacent two of the plurality of first heat exchange fins to the second thickness is greater than or equal to 2 and less than or equal to 20.

10. The air-conditioning indoor unit according to claim 6, wherein the second heat exchanger comprises a plurality of second heat exchange fins arranged at intervals along the third direction; a fin-width of the plurality of second heat exchange fins is greater than a fin-width of the plurality of first heat exchange fins.

11. The air-conditioning indoor unit according to claim 1, further comprising a fresh air injection device arranged in the accommodating cavity and configured to inject outdoor fresh air into the accommodating cavity.

12. The air-conditioning indoor unit according to claim 11, wherein the fresh air injection device is arranged on a side of the second heat exchanger away from the lower side panel, the injection direction of the fresh air injection device is directed to the rear panel, and an included angle between the fresh air injection device and the rear panel is greater than or equal to 2 degrees and less than or equal to 20 degrees; or the fresh air injection device is on a side of the second heat exchanger facing the lower side panel, and an injection direction of the fresh air injection device is directed to the lower side panel along the second direction.

* * * * *